US007047728B2

(12) United States Patent
Yasui

(10) Patent No.: US 7,047,728 B2
(45) Date of Patent: May 23, 2006

(54) APPARATUS FOR AND METHOD OF CONTROLLING AIR-FUEL RATIO OF INTERNAL COMBUSTION ENGINE, AND RECORDING MEDIUM STORING PROGRAM FOR CONTROLLING AIR-FUEL RATIO OF INTERNAL COMBUSTION ENGINE

(75) Inventor: Yuji Yasui, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/636,661

(22) Filed: Aug. 8, 2003

(65) Prior Publication Data

US 2004/0030485 A1 Feb. 12, 2004

(30) Foreign Application Priority Data

Aug. 8, 2002 (JP) ..... 2002-230739

(51) Int. Cl.
*F01N 3/00* (2006.01)

(52) U.S. Cl. ..... 60/285; 60/274; 60/276; 60/277; 60/284; 60/286; 73/118.1; 73/23.32; 701/103; 701/109

(58) Field of Classification Search ..... 60/274, 60/276, 277, 285, 284, 286, 300; 73/118.1, 73/23.31, 23.32; 701/103, 104, 109
See application file for complete search history.

(56) References Cited

U.S. PATENT DOCUMENTS

| | | | | |
|---|---|---|---|---|
| 4,941,318 | A * | 7/1990 | Matsuoka | 60/274 |
| 5,669,219 | A * | 9/1997 | Schnaibel et al. | 60/274 |
| 6,094,975 | A * | 8/2000 | Hasegawa et al. | 73/118.1 |
| 6,164,125 | A * | 12/2000 | Kawase et al. | 73/118.1 |
| 6,188,953 | B1 | 2/2001 | Yasui et al. | |
| 6,354,134 | B1 * | 3/2002 | Katafuchi et al. | 73/23.32 |

FOREIGN PATENT DOCUMENTS

JP 11-324767 11/1999

* cited by examiner

*Primary Examiner*—Binh Q. Tran
(74) *Attorney, Agent, or Firm*—Squire, Sanders & Dempsey L.L.P.

(57) ABSTRACT

A target value Vtgt for an output Vout of an $O_2$ sensor 8 (an exhaust gas sensor) disposed downstream of a catalytic converter 4 is set variably depending on a temperature $T_{O2}$ of an active element 10 of the $O_2$ sensor 8 by a target value setting unit 18, and the air-fuel ratio of an exhaust gas is controlled by an air-fuel ratio control unit 17 to converge the output Vout to the target value Vtgt. An exhaust gas temperature Tgd is estimated by an exhaust temperature observer 19, and the temperature $T_{O2}$ of the active element 10 is sequentially estimated by an element temperature observer 20 using the estimated value of the exhaust gas temperature Tgd. A heater 13 of the $O_2$ sensor 8 is controlled by a heater controller 22 to keep the temperature $T_{O2}$ of the active element 10 at a predetermined target value R. The air-fuel ratio is thus controlled to maintain a desired exhaust gas purifying capability of the catalytic converter irrespective of the temperature of the active element of the exhaust gas sensor.

42 Claims, 12 Drawing Sheets

APPARATUS FOR AND METHOD OF CONTROLLING AIR-FUEL RATIO OF INTERNAL COMBUSTION ENGINE, AND RECORDING MEDIUM STORING PROGRAM FOR CONTROLLING AIR-FUEL RATIO OF INTERNAL COMBUSTION ENGINE

BACKGROUND OF THE INVENTION

1. Field of the Invention

The present invention relates to an apparatus for and a method of controlling the air-fuel ratio of an internal combustion engine, and a recording medium storing a program for controlling the air-fuel ratio of an internal combustion engine.

2. Description of the Related Art

Heretofore, it has been known in the art to place an exhaust sensor downstream of a catalytic converter that is disposed in the exhaust passage of an internal combustion engine, the exhaust sensor having a sensitive element that is sensitive to a certain component of the exhaust gas, and control the air-fuel ratio of the exhaust gas that is supplied from the internal combustion engine to the catalytic converter in order to converge an output of the exhaust gas sensor to a predetermined target value for the purpose of achieving a desired exhaust gas purifying capability of the catalytic converter. For example, Japanese laid-open patent publication No. 11-324767 and U.S. Pat. No. 6,188,953 disclose a system, proposed by the applicant of the present application, wherein an $O_2$ sensor serving as an exhaust gas sensor for generating an output depending on the concentration of oxygen in an exhaust gas is disposed downstream of a catalytic converter comprising a three-way catalyst, and the air-fuel ratio is controlled to converge the output of the $O_2$ sensor to a predetermined target value for thereby enabling the catalytic converter to purify CO (carbon monoxide), HC (hydrocarbons), and NOx (nitrogen oxides) contained in the exhaust gas. The disclosed system is based on he phenomenon that when the air-fuel ratio of the exhaust gas supplied from the internal combustion engine to the catalytic converter is controlled at an air-fuel ratio state wherein the output (output voltage) of the $O_2$ sensor disposed downstream of the catalytic converter is settled on a certain constant value, the purification rate of CO (carbon monoxide), HC (hydrocarbons), and NOx (nitrogen oxides) by the catalytic converter is kept at a good level (substantially maximum level) regardless of the deteriorated state of the catalytic converter.

Some exhaust gas sensors such as $O_2$ sensors have a heater for heating the sensitive element thereof to quickly activate the sensitive element after the internal combustion engine starts to operate.

Generally, exhaust gas sensors such as $O_2$ sensors have their output characteristics (representing an output voltage depending on the content of a certain component in the exhaust gas) that are variable depending on the temperature of the sensitive element. According to the findings of the inventors of the present invention, when the output of an $O_2$ sensor disposed downstream of a catalytic converter varies depending on the temperature of the sensitive element of the $O_2$ sensor, the output of the $O_2$ sensor that achieves a desired exhaust gas purifying capability of the catalytic converter also varies. Therefore, in the case where the temperature of the sensitive element of the $O_2$ sensor is easily variable due to the exhaust system layout or an operating state of the internal combustion engine, if the target value for the output of the $O_2$ sensor is set to a constant value, then it tends to be difficult to sufficiently achieve a desired exhaust gas purifying capability of the catalytic converter even by controlling the air-fuel ratio to maintain the output of the $O_2$ sensor at the target value thereof.

SUMMARY OF THE INVENTION

It is therefore an object of the present invention to provide an apparatus for and a method of controlling the air-fuel ratio of an internal combustion engine to maintain a desired exhaust gas purifying capability of the catalytic converter appropriately regardless of the temperature of a sensitive element of an exhaust gas sensor such as an $O_2$ sensor.

Another object of the present invention is to provide an apparatus for and a method of controlling the air-fuel ratio of an internal combustion engine to maintain a desired exhaust gas purifying capability of the catalytic converter stably regardless of the temperature of a sensitive element of an exhaust gas sensor such as an $O_2$ sensor.

Still another object of the present invention is to provide a recording medium storing a program for enabling a computer to control the air-fuel ratio of an internal combustion engine to maintain a desired exhaust gas purifying capability of the catalytic converter appropriately and stably regardless of the temperature of a sensitive element of an exhaust gas sensor such as an $O_2$ sensor.

To achieve the above objects, there are available two aspects of the present invention. According to a first aspect of the present invention, there is provided an apparatus for controlling the air-fuel ratio of an internal combustion engine, having an exhaust gas sensor disposed downstream of a catalytic converter that is positioned in an exhaust passage of the internal combustion engine and having an active element for contacting an exhaust gas passing through the catalytic converter, the active element being sensitive to a particular component in the exhaust gas, so that the air-fuel ratio of the exhaust gas supplied from the internal combustion engine to the catalytic converter is controlled to converge an output of the exhaust gas sensor to a predetermined target value, the apparatus comprising element temperature data acquiring means for sequentially acquiring element temperature data representative of the temperature of the active element of the exhaust gas sensor, and target value setting means for setting the target value variably depending on the element temperature data.

According to the first aspect of the present invention, there is also provided a method of controlling the air-fuel ratio of an internal combustion engine with an exhaust gas sensor disposed downstream of a catalytic converter that is positioned in an exhaust passage of the internal combustion engine and having an active element for contacting an exhaust gas passing through the catalytic converter, the active element being sensitive to a particular component in the exhaust gas, so that the air-fuel ratio of the exhaust gas supplied from the internal combustion engine to the catalytic converter is controlled to converge an output of the exhaust gas sensor to a predetermined target value, the method comprising the steps of sequentially acquiring element temperature data representative of the temperature of the active element of the exhaust gas sensor, and sequentially setting the target value variably depending on the element temperature data.

According to the first aspect of the present invention, there is further provided a recording medium readable by a computer and storing an air-fuel ratio control program for enabling the computer to control the air-fuel ratio of an internal combustion engine with an exhaust gas sensor disposed downstream of a catalytic converter that is positioned in an exhaust passage of the internal combustion engine and having an active element for contacting an exhaust gas passing through the catalytic converter, the active element being sensitive to a particular component in the exhaust gas, so that the air-fuel ratio of the exhaust gas supplied from the internal combustion engine to the catalytic converter is controlled to converge an output of the exhaust gas sensor to a predetermined target value, the air-fuel ratio control program comprising a program for enabling the computer to sequentially acquire element temperature data representative of the temperature of the active element of the exhaust gas sensor, and set the target value variably depending on the element temperature data.

According to the first aspect of the present invention, since the target value for the output of the exhaust gas sensor is set variably depending on the element temperature data representative of the temperature of the active element of the exhaust gas sensor, the target value can be set to match the temperature of the active element and hence the output characteristics of the exhaust gas sensor that correspond to the temperature of the active element. As a result, it is possible to set the target value for the output of the exhaust gas sensor which is appropriate for keeping a desired exhaust gas purifying capability of the catalytic converter irrespective of the temperature of the active element of the exhaust gas sensor. By controlling the air-fuel ratio in order to converge the output of the exhaust gas sensor to the target value thus set, the desired exhaust gas purifying capability of the catalytic converter can be maintained appropriately regardless of the temperature of the active element of the exhaust gas sensor or factors (the layout of an exhaust system of the internal combustion engine and an operating state of the internal combustion engine) that affect the temperature of the active element.

In the first aspect of the present invention, a temperature sensor for detecting the temperature of the active element may be provided, and the temperature of the active element as detected by the temperature sensor may be used as the element temperature data. However, using such a temperature sensor is disadvantageous as to cost, and there is a problem with respect to the durability of the temperature sensor. In the apparatus according to the first aspect of the present invention, therefore, the element temperature data acquiring means should preferably comprise means for sequentially determining an estimated value of the temperature of the active element as the element temperature data, using a parameter representative of at least an operating state of the internal combustion engine.

Similarly, the method according to the first aspect of the present invention should preferably further comprise the step of sequentially determining an estimated value of the temperature of the active element as the element temperature data, using a parameter representative of at least an operating state of the internal combustion engine.

In the recording medium according to the first aspect of the present invention, the program for enabling the computer to sequentially acquire the element temperature data should preferably be arranged to enable the computer to sequentially determine an estimated value of the temperature of the active element as the element temperature data, using a parameter representative of at least an operating state of the internal combustion engine.

Specifically, the temperature of the active element is strongly affected by the temperature of the exhaust gas that is brought into contact with the active element, and the temperature of the exhaust gas primarily depends on the operating state of the internal combustion engine. Therefore, the temperature of the active element can be estimated relatively accurately using the parameter representative of the operating state of the internal combustion engine. By setting the target value for the output of the exhaust gas sensor using the estimated value of the temperature of the active element as the element temperature data, it is possible to construct at a low cost a system which is capable of keeping the desired exhaust gas purifying capability of the catalytic converter. The parameter representative of the operating state of the internal combustion engine which is used to determine the estimated value of the temperature of the active element should preferably be a parameter that is highly correlated to the temperature of the exhaust gas, and should preferably include at least a parameter representing a rotational speed of the internal combustion engine (e.g., a detected value of the rotational speed) and a parameter representing an amount of intake air supplied to the internal combustion engine (e.g., a detected value of an intake pressure).

For estimating the temperature of the active element using the parameter representative of the operating state of the internal combustion engine, it is possible to determine the temperature of the active element from the parameter based on a predetermined map or data table. To increase the accuracy of the estimated value of the temperature of the active element, it is preferable to arrange the apparatus, the method, and the recording medium according to the first aspect as follows: In the apparatus according to the first aspect, the element temperature data acquiring means should preferably comprise means for estimating a temperature of the exhaust gas using the parameter representative of at least the operating state of the internal combustion engine, and determining the estimated value of the temperature of the active element, using an estimated value of the temperature of the exhaust gas and a predetermined thermal model representative of a heat exchange relationship between the exhaust gas and the active element.

In the method according to the first aspect, the step of sequentially determining the estimated value of the temperature of the active element should preferably comprise the steps of sequentially estimating a temperature of the exhaust gas using the parameter representative of at least the operating state of the internal combustion engine, and determining the estimated value of the temperature of the active element, using an estimated value of the temperature of the exhaust gas and a predetermined thermal model representative of a heat exchange relationship between the exhaust gas and the active element.

In the recording medium according to the first aspect, the program for enabling the computer to sequentially acquire the element temperature data should preferably be arranged to enable the computer to sequentially estimate a temperature of the exhaust gas using the parameter representative of at least the operating state of the internal combustion engine, and determine the estimated value of the temperature of the active element, using an estimated value of the temperature of the exhaust gas and a predetermined thermal model representative of a heat exchange relationship between the exhaust gas and the active element.

Since the operating state of the internal combustion engine directly affects the temperature of the exhaust gas produced by the internal combustion engine, the temperature of the exhaust gas can be estimated relatively accurately using the parameter representing the operating state of the internal combustion engine. By determining the estimated value of the temperature of the active element using the estimated value of the temperature of the exhaust gas and the predetermined thermal model, it is possible to determine the estimated value of the temperature of the active element in view of the heat exchange relationship between the exhaust gas and the active element that is brought into contact with the exhaust gas. As a result, the accuracy of the estimated value of the temperature of the active element is increased. Thus, it is possible to set the target value for the output of the exhaust gas sensor to match the actual temperature of the active element, more appropriately achieving the desired exhaust gas purifying capability of the catalytic converter.

The heat exchange relationship between the exhaust gas and the active element, which is represented by the above thermal model, is a relationship wherein the rate of change (change per unit time) of the temperature of the active element depends on the difference between the temperature of the active element and the temperature of the exhaust gas. The thermal model may not necessarily be representative of the heat exchange relationship between the active element and the exhaust gas only, but may be representative of something other than the heat exchange relationship between the active element and the exhaust gas (i.e., something that affects the temperature of the active element), e.g., the heat exchange relationship between the active element and the air in the active element.

For estimating the temperature of the active element with as high accuracy as possible using the estimated value of the temperature of the exhaust gas and the heat exchange relationship between the exhaust gas and the active element, it is preferable to estimate, as accurately as possible, the temperature of the exhaust gas in the vicinity of the location of the exhaust gas sensor (in the vicinity of the active element), and use the estimated temperature to estimate the temperature of the active element. More specifically, the operating state of the internal combustion engine directly affects the temperature of the exhaust gas in the vicinity of an exhaust port of the internal combustion engine. It takes a certain time for the exhaust gas in the vicinity of the exhaust port of the internal combustion engine to flow to the location of the exhaust gas sensor. In general, while the exhaust gas is flowing to the location of the exhaust gas sensor, it causes a heat transfer to surrounding objects (an exhaust pipe, a catalyst in the catalyst converter, etc.), and a heat radiation into the atmosphere. Consequently, the temperature of the exhaust gas in the vicinity of the exhaust port from instant to instant may not necessarily be equivalent or substantially equivalent to the temperature of the exhaust gas in the vicinity of the location of the exhaust gas sensor.

Therefore, the estimated value of the temperature of the exhaust gas which is used to determine the estimated value of the temperature of the active element should preferably comprise an estimated value of the temperature of the exhaust gas in the vicinity of the location of the exhaust gas sensor. In the apparatus according to the first aspect, the element temperature data acquiring means should preferably comprise means for estimating a temperature of the exhaust gas in the vicinity of an exhaust port of the internal combustion engine using the parameter representative of the operating state of the internal combustion engine, and determining an estimated value of the temperature of the exhaust gas in the vicinity of the location of the exhaust gas sensor, using an estimated value of the temperature of the exhaust gas in the vicinity of the exhaust port and a predetermined thermal model representative of a change in the temperature of the exhaust gas as the exhaust gas flows from near the exhaust port to the location of the exhaust gas sensor.

In the method according to the first aspect, the step of sequentially determining the estimated value of the temperature of the active element should preferably comprise the steps of estimating a temperature of the exhaust gas in the vicinity of an exhaust port of the internal combustion engine using the parameter representative of the operating state of the internal combustion engine, and determining an estimated value of the temperature of the exhaust gas in the vicinity of the location of the exhaust gas sensor, using an estimated value of the temperature of the exhaust gas in the vicinity of the exhaust port and a predetermined thermal model representative of a change in the temperature of the exhaust gas as the exhaust gas flows from near the exhaust port to the location of the exhaust gas sensor.

In the recording medium according to the first aspect, the program for enabling the computer to sequentially acquire the element temperature data should preferably be arranged to enable the computer to estimate a temperature of the exhaust gas in the vicinity of an exhaust port of the internal combustion engine using the parameter representative of the operating state of the internal combustion engine, and determine an estimated value of the temperature of the exhaust gas in the vicinity of the location of the exhaust gas sensor, using an estimated value of the temperature of the exhaust gas in the vicinity of the exhaust port and a predetermined thermal model representative of a change in the temperature of the exhaust gas as the exhaust gas flows from near the exhaust port to the location of the exhaust gas sensor.

By estimating the temperature of the exhaust gas in the vicinity of the location of the exhaust gas sensor using the parameter representative of the operating state of the internal combustion engine, the accuracy of the estimated value of the temperature of the exhaust gas is sufficiently increased. By further estimating the temperature of the exhaust gas in the vicinity of the location of the exhaust gas sensor using the estimated value of the temperature of the exhaust gas in the vicinity of the exhaust port and the predetermined thermal model, a change in the temperature of the exhaust gas as it flows from near the exhaust port to the location of the exhaust gas sensor is taken into account, allowing the estimated value of the temperature of the exhaust gas in the vicinity of the location of the exhaust gas sensor to be determined accurately. As a result, the accuracy of the estimated value of the temperature of the active element that is determined using the estimated value of the temperature of the exhaust gas can further be increased. Thus, the matching between the target value for the output of the exhaust gas sensor that is set depending on the estimated value of the temperature of the active element and the actual temperature of the active element can further be increased, making it possible to maintain more appropriately the desired exhaust gas purifying capability of the catalytic converter.

The thermal model relative to the change in the temperature of the exhaust gas should preferably be a model representative of a heat transfer between the exhaust gas and a passage-defining member (the exhaust pipe, the catalyst, or the like) through which the exhaust gas flows, a change in the temperature of the exhaust gas due to the radiation of heat through the passage-defining member into the atmosphere, a change in the temperature of the exhaust gas due to the heating of the catalyst, and a change in the temperature of the exhaust gas due to a temperature gradient in the direction in which the exhaust gas flows and a speed at which the exhaust gas flows.

In the first aspect of the present invention, a heater for heating the active element of the exhaust gas sensor may not necessarily be required. However, a heater for heating the active element for increasing the temperature of the active element to activate the active element, and a heater control means for controlling the heater may be provided. If a heater and a heater control means are provided, and the temperature of the active element is estimated using the estimated value of the temperature of the exhaust gas, then the following arrangements should preferably be employed: In the apparatus according to the first aspect, the element temperature data acquiring means should preferably comprise means for determining the estimated value of the temperature of the active element using the estimated value of the temperature of the exhaust gas, heater energy supplied quantity data representing a quantity of heating energy supplied from the heater control means to the heater, and a predetermined thermal model representative of the heat exchange relationship between the exhaust gas and the active element, a heat exchange relationship between the active element and the heater, and the heating of the heater with the heating energy supplied to the heater.

Likewise, in the method according to the first aspect, the step of sequentially determining the estimated value of the temperature of the active element should preferably comprise the steps of determining the estimated value of the temperature of the active element using the estimated value of the temperature of the exhaust gas, heater energy supplied quantity data representing a quantity of heating energy supplied to a heater for heating the active element, and a predetermined thermal model representative of the heat exchange relationship between the exhaust gas and the active element, a heat exchange relationship between the active element and the heater, and the heating of the heater with the heating energy supplied to the heater.

In the recording medium according to the first aspect, the program for enabling the computer to sequentially acquire the element temperature data should preferably be arranged to enable the computer to determine the estimated value of the temperature of the active element using the estimated value of the temperature of the exhaust gas, heater energy supplied quantity data representing a quantity of heating energy supplied to a heater for heating the active element, and a predetermined thermal model representative of the heat exchange relationship between the exhaust gas and the active element, a heat exchange relationship between the active element and the heater, and the heating of the heater with the heating energy supplied to the heater.

Specifically, if the heater is provided, then the heating of the heater as well as the exhaust gas strongly affects the temperature of the active element. Therefore, in order to determine the estimated value of the temperature of the active element with accuracy, it is preferable to use, in addition to the estimated value of the temperature of the exhaust gas (preferably the estimated value of the temperature of the exhaust gas in the vicinity of the location of the exhaust gas sensor), the heater energy supplied quantity data representing the quantity of heating energy supplied to the heater, and also the thermal model representative of, in addition to the heat exchange relationship between the exhaust gas and the active element, the heat exchange relationship between the heater and the active element, and the heating of the heater with the heating energy supplied to the heater. Such an arrangement makes it possible to determine the estimated value of the temperature of the active element with accuracy. Thus, the matching between the target value for the output of the exhaust gas sensor that is set depending on the estimated value of the temperature of the active element and the actual temperature of the active element can further be increased, making it possible to maintain more appropriately the desired exhaust gas purifying capability of the catalytic converter.

If the heater is an electric heater, then a detected value of the voltage supplied to the heater or a command value for the voltage supplied to the heater, or a detected value of the current supplied to the heater or a command value for the current supplied to the heater, or the product of those values may be used as the heater energy supplied quantity data. If the energization of the heater is controlled according to a PWM control process, then the duty cycle of a pulse signal generated for controlling the energization of the heater according to the PWM control process may be used as the heater energy supplied quantity data. The thermal model that is representative of the heat exchange relationship between the exhaust gas and the active element, the heat exchange relationship between the active element and the heater, and the heating of the heater with the heating energy supplied to the heater is a model that is representative of a relationship wherein the rate of change (change per unit time) of the temperature of the active element depends on the difference between the temperature of the active element and the temperature of the exhaust gas and the difference between the temperature of the active element and the temperature of the heater, and the rate of change of the temperature of the heater depends on the difference between the temperature of the active element and the temperature of the heater and the amount of heating energy supplied to the heater. The thermal model may represent, in addition to the heat exchange relationship between the active element and the heater, other factors that affect the temperatures of the active element and the heater, e.g., the heat exchange relationship between the active element and the air in the active element, and the heat exchange relationship between the heater and the air in the active element.

If the apparatus according to the first aspect further comprises a heater for heating the active element and heater control means for controlling the heater, then the element temperature data acquiring means may comprise means for sequentially determining an estimated value of the temperature of the active element as the element temperature data, using at least heater energy supplied quantity data representing a quantity of heating energy supplied from the heater control means to the heater, and a predetermined thermal model representative of a heat exchange relationship between the active element and the heater, and the heating of the heater with the heating energy supplied to the heater.

Similarly, the method according to the first aspect may also comprise the step of sequentially determining an estimated value of the temperature of the active element as the element temperature data, using heater energy supplied quantity data representing a quantity of heating energy supplied to a heater for heating the active element, and a predetermined thermal model representative of a heat exchange relationship between the active element and the heater, and the heating of the heater with the heating energy supplied to the heater.

In the recording medium according to the first aspect, the program for enabling the computer to sequentially acquire the element temperature data may be arranged to enable the computer to sequentially determine an estimated value of the temperature of the active element as the element temperature data, using heater energy supplied quantity data representing a quantity of heating energy supplied to a heater for heating the active element, and a predetermined thermal model representative of a heat exchange relationship between the active element and the heater, and the heating of the heater with the heating energy supplied to the heater.

Specifically, under conditions in which a change in the temperature of the exhaust gas is relatively small, e.g., when the internal combustion engine operates in a steady state, a change in the temperature of the active element is mainly caused by the heating of the heater. Accordingly, by using the heater energy supplied quantity data representing the quantity of heating energy supplied to the heater, and the predetermined thermal model representative of the heat exchange relationship between the active element and the heater, and the heating of the heater with the heating energy supplied to the heater, the estimated value of the temperature of the active element can be determined relatively accurately without the use of detected and estimated values of the temperature of the exhaust gas. Thus, the matching between the target value for the output of the exhaust gas sensor that is set depending on the estimated value of the temperature of the active element and the actual temperature of the active element can further be increased, making it possible to maintain more appropriately the desired exhaust gas purifying capability of the catalytic converter. The data for use as the heater energy supplied quantity data may be the same as when the temperature of the exhaust energy is taken into account as described above. The thermal model representative of the heat exchange relationship between the active element and the heater, and the heating of the heater with the heating energy supplied to the heater is a model that is representative of a relationship wherein the rate of change (change per unit time) of the temperature of the active element depends on the difference between the temperature of the active element and the temperature of the heater, and the rate of change of the temperature of the heater depends on the difference between the temperature of the active element and the temperature of the heater and the amount of heating energy supplied to the heater. The thermal model may represent, in addition to the heat exchange relationship between the active element and the heater, the heat exchange relationship between the active element and the air in the active element, and the heat exchange relationship between the heater and the air in the active element.

According to the first aspect of the present invention, when the temperature of the active element changes, though it is possible to set the target value for the output of the exhaust gas sensor that is suitable to maintain the desired exhaust gas purifying capability of the catalytic converter, but when the target value frequently or abruptly changes, the stability of the process of controlling the air-fuel ratio may possibly be impaired. In the apparatus according to the first aspect which has the heater, the heater control means should preferably control the heater to keep the active element at a predetermined temperature. The method according to the first aspect should preferably comprise the step of controlling the heater for heating the active element to keep the active element at a predetermined temperature. Furthermore, in the recording medium according to the first aspect, the air-fuel ratio control program should preferably include a program for enabling the computer to control the heater for heating the active element to keep the active element at a predetermined temperature.

By thus controlling the heater to keep the active element at a predetermined temperature, any changes in the temperature of the active element are minimized, and the temperature of the active element and hence the output characteristics of the exhaust gas sensor can be stabilized maximally. Therefore, any frequent or abrupt changes in the target value for the output of the exhaust gas sensor that is set by the target value setting means are minimized. As a result, the stability of the process of controlling the air-fuel ratio to converge the output of the exhaust gas sensor to the target value can be increased, and hence the desired exhaust gas purifying capability of the catalytic converter can stably be maintained.

The predetermined temperature at which the active element is to be kept should basically be of a constant value for the purpose of stabilizing the output characteristics of the exhaust gas sensor. However, immediately after the internal combustion engine has started to operate or when the atmospheric temperature is relatively low, the predetermined temperature as a target temperature for the active element may be lower than normal. For controlling the temperature of the active element to be kept at the predetermined temperature, the amount of energy supplied to the heater may be controlled by the heater control means according to a feedback control process depending on the difference between the temperature of the active element that is represented by the element temperature data and the predetermined temperature as the target temperature for the active element. Alternatively, since the temperature of the active element and the temperature of the heater are highly correlated to each other, heater temperature data representing the temperature of the heater may be acquired by an estimating process, in addition to the element temperature data, and the amount of energy supplied to the heater may be controlled according to a feedback control process depending on the difference between the temperature of the heater that is represented by the heater temperature data and a target temperature for the heater which corresponds to the predetermined temperature for the active element.

According to findings of the inventors of the present invention, if the heater is used to heat the active element, the temperature of the heater and the temperature of the active element are highly correlated to each other. In a steady state, for example, the temperature of the heater has a tendency to be higher than the temperature of the active element by a constant temperature. Therefore, if the target value for the output of the exhaust gas sensor is set depending on the temperature of the heater, for example, then the target value can be set indirectly depending on the temperature of the active element. According to a second aspect of the present invention, there is provided an apparatus for controlling the air-fuel ratio of an internal combustion engine, having an exhaust gas sensor disposed downstream of a catalytic converter that is positioned in an exhaust passage of the internal combustion engine and having an active element for contacting an exhaust gas passing through the catalytic converter, the active element being sensitive to a particular component in the exhaust gas, and a heater for heating the active element, and heater control means for controlling the heater, so that the air-fuel ratio of the exhaust gas supplied from the internal combustion engine to the catalytic converter is controlled to converge an output of the exhaust gas sensor to a predetermined target value, the apparatus comprising heater temperature data acquiring means for sequentially acquiring heater temperature data representative of the temperature of the heater of the exhaust gas sensor, and target value setting means for setting the target value variably depending on the heater temperature data.

According to the second aspect of the present invention, there is also provided a method of controlling the air-fuel ratio of an internal combustion engine with an exhaust gas sensor disposed downstream of a catalytic converter that is positioned in an exhaust passage of the internal combustion engine and having an active element for contacting an exhaust gas passing through the catalytic converter, the active element being sensitive to a particular component in the exhaust gas, and a heater for heating the active element, so that the air-fuel ratio of the exhaust gas supplied from the internal combustion engine to the catalytic converter is controlled to converge an output of the exhaust gas sensor to a predetermined target value, the method comprising the steps of sequentially acquiring heater temperature data representative of the temperature of the heater, and setting the target value variably depending on the heater temperature data.

According to the second aspect of the present invention, there is further provided a recording medium readable by a computer and storing an air-fuel ratio control program for enabling the computer to control the air-fuel ratio of an internal combustion engine with an exhaust gas sensor disposed downstream of a catalytic converter that is positioned in an exhaust passage of the internal combustion engine and having an active element for contacting an exhaust gas passing through the catalytic converter, the active element being sensitive to a particular component in the exhaust gas, and a heater for heating the active element, so that the air-fuel ratio of the exhaust gas supplied from the internal combustion engine to the catalytic converter is controlled to converge an output of the exhaust gas sensor to a predetermined target value, the air-fuel ratio control program comprising a program for enabling the computer to sequentially acquire heater temperature data representative of the temperature of the heater, and set the target value variably depending on the heater temperature data.

According to the second aspect, since the target value for the output of the exhaust gas sensor is set depending on the heater temperature data that represents the temperature of the heater which is highly correlated to the temperature of the active element, the target value can be set indirectly to match the temperature of the active element and hence the output characteristics of the exhaust gas sensor that correspond to the temperature of the active element. As a result, as with the first aspect, it is possible to set the target value for the output of the exhaust gas sensor which is appropriate for keeping a desired exhaust gas purifying capability of the catalytic converter irrespective of the temperature of the active element of the exhaust gas sensor. By controlling the air-fuel ratio in order to converge the output of the exhaust gas sensor to the target value thus set, the desired exhaust gas purifying capability of the catalytic converter can be maintained appropriately regardless of the temperature of the active element of the exhaust gas sensor or factors (the layout of an exhaust system of the internal combustion engine and an operating state of the internal combustion engine) that affect the temperature of the active element.

In the second aspect of the present invention, a temperature sensor for detecting the temperature of the heater may be provided, and the temperature of the heater as detected by the temperature sensor may be used as the heater temperature data. However, using such a temperature sensor is disadvantageous as to cost, and there is a problem with respect to the durability of the temperature sensor. In the apparatus according to the second aspect of the present invention, therefore, as with the apparatus which has the heater and estimates the temperature of the active element according to the first aspect, the heater temperature data acquiring means should preferably comprise means for estimating a temperature of the exhaust gas using a parameter representative of at least an operating state of the internal combustion engine, and sequentially determining an estimated value of the temperature of the heater as the heater temperature data, using an estimated value of the temperature of the exhaust gas, heater energy supplied quantity data representing a quantity of heating energy supplied from the heater control means to the heater, and a predetermined thermal model representative of a heat exchange relationship between the exhaust gas and the active element, a heat exchange relationship between the active element and the heater, and the heating of the heater with the heating energy supplied to the heater.

Similarly, the method according to the second aspect should preferably further comprise the steps of estimating a temperature of the exhaust gas using a parameter representative of at least an operating state of the internal combustion engine, and sequentially determining an estimated value of the temperature of the heater as the heater temperature data, using an estimated value of the temperature of the exhaust gas, heater energy supplied quantity data representing a quantity of heating energy supplied to the heater, and a predetermined thermal model representative of a heat exchange relationship between the exhaust gas and the active element, a heat exchange relationship between the active element and the heater, and the heating of the heater with the heating energy supplied to the heater.

In the recording medium according to the first aspect, the program for enabling the computer to sequentially acquire heater temperature data should preferably be arranged to enable the computer to estimate a temperature of the exhaust gas using a parameter representative of at least an operating state of the internal combustion engine, and sequentially determine an estimated value of the temperature of the heater as the heater temperature data, using an estimated value of the temperature of the exhaust gas, heater energy supplied quantity data representing a quantity of heating energy supplied to the heater, and a predetermined thermal model representative of a heat exchange relationship between the exhaust gas and the active element, a heat exchange relationship between the active element and the heater, and the heating of the heater with the heating energy supplied to the heater.

With the above arrangement, the estimated value of the temperature of the heater can be determined accurately in the same manner as the temperature of the active element is estimated. Thus, the matching between the target value for the output of the exhaust gas sensor that is set depending on the estimated value of the temperature of the heater and the actual temperature of the active element can be increased, making it possible to maintain more appropriately the desired exhaust gas purifying capability of the catalytic converter. The data for use as the heater energy supplied quantity data, the form of the thermal model, and the parameter representative of the operating state of the internal combustion engine may be the same as those of the first aspect of the present invention.

To increase the accuracy of the estimated value of the temperature of the heater, the estimated value of the temperature of the exhaust gas that is used to determine the estimated value of the temperature of the heater should preferably comprise an estimated value of the temperature of the exhaust gas in the vicinity of the location of the exhaust gas sensor. In the apparatus according to the second aspect, the heater temperature data acquiring means should preferably comprise means for estimating a temperature of the exhaust gas in the vicinity of an exhaust port of the internal combustion engine using the parameter representative of the operating state of the internal combustion engine, and determining an estimated value of the temperature of the exhaust gas in the vicinity of the location of the exhaust gas sensor, using an estimated value of the temperature of the exhaust gas in the vicinity of the exhaust port and a predetermined thermal model representative of a change in the temperature of the exhaust gas as the exhaust gas flows from near the exhaust port to the location of the exhaust gas sensor.

Similarly, in the method according to the second aspect, the step of sequentially determining the estimated value of the temperature of the heater should preferably comprise the steps of estimating a temperature of the exhaust gas in the vicinity of an exhaust port of the internal combustion engine using the parameter representative of the operating state of the internal combustion engine, and determining an estimated value of the temperature of the exhaust gas in the vicinity of the location of the exhaust gas sensor, using an estimated value of the temperature of the exhaust gas in the vicinity of the exhaust port and a predetermined thermal model representative of a change in the temperature of the exhaust gas as the exhaust gas flows from near the exhaust port to the location of the exhaust gas sensor.

In the recording medium according to the second aspect, the program for enabling the computer to sequentially acquire heater temperature data should preferably be arranged to enable the computer to estimate a temperature of the exhaust gas in the vicinity of an exhaust port of the internal combustion engine using the parameter representative of the operating state of the internal combustion engine, and determine an estimated value of the temperature of the exhaust gas in the vicinity of the location of the exhaust gas sensor, using an estimated value of the temperature of the exhaust gas in the vicinity of the exhaust port and a predetermined thermal model representative of a change in the temperature of the exhaust gas as the exhaust gas flows from near the exhaust port to the location of the exhaust gas sensor.

By thus estimating the temperature of the exhaust gas in the vicinity of the exhaust port of the internal combustion engine using the parameter representative of the operating state of the internal combustion engine, and estimating the temperature of the exhaust gas in the vicinity of the location of the exhaust gas sensor, using the estimated value of the temperature of the exhaust gas and the predetermined thermal model representative of the change in the temperature of the exhaust gas, the estimated value of the temperature of the exhaust gas in the vicinity of the location of the exhaust gas sensor can accurately be determined, as described above with respect to the first aspect of the present invention. As a result, the accuracy of the estimated value of the temperature of the heater using the estimated value of the temperature of the exhaust gas can further be increased. Thus, it is possible to increase the matching between the target value for the output of the exhaust gas sensor that is set depending on the estimated value of the temperature of the heater and the actual temperature of the active element, more appropriately achieving the desired exhaust gas purifying capability of the catalytic converter. The form of the thermal model relative to a change in the temperature of the exhaust gas may be the same as with the first aspect of the present invention.

In the apparatus according to the second aspect, the heater temperature data acquiring means should preferably comprise means for sequentially determining an estimated value of the temperature of the heater as the heater temperature data, using at least heater energy supplied quantity data representing a quantity of heating energy supplied from the heater control means to the heater, and a predetermined thermal model representative of a heat exchange relationship between the active element and the heater, and the heating of the heater with the heating energy supplied to the heater.

Similarly, the method according to the second aspect may further comprise the step of sequentially determining an estimated value of the temperature of the heater as the heater temperature data, using at least heater energy supplied quantity data representing a quantity of heating energy supplied to the heater, and a predetermined thermal model representative of a heat exchange relationship between the active element and the heater, and the heating of the heater with the heating energy supplied to the heater.

In the recording medium according to the second aspect, the program for enabling the computer to sequentially acquire heater temperature data may be arranged to enable the computer to sequentially determine an estimated value of the temperature of the heater as the heater temperature data, using at least heater energy supplied quantity data representing a quantity of heating energy supplied to the heater, and a predetermined thermal model representative of a heat exchange relationship between the active element and the heater, and the heating of the heater with the heating energy supplied to the heater.

Specifically, under conditions in which a change in the temperature of the exhaust gas is relatively small, e.g., when the internal combustion engine operates in a steady state, a change in the temperature of the heater is mainly caused by the heating of the heater. Accordingly, by using the heater energy supplied quantity data representing the quantity of heating energy supplied to the heater, and the predetermined thermal model representative of the heat exchange relationship between the active element and the heater, and the heating of the heater with the heating energy supplied to the heater, the estimated value of the temperature of the heater can be determined relatively accurately without the use of detected and estimated values of the temperature of the exhaust gas. Thus, the matching between the target value for the output of the exhaust gas sensor that is set depending on the estimated value of the temperature of the heater and the actual temperature of the active element can further be increased, making it possible to maintain more appropriately the desired exhaust gas purifying capability of the catalytic converter. The data for use as the heater energy supplied quantity data and the thermal model are the same as with the first aspect of the present invention.

In the apparatus according to the second aspect, as with the apparatus according to the first aspect, the heater control means should preferably comprise means for controlling the heater to keep the active element at a predetermined temperature.

Similarly, the method according to the second aspect should preferably further comprise the step of controlling the heater to keep the active element at a predetermined temperature.

In the recording medium according to the second aspect, the air-fuel ratio control program should preferably include a program for enabling the computer to control the heater to keep the active element at a predetermined temperature.

With the above arrangement, as described above with respect to the first aspect, any changes in the temperature of the active element are minimized, and the temperature of the active element and hence the output characteristics of the exhaust gas sensor can be stabilized maximally. Therefore, any frequent or abrupt changes in the target value for the output of the exhaust gas sensor that is set by the target value setting means are minimized. As a result, the stability of the process of controlling the air-fuel ratio to converge the output of the exhaust gas sensor to the target value can be increased, and hence the desired exhaust gas purifying capability of the catalytic converter can stably be maintained.

The heater may be controlled to keep the active element at a predetermined temperature in the same manner as with the first aspect as described above.

In the first and second aspects, if the exhaust gas sensor comprises an $O_2$ sensor and has such output characteristics that the output voltage thereof sharply changes from a low voltage level to a high voltage level when the oxygen concentration in the exhaust gas changes from a low concentration level to a high concentration level in the vicinity of the stoichiometric air-fuel ratio, then the target value should preferably be set to a higher output voltage value within a range in which the output voltage sharply changes (preferably a value close to the high voltage level in that range) as the temperature of the active element of the $O_2$ sensor or the temperature of the heater for heating the active element thereof is lower.

The above and other objects, features, and advantages of the present invention will become apparent from the following description when taken in conjunction with the accompanying drawings which illustrate preferred embodiments of the present invention by way of example.

DESCRIPTION OF THE PREFERRED EMBODIMENTS

Figure 1:
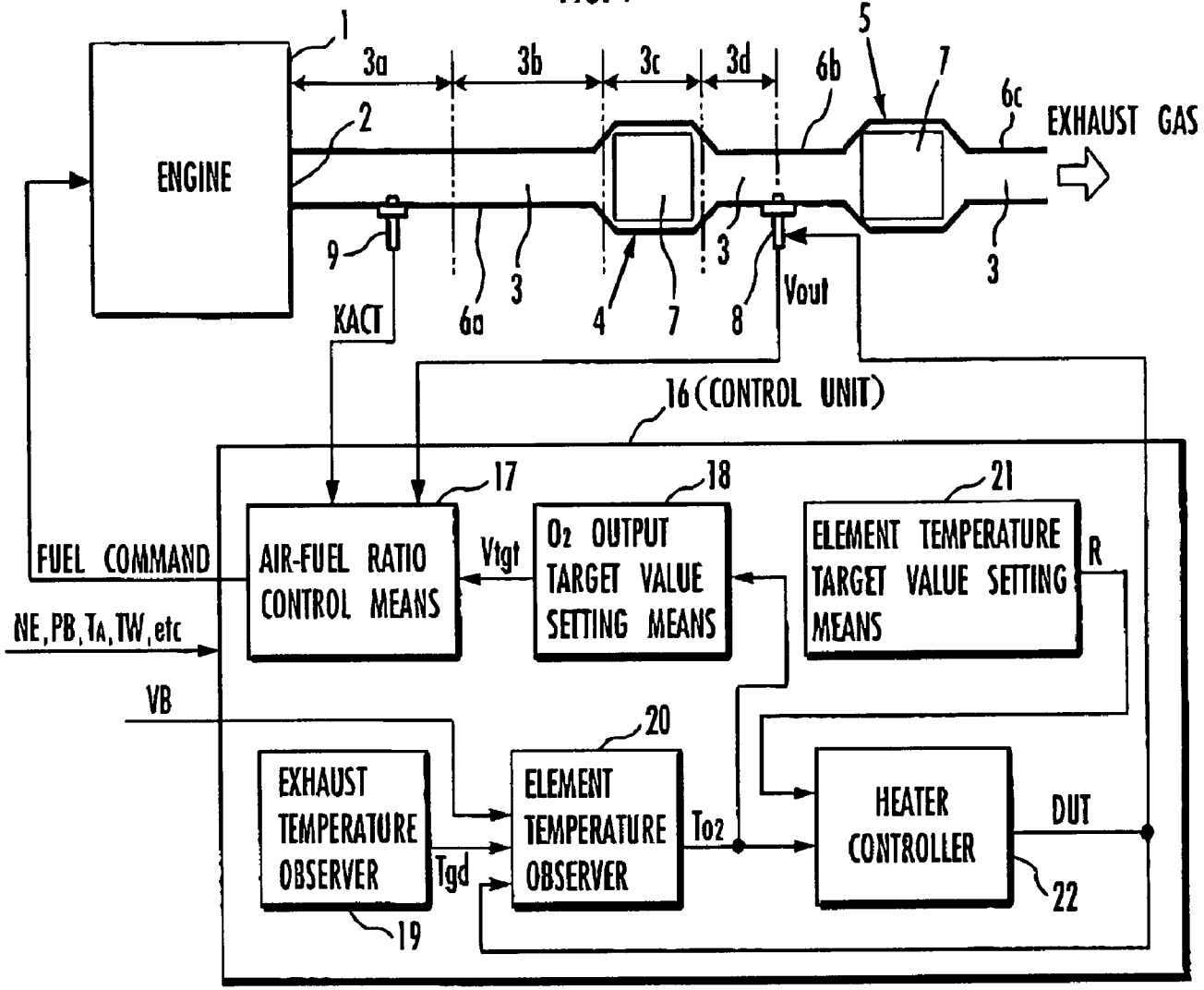
FIG. 1 is a block diagram of an apparatus for controlling the air-fuel ratio of an internal combustion engine according to a first embodiment of the present invention.

An apparatus for controlling the air-fuel ratio of an internal combustion engine according to a first embodiment of the present invention will be described below with reference to FIGS. 1 through 12. The first embodiment of the present invention corresponds to a first aspect of the present invention. FIG. 1 shows in block form an overall arrangement of the apparatus according to the first embodiment of the present invention. In FIG. 1, an engine (an internal combustion engine) 1 mounted on an automobile, a hybrid vehicle, or the like combusts a mixture of fuel and air and generates an exhaust gas, which is discharged into the atmosphere through an exhaust passage 3 communicating with an exhaust port 2 of the engine 1. The exhaust passage 3 incorporates therein two catalytic converters 4, 5 disposed successively downstream for purifying the exhaust gas emitted from the engine 1 and flowing through the exhaust passage 3. The exhaust passage 3 includes a section upstream of the catalytic converter 4 (between the exhaust port 2 and the catalytic converter 4), a section between the catalytic converters 4, 5, and a section downstream of the catalytic converter 5. These sections of the exhaust passage 3 are provided by respective tubular exhaust pipes 6*a*, 6*b*, 6*c*.

Each of the catalytic converters 4, 5 contains a catalyst 7 (three-way catalyst in the present embodiment). The catalyst 7 has a passage-defining honeycomb structure and allows the exhaust gas to flow therethrough. The catalytic converters 4, 5 may be of a unitary structure, such as the structure with two catalytic beds in one case, each comprising a three-way catalyst, disposed respectively in upstream and downstream regions thereof.

In the present embodiment, the air-fuel ratio of the exhaust gas emitted from the engine 1 is basically controlled in order for the upstream catalytic converter 4 to have a good exhaust gas purifying capability (the ability of the catalytic converter 4 to purify CO, HC, and NOx). For controlling the air-fuel ratio of the exhaust gas, an $O_2$ sensor 8 is mounted on the exhaust passage 3 between the catalytic converters 4, 5, i.e., on the exhaust passage defined by the exhaust pipe 6*b*, and a wide-range air-fuel ratio sensor 9 is mounted on the exhaust passage 3 upstream of the catalytic converter 4, i.e., on the exhaust passage defined by the exhaust pipe 6*a*. If the catalytic converters 4, 5 are of a unitary structure with two catalytic beds, then the $O_2$ sensor 8 is disposed between the upstream catalytic bed and the downstream catalytic bed.

Figure 2:
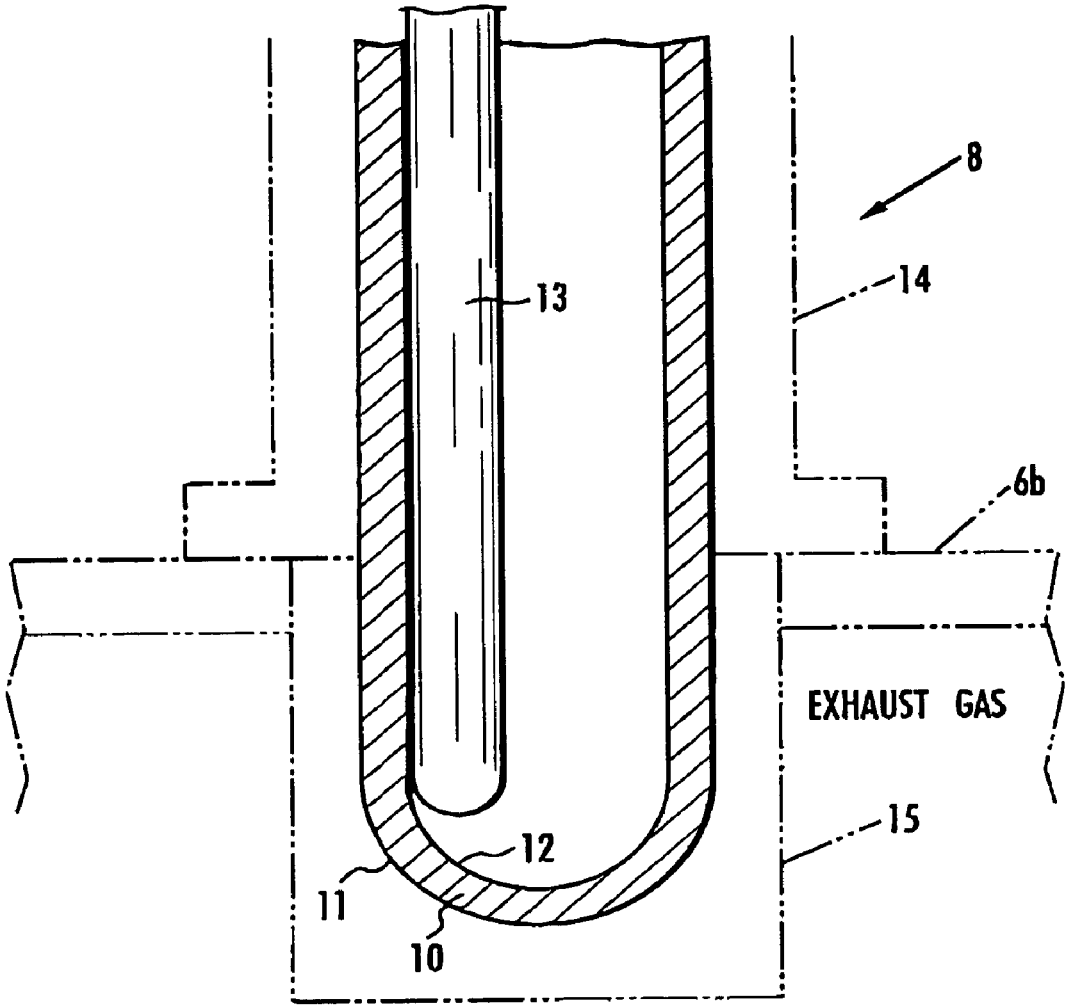
FIG. 2 is a fragmentary cross-sectional view of an $O_2$ sensor (exhaust gas sensor) in the apparatus shown in FIG. 1.

The $O_2$ sensor 8 corresponds to an exhaust gas sensor according to the present invention. Basic structural details and characteristics of the $O_2$ sensor 8 will be described below. As shown in FIG. 2, the $O_2$ sensor 8 has an active element 10 (sensitive element) in the form of a hollow bottomed cylinder made primarily of a solid electrolyte permeable to oxygen ions, e.g., stabilized zirconia ($ZrO_2$+$Y_2O_3$). The active element 10 has outer and inner surfaces coated with porous platinum electrodes 11, 12, respectively. The $O_2$ sensor 8 also has a rod-shaped ceramic heater 13 (hereinafter referred to as "heater 13") inserted as an electric heater into the active element 10 for heating the active element 10 for activation and controlling the temperature of the active element 10. The active element 10 is filled with air containing oxygen at a constant concentration, i.e., under a constant partial pressure, in a space around the ceramic heater 13. The $O_2$ sensor 8 is placed in a sensor casing 14 mounted on the exhaust pipe 6*b* such that the tip end of the active element 10 has its outer surface positioned in contact with the exhaust gas flowing in the exhaust pipe 6*b*.

The tip end of the active element 10 is covered with a tubular protector 15 which protects the active element 10 against the impingement of foreign matter thereon. The tip end of the active element 10 which is positioned in the exhaust pipe 6*b* contacts the exhaust gas through a plurality of holes (not shown) defined in the protector 15.

The $O_2$ sensor 8 thus constructed operates as follows: An electromotive force depending on the concentration of oxygen in the exhaust gas is generated between the platinum electrodes 11, 12 based on the difference between the concentration of oxygen in the exhaust gas which is brought into contact with the outer surface of the tip end of the active element 10 and the concentration of oxygen in the air in the active element 10. The generated electromotive force is amplified by an amplifier (not shown), and then produced as an output voltage Vout from the $O_2$ sensor 8.

Figure 3:
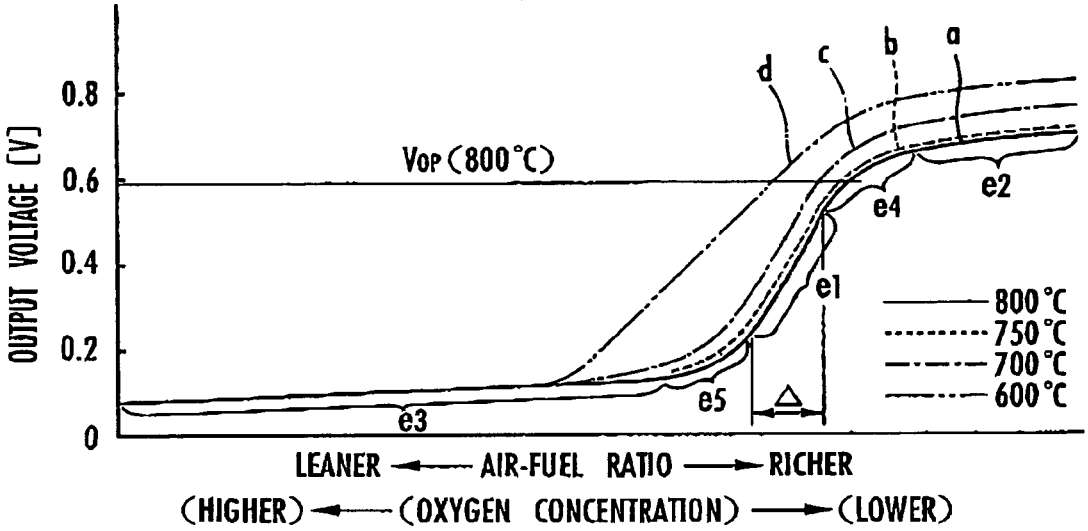
FIG. 3 is a graph illustrative of the output characteristics of the $O_2$ sensor shown in FIG. 2.

The output voltage Vout of the $O_2$ sensor 8 has characteristics (output characteristics) with respect to the concentration of oxygen in the exhaust gas or the air-fuel ratio of the exhaust gas which is recognized from the concentration of oxygen, as basically represented by a solid-line curve "a" (so-called "Z curve") in FIG. 3. The solid-line curve "a" represents the output characteristics of the $O_2$ sensor 8 when the temperature of the active element 10 is 800° C. The relationship between the temperature of the active element 10 and the output characteristics of the $O_2$ sensor 8 will be described later on.

As indicated by the curve "a" in FIG. 3, the output characteristics of the $O_2$ sensor 8 are generally of such a nature that the output voltage Vout changes substantially linearly with high sensitivity with respect to the air-fuel ratio of the exhaust gas only when the air-fuel ratio represented by the concentration of oxygen in the exhaust gas is present in a narrow air-fuel ratio range Δ near a stoichiometric air-fuel ratio. In the air-fuel ratio range Δ (hereinafter referred to as "high-sensitivity air-fuel ratio range Δ"), the gradient of a change in the output voltage Vout with respect to a change in the air-fuel ratio, i.e., the gradient of the curve of the output characteristics of the $O_2$ sensor 8, is large. In an air-fuel ratio range richer than the high-sensitivity air-fuel ratio range Δ and an air-fuel ratio range leaner than the high-sensitivity air-fuel ratio range Δ, the gradient of a change in the output voltage Vout with respect to a change in the air-fuel ratio of exhaust gas, i.e., the gradient of the curve of the output characteristics of the $O_2$ sensor 8, is smaller.

The wide-range air-fuel ratio sensor 9, which will not be described in detail below, comprises an air-fuel ratio sensor disclosed in Japanese laid-open patent publication No. 4-369471 or U.S. Pat. No. 5,391,282 by the applicant of the present application, for example. The wide-range air-fuel ratio sensor 9 is a sensor for generating an output voltage KACT which changes linearly with respect to the air-fuel ratio of the exhaust gas in an air-fuel ratio range wider than that of the $O_2$ sensor 8 and the output voltage Vout of the $O_2$ sensor 8 and the output voltage KACT of the wide-range air-fuel ratio sensor 9 will hereinafter be referred to as "output Vout" and "output KACT", respectively.

As shown in FIG. 1, the apparatus according to the first embodiment of the present embodiment also has a control unit 16 for controlling the air-fuel ratio of the exhaust gas and controlling the temperature of the active element 10 of the $O_2$ sensor 8, or the like. The control unit 16 comprises a microcomputer including a CPU, a RAM, and a ROM (not shown). For carrying out a control process to be described later on, the control unit 16 is supplied with the outputs Vout and KACT from the $O_2$ sensor 8 and the wide-range air-fuel ratio sensor 9, and also with data representing the rotational speed NE of the engine 1, the intake pressure PB (the absolute pressure in the intake pipe of the engine 1), and detected values of the atmospheric temperature $T_A$ and the engine temperature TW (specifically, the temperature of the coolant of the engine 1), from sensors (not shown) combined with the engine 1. The control unit 16 is also supplied from a sensor (not shown) with data of a detected value of the voltage VB (hereinafter referred to as "battery voltage VB") of a battery (not shown) that serves as a power supply for electric accessories including an igniter (not shown) of the engine 1, the control unit 16, and the heater 13.

The detected data of the rotational speed NE of the engine 1, the intake pressure PB, the atmospheric temperature $T_A$, and the engine temperature TW are data relative to a basic operating state of the engine 1, and are used in various processing sequences of the control unit 16 that are carried out by an air-fuel ratio control means 17, an exhaust temperature observer 19, etc. which will be described later on. The detected data of the battery voltage VB is used in a processing sequence carried out by an element temperature observer 20 which will be described later on. The outputs Vout and KACT from the $O_2$ sensor 8 and the wide-range air-fuel ratio sensor 9 are used in the processing sequence carried out by the air-fuel ratio control means 17. The non-illustrated ROM of the control unit 16 stores a program for carrying out a control process which will be described later on. The ROM corresponds to a recording medium according to the present invention.

The control unit 16 has as its functional means an air-fuel ratio control means 17 for controlling the air-fuel ratio of the exhaust gas emitted from the engine 1, an $O_2$ output target value setting means 18 for sequentially setting a target value Vtgt for the output Vout of the $O_2$ sensor 8 for an air-fuel ratio control process carried out by the air-fuel ratio control means 17, an exhaust temperature observer 19 for sequentially determining an estimated value of an exhaust gas temperature Tgd in the vicinity of the $O_2$ sensor 8, an element temperature observer 20 for sequentially determining an estimated value of a temperature $T_{O2}$ (hereinafter referred to as "element temperature $T_{O2}$") of the active element 10 of the $O_2$ sensor 8, an element temperature target value setting means 21 for setting a target value R for the element temperature $T_{O2}$, and a heater controller 22 for controlling the electric energy (for energizing the heater 13) supplied to the heater 13 in order to converge the element temperature $T_{O2}$ to the target value R using the target value R for the element temperature $T_{O2}$ and the estimated value of the temperature $T_{O2}$ which is determined by the element temperature observer 20.

The estimated value of the exhaust gas temperature Tgd which is determined by the exhaust temperature observer 19 is used in an estimating process carried out by the element temperature observer 20. The estimated value of the temperature $T_{O2}$ which is determined by the element temperature observer 20 is used in processes carried out by the $O_2$ output target value setting means 18 and the heater controller 22. The target value R which is determined by the element temperature target value setting means 21 is used in the process carried out by the heater controller 22. Of the functional means of the control unit 16, the $O_2$ output target value setting means 18 corresponds to a target value setting means according to the first aspect of the present invention, and the heater controller 22 corresponds to a heater control means. The exhaust temperature observer 19 and the element temperature observer 20 correspond to an element temperature data acquiring means according to the first aspect of the present invention. The estimated value of the temperature $T_{O2}$ which is determined by the element temperature observer 20 corresponds to element temperature data according to the first aspect of the present invention.

In the present embodiment, the heater 13 is controlled for its energization (PWM control) by giving a pulsed voltage to a heater energization circuit (not shown). The amount of electric energy supplied to the heater 13 can be controlled by adjusting the duty cycle DUT of the pulsed voltage (the ratio of the pulse duration to one period of the pulsed voltage). Therefore, the heater controller 22 sequentially determines the duty cycle DUT of the pulsed voltage applied to the heater energization circuit as a control input (manipulated variable) for controlling the heater 13, and adjusts the duty cycle DUT to control the amount of electric energy supplied to the heater 13 and hence the amount of heat generated by the heater 13. The duty cycle DUT generated by the heater controller 22 is also used in a processing sequence of the element temperature observer 20.

The above functional means of the control unit 16 will be described in greater detail below. The portion of the exhaust passage 3 which extends from the exhaust port 2 of the engine 1 to the position where the $O_2$ sensor 8 is located, i.e., the exhaust passage 3 upstream of the $O_2$ sensor 8, is divided into a plurality of (four in the present embodiment) partial exhaust passageways 3*a*, 3*b*, 3*c*, 3*d* along the direction in which the exhaust passage 3 extends, i.e., the direction in which the exhaust gas flows. The exhaust temperature observer 19 estimates, in a predetermined cycle time (period), the temperature of the exhaust gas at the exhaust port 2 (the inlet of the exhaust passage 3) and the temperatures of the exhaust gas in the respective partial exhaust passageways 3*a*, 3*b*, 3*c*, 3*d*, or specifically, the temperatures of the exhaust gas in the downstream ends of the respective partial exhaust passageways 3*a*, 3*b*, 3*c*, 3*d*, successively in the downstream direction. Of the partial exhaust passageways 3*a*, 3*b*, 3*c*, 3*d*, the partial exhaust passageways 3*a*, 3*b* are two partial exhaust passageways divided from the exhaust passage 3 upstream of the catalytic converter 4, i.e., the exhaust passage defined by the exhaust pipe 6*a*, the partial exhaust passageway 3*c* is a partial exhaust passageway extending from the inlet to outlet of the catalytic converter 4, i.e., the exhaust passage defined in the catalyst 7 in the catalytic converter 4, and the partial exhaust passageway 3*d* is a partial exhaust passageway extending from the outlet of the catalytic converter 4 to the position where the $O_2$ sensor 8 is located, i.e., the partial exhaust passageway defined by the exhaust pipe 6*b*. The exhaust temperature observer 19 has its algorithm constructed as follows:

The temperature of the exhaust gas at the exhaust port 2 of the engine 1 basically depends on the rotational speed NE and the intake pressure PB of the engine 1 while the engine 1 is operating in a steady state in which the rotational speed NE and the intake pressure PB of the engine 1 are kept constant. Therefore, the temperature of the exhaust gas at the exhaust port 2 can basically be estimated from detected values of the rotational speed NE and the intake pressure PB, which serve as parameters indicative of the operating state of the engine 1, based on a predetermined map which has been established by way of experimentation, for example. If the operating state (the rotational speed NE and the intake pressure PB) of the engine 1 varies, then the temperature of the exhaust gas at the exhaust port 2 suffers a delay in the response to the exhaust gas temperature determined by the map (hereinafter referred to as "basic exhaust gas temperature TMAP(NE,PB)") due to a heat exchange between the exhaust gas and a wall in the vicinity of the exhaust port 2 and a combustion chamber of the engine 1.

According to the present embodiment, the exhaust temperature observer 19 determines, in a predetermined cycle time (processing period), the basic exhaust gas temperature TMAP(NE,PB) from the detected values (latest detected values) of the rotational speed NE and the intake pressure PB of the engine 1 based on the map, and thereafter sequentially estimates an exhaust gas temperature Texg at the exhaust port 2 as a value which follows, with a time lag of first order, the basic exhaust gas temperature TMAP(NE, PB) as expressed by the following equation (1):

$$Texg(k)=(1-Ktex)\cdot Texg(k-1)+Ktex\cdot TMAP(NE,PB) \quad (1)$$

where k represents the ordinal number of a processing period of the exhaust temperature observer 19, and Ktex a coefficient (lag coefficient) predetermined by way of experimentation or the like (0<Ktex<1). In the present embodiment, the intake pressure PB of the engine 1 serves as a parameter representative of the amount of intake air introduced into the engine 1. Therefore, if a flow sensor is used for directly detecting the amount of intake air introduced into the engine 1, then the output of the flow sensor, i.e., a detected value of the amount of intake air, may be used instead of the detected value of the intake pressure PB. According to the present embodiment, an initial value Texg (0) of the estimated value of the exhaust gas temperature Texg is set to the atmospheric temperature $T_A$ that is detected by an atmospheric temperature sensor (not shown) when the engine 1 starts operating (upon an engine startup) or the engine temperature TW (the temperature of the coolant of the engine 1) detected by an engine temperature sensor (not shown), as described later on.

Using the estimated value of the exhaust gas temperature Texg at the exhaust port 2, the temperatures of the exhaust gas in the respective partial exhaust passageways 3*a*, 3*b*, 3*c*, 3*d* are estimated as described below. For illustrative purpose, a general heat transfer that occurs when a fluid flows through a circular tube 23 (see FIG. 5) which extends in the direction of a Z-axis in the atmosphere while exchanging heat with the tube wall of the circular tube 23 will be described below. It is assumed that the fluid temperature Tg and the temperature Tw of the tube wall (hereinafter referred to as "circular tube temperature Tw") are functions Tg(t,z), Tw(t,z) of the time t and the position z in the direction of the Z-axis, and the thermal conductivity of the tube wall of the circular tube 23 is infinite in the radial direction and nil in the direction of the Z-axis. It is also assumed that the heat transfer between the fluid and the tube wall of the circular tube 23 and the heat transfer between the tube wall of the circular tube 23 and the external atmosphere are proportional to their temperature differences according to the Newton law of cooling. At this time, the following equations (2-1), (2-2) are satisfied:

$$Sg\cdot\rho g\cdot Cg\cdot\left(\frac{\partial Tg}{\partial t}+V\cdot\frac{\partial Tg}{\partial z}\right)=\alpha_1\cdot U\cdot(Tw-Tg) \quad (2\text{-}1)$$

$$Sw\cdot\rho w\cdot Cw\cdot\frac{\partial Tw}{\partial t}=\alpha_1\cdot U\cdot(Tg-Tw)+\alpha_2\cdot U\cdot(T_A-Tw) \quad (2\text{-}2)$$

where $S_g$, $\rho_g$, $C_g$ represent the density and specific heat of the fluid and the cross-sectional area of the fluid passage, respectively, $S_w$, $\rho_w$, $C_w$ the density, specific heat, and cross-sectional area of the tube wall of the circular tube 23, respectively, V the speed of the fluid flowing through the circular tube 23, $T_A$ the atmospheric temperature outside of the circular tube 23, U the inner circumferential length of the circular tube 23, $\alpha_1$ the heat transfer coefficient between the fluid and the tube wall of the circular tube 23, and $\alpha_2$ the heat transfer coefficient between the tube wall of the circular tube 23 and the atmosphere. It is assumed that the atmospheric temperature $T_A$ is kept constant around the circular tube 23.

The above equations (2-1), (2-2) are modified into the following equations (3-1), (3-2):

$$\frac{\partial Tg}{\partial t} = -V \cdot \frac{\partial Tg}{\partial z} + a \cdot (Tw - Tg) \tag{3-1}$$

$$\frac{\partial Tw}{\partial t} = b \cdot (Tg - Tw) + c \cdot (T_A - Tw) \tag{3-2}$$

where a, b, c represent constants, $a=\alpha_1 \cdot U/(S_g \cdot \rho_g \cdot C_g)$, $b=\alpha_1 \cdot U/(S_w \cdot \rho_w \cdot C_w)$, $C=\alpha_2 \cdot U/(S_w \cdot \rho_w \cdot C_w)$.

The first term on the right side of the equation (3-1) is a shifting flow term representing a time-dependent rate of change of the fluid temperature Tg (a change in the temperature per unit time) depending on the temperature gradient in the flowing direction of the fluid and the speed of the fluid in a position z. The second term on the right side of the equation (3-1) is a heat transfer term representing a time-dependent rate of change of the fluid temperature Tg (a change in the temperature per unit time) depending on the difference between the fluid temperature Tg and the circular tube temperature Tw in the position z, i.e., a time-dependent rate of change of the fluid temperature Tg which is caused by the heat transfer between the fluid and the tube wall of the circular tube 23. Therefore, the equation (3-1) indicates that the time-dependent rate $\partial Tg/\partial t$ of change of the fluid temperature Tg in the position z depends on the temperature change component of the shifting flow term and the temperature change component of the heat transfer term, i.e., the sum of those temperature change components.

The first term on the right side of the equation (3-2) is a heat transfer term representing a time-dependent rate of change of the circular tube temperature Tw (a change in the temperature per unit time) depending on the difference between the circular tube temperature Tw and the fluid temperature Tg in the position z, i.e., a time-dependent rate of change of the circular tube temperature Tw which is caused by the heat transfer between the fluid and the tube wall of the circular tube 23 in the position z. The second term on the right side of the equation (3-2) is a heat radiation term representing a time-dependent rate of change of the circular tube temperature Tw (a change in the temperature per unit time) depending on the difference between the circular tube temperature Tw and the atmospheric temperature $T_A$ outside of the circular tube 23 in the position z, i.e., a time-dependent rate of change of the circular tube temperature Tw depending on the heat radiation from the tube wall of the circular tube 23 into the atmosphere in the position z. The equation (3-2) indicates that the time-dependent rate $\partial Tw/\partial t$ of change of the circular tube temperature Tw in the position z depends on the temperature change component of the heat transfer term and the temperature change component of the heat radiation term, i.e., the sum of those temperature change components.

According to the calculus of finite differences, the equations (3-1), (3-2) can be rewritten into the following equations (4-1), (4-2):

$$Tg(t+\Delta t, z) = Tg(t, z) - \frac{V \cdot \Delta t}{\Delta z} \cdot (Tg(t, z) - Tg(t, z-\Delta z)) + a \cdot \Delta t \cdot (Tw(t, z) - Tg(t, z)) \tag{4-1}$$

$$Tw(t+\Delta t,z)=Tw(t,z)+b \cdot \Delta t \cdot (Tg(t,z)-Tw(t,z))+c \cdot \Delta t \cdot (T_A - Tw(t,z)) \tag{4-2}$$

The above equations (4-1), (4-2) indicate that if the fluid temperature Tg(t,z) and the circular tube temperature Tw(t,z) in the position z at the time t, and the fluid temperature Tg(t,z−Δz) in a position z−Δz which precedes the position z (upstream thereof) at the time t are known, then the fluid temperature Tg(t+Δt,z) and the circular tube temperature Tw(t+Δt,z) in the position z at a next time t+Δt can be determined, and that the fluid temperatures Tg and the circular tube temperatures Tw in successive positions z+Δz, z+2Δz, . . . can be determined by solving the equations (4-1), (4-2) simultaneously in sequence for those positions. Specifically, if initial values of the fluid temperature Tg and the circular tube temperature Tw (initial values at t=0) are given in the positions z, z+Δz, z+2Δz, . . . and the fluid temperature Tg(t,0) at an origin (e.g., the inlet of the circular tube 23) in the direction of the Z-axis of the circular tube 23 is given (it is assumed that z·Δz=0), then the fluid temperatures Tg and the circular tube temperatures Tw in successive positions z, z+Δz, z+2Δz, . . . at successive times t, t+Δt, t+2Δt, . . . can be calculated.

The fluid temperature Tg(t,z) in the position z can be calculated by cumulatively adding (integrating), to the initial value Tg(0,z), the temperature change component depending on the fluid speed V and the temperature gradient in the position z (the temperature change component represented by the second term of the equation (4-1)) and the temperature change component depending on the difference between the fluid temperature Tg and the circular tube temperature Tw in the position z (the temperature change component represented by the third term of the equation (4-1)), at each given time interval. The fluid temperatures in the other positions z+Δz, z+2Δz, . . . can similarly be calculated. The circular tube temperature Tw(t,z) in the position z can be calculated by cumulatively adding (integrating), to the initial value Tw(0,z), the temperature change component depending on the difference between the fluid temperature Tg and the circular tube temperature Tw in the position z (the temperature change component represented by the second term of the equation (4-2)) and the temperature change component depending on the difference between the circular tube temperature Tw and the atmospheric temperature $T_A$ in the position z (the temperature change component represented by the third term of the equation (4-2)), at each given time interval.

In the present embodiment, the exhaust temperature observer 19 uses the model equations (4-1), (4-2) as basic equations and determines the temperatures of the exhaust gas in the respective partial exhaust passageways 3*a*, 3*b*, 3*c*, 3*d* as follows:

Of the partial exhaust passageways 3*a*, 3*b*, 3*c*, 3*d*, each of the partial exhaust passageways 3*a*, 3*b* is defined by the exhaust pipe 6*a* as a passage-defining member. In order to estimate the temperatures of the exhaust gas in the partial exhaust passageways 3*a*, 3*b*, the temperature changes depending on the speed of the exhaust gas and the temperature gradient thereof (the temperature gradient in the direction in which the exhaust gas flows), the heat transfer between the exhaust gas and the exhaust pipe 6*a*, and the heat radiation from the exhaust pipe 6*a* into the atmosphere are taken into account in the same manner as described above with respect to the circular tube 23.

An estimated value of the exhaust gas temperature Tga in the partial exhaust passageway 3*a* and an estimated value of the temperature Twa (hereinafter referred to as "exhaust pipe temperature Twa") of the exhaust pipe 6*a* in the partial exhaust passageway 3*a* are determined by respective thermal model equations (5-1), (5-2), shown below, in each cycle time of the processing sequence of the exhaust temperature observer 19. An estimated value of the exhaust gas temperature Tgb in the partial exhaust passageway 3*b* and an estimated value of the exhaust pipe temperature Twb in the partial exhaust passageway 3*b* are determined by respective thermal model equations (6-1), (6-2), shown below, in each cycle time of the processing sequence of the exhaust temperature observer 19. More specifically, the exhaust gas temperature Tga and the exhaust pipe temperature Twa that are determined by the equations (5-1), (5-2) represent estimated values of the temperatures in the vicinity of the downstream end of the partial exhaust passageway 3*a*. Likewise, the exhaust gas temperature Tgb and the exhaust pipe temperature Twb that are determined by the equations (6-1), (6-2) represent estimated values of the temperatures in the vicinity of the downstream end of the partial exhaust passageway 3*b*.

$$Tga(k+1) = Tga(k) - Vg \cdot \frac{dt}{La} \cdot (Tga(k) - Texg(k)) + Aa \cdot dt \cdot (Twa(k) - Tga(k)) \tag{5-1}$$

$$Twa(k+1) = Twa(k) + Ba \cdot dt \cdot (Tga(k) - Twa(k)) + Ca \cdot dt \cdot (T_A(k) - Twa(k)) \tag{5-2}$$

$$Tgb(k+1) = Tgb(k) - Vg \cdot \frac{dt}{Lb} \cdot (Tgb(k) - Tga(k)) + Ab \cdot dt \cdot (Twb(k) - Tgb(k)) \tag{6-1}$$

$$Twb(k+1) = Twb(k) + Bb \cdot dt \cdot (Tgb(k) - Twb(k)) + Cb \cdot dt \cdot (T_A(k) - Twb(k)) \tag{6-2}$$

In the equations (5-1), (5-2), (6-1), (6-2), dt represents the period (cycle time) of the processing sequence of the exhaust temperature observer 19, and corresponds to Δt in the equations (4-1), (4-2). The value of dt is a predetermined value. In the equations (5-1), (6-1), La, Lb represent the respective lengths (fixed values) of the partial exhaust passageways 3*a*, 3*b*, and correspond to Δz in the equation (4-1). Aa, Ba, Ca in the equations (5-1), (5-2) and Ab, Bb, Cb in the equations (6-1), (6-2) represent model coefficients corresponding respectively to a, b, c in the equations (4-1), (4-2), and the values of those model coefficients are set (identified) in advance by way of experimentation or simulation. In the equations (5-1), (6-1), Vg represents a parameter (to be determined as described later on) indicative of the speed of the exhaust gas, and corresponds to V in the equation (4-1).

The exhaust gas temperature Texg(k) (the exhaust gas temperature at the exhaust port 2) which is required to calculate a new estimated value Tga(k+1) of the exhaust gas temperature Tga according to the equation (5-1) is basically of the latest value determined according to the equation (1). Similarly, the exhaust gas temperature Tga(k) (the exhaust gas temperature in the partial exhaust passageway 3*a*) which is required to calculate a new estimated value Tgb(k+1) of the exhaust gas temperature Tgb according to the equation (6-1) is basically of the latest value determined according to the equation (5-1). The atmospheric temperature $T_A(k)$ which is required in the calculation of the equations (5-2), (6-2) is of the latest value of the atmospheric temperature $T_A$ detected by the non-illustrated atmospheric temperature sensor (in the present embodiment, a sensor on the engine 1 is substituted for this atmospheric temperature sensor), not shown. In the present embodiment, the gas speed parameter Vg which is required in the calculation of the equations (5-1), (6-1) is of a value which is calculated from latest detected values of the rotational speed NE and the intake pressure PB according to the following equation (7):

$$Vg = \frac{NE}{NEBASE} \cdot \frac{PB}{PBBASE} \tag{7}$$

where NEBASE, PBBASE represent a predetermined rotational speed and a predetermined intake pressure, respectively, which are set to, for example, the maximum rotational speed of the engine 1 and 760 mmHg (≈101 kPa), respectively. The gas speed parameter Vg calculated according to the equation (7) is proportional to the speed of the exhaust gas, with $Vg \leqq 1$.

In the present embodiment, initial values Tga(0), Twa(0), Tgb(0), Twb(0) of the estimated values of the exhaust gas temperature Tga, the exhaust pipe temperature Twa, the exhaust gas temperature Tgb, and the exhaust pipe temperature Twb are set to the atmospheric temperature $T_A$ which is detected by the non-illustrated atmospheric temperature sensor when the engine 1 has started to operate (upon an engine startup) or the engine temperature TW (the temperature of the coolant of the engine 1) detected by the non-illustrated engine temperature sensor.

The partial exhaust passageway 3*c* is defined by the catalyst 7, as a passage-defining member, in the catalytic converter 4. The catalyst 7 generates heat by itself due to its own exhaust gas purifying action (specifically, an oxidizing/reducing action), and the amount of heat (the amount of heat per unit time) generated by the catalyst 7 is substantially in proportion to the speed of the exhaust gas. This is because as the speed of the exhaust gas is higher, the exhaust gas components reacting with the catalyst 7 per unit time increase.

According to the present embodiment, for estimating the exhaust gas temperature in the partial exhaust passageway 3*c* with high accuracy, the generation of heat by the catalyst 7 in the catalytic converter 4 as well as the temperature change depending on the speed and temperature gradient of the exhaust gas, the heat transfer between the exhaust gas and the catalyst 7, and the heat radiation from the catalyst 7 into the atmosphere are taken into account.

An estimated value of the exhaust gas temperature Tgc in the partial exhaust passageway 3*c* and an estimated value of the temperature Twc (hereinafter referred to as "catalyst temperature Twc") of the catalyst 7 which defines the partial exhaust passageway 3*c* are determined by respective thermal model equations (8-1), (8-2), shown below, in each cycle time of the processing sequence of the exhaust temperature observer 19. More specifically, the exhaust gas temperature Tgc and the catalyst temperature Twc that are determined by the equations (8-1), (8-2) represent estimated values of the temperatures in the vicinity of the downstream end of the partial exhaust passageway 3*c*, i.e., in the vicinity of the outlet of the catalytic converter 4.

$$Tgc(k+1) = Tgc(k) - Vg \cdot \frac{dt}{Lc} \cdot (Tgc(k) - Tgb(k)) + Ac \cdot dt \cdot (Twc(k) - Tgc(k)) \quad (8\text{-}1)$$

$$Twc(k+1) = Twc(k) + Bc \cdot dt \cdot (Tgc(k) - Twc(k)) + Cc \cdot dt \cdot (T_A(k) - Twc(k)) + Dc \cdot dt \cdot Vg \quad (8\text{-}2)$$

In the equation (8-1), Lc represents the length (fixed value) of the partial exhaust passageway 3*c*, and corresponds to Δz in the equation (4-1). Ac, Bc, Cc in the equations (8-1), (8-2) represent model coefficients corresponding respectively to a, b, c in the equations (4-1), (4-2), and the values of those model coefficients are set (identified) in advance by way of experimentation or simulation. The fourth term on the right side of the equation (8-2) represents a temperature change component of the catalyst 7 in the catalytic converter 4 due to the heating of the catalyst 7 by itself, i.e., the temperature change per period of the processing sequence of the exhaust temperature observer 19, and is proportional to the gas speed parameter Vg. As with Ac through Cc, Dc in the fourth term represents a model coefficient that is set (identified) in advance by way of experimentation or simulation. Therefore, the equation (8-2) corresponds to the combination of the right side of the equation (4-2) with a temperature change component due to the heating of a passage-defining member (the catalyst 7).

dt, Vg in the equations (8-1), (8-2) have the same meanings and values as those in the equations (5-1) through (6-2). The value of $T_A$ used in the calculation of the equation (8-2) is identical to those used in the equation (5-2), (6-2). In the present embodiment, the initial values Tgc(0), Twc(0) of the initial values of the exhaust gas temperature Tgc and the catalyst temperature Twc are equal to the detected value of the atmospheric temperature $T_A$ at the time the engine 1 has started to operate, or the detected value of the engine temperature TW, as with the equations (5-1) through (6-2).

The partial exhaust passageway 3*d* is defined by the exhaust pipe 6*b* as a passage-defining member that is similar to the exhaust pipe 6*a* which defines the partial exhaust passageways 3*a*, 3*b*. The exhaust gas temperature Tgd in the partial exhaust passageway 3*d* and the exhaust pipe temperature Twd of the exhaust pipe 6*b*, or more specifically the temperature at the downstream end of the partial exhaust passageway 3*d*, are determined respectively by the following equations (9-1), (9-2) which are similar to the equations (5-1) through (6-2):

$$Tgd(k+1) = Tgd(k) - Vg \cdot \frac{dt}{Ld} \cdot (Tgd(k) - Tgc(k)) + Ad \cdot dt \cdot (Twd(k) - Tgd(k)) \quad (9\text{-}1)$$

$$Twd(k+1) = Twd(k) + Bd \cdot dt \cdot (Tgd(k) - Twd(k)) + Cd \cdot dt \cdot (T_A(k) - Twd(k)) \quad (9\text{-}2)$$

In the equation (9-1), Ld represents the length (fixed value) of the partial exhaust passageway 3*d*, and corresponds to Δz in the equation (4-1). Ad, Bd, Cd in the equations (9-1), (9-2) represent model coefficients corresponding respectively to a, b, c in the equations (4-1), (4-2), and the values of those model coefficients are set (identified) in advance by way of experimentation or simulation.

dt, Vg in the equations (9-1), (9-2) have the same meanings and values as those in the equations (5-1) through (6-2). The value of $T_A$ used in the calculation of the equation (9-2) is identical to those used in the equation (5-2), (6-2), (8-2). The initial values Tgd(0), Twd(0) of the estimated values of the exhaust gas temperature Tgd and the catalyst temperature Twd are equal to the detected value of the atmospheric temperature $T_A$ at the time the engine 1 has started to operate, or the detected value of the engine temperature TW, as with the equations (5-1) through (6-2).

The processing sequence of the exhaust temperature observer 19, as described above, determines estimated values of the exhaust gas temperatures Texg, Tga, Tgb, Tgc, Tgd in the exhaust port 2 of the engine 1 and the partial exhaust passageways 3*a*, 3*b*, 3*c*, 3*d* successively downstream in each cycle time. Stated otherwise, the exhaust temperature observer 19 determines an estimated value of the exhaust gas temperature Texg in the exhaust port 2 using parameters (NE and PB in the present embodiment) representative of the operating state of the engine 1, and determines an estimated value of the exhaust gas temperature Tgd in the partial exhaust passageway 3*d* which is located most downstream using the thermal model equations (5-1), (5-2) through (9-1), (9-2) which represent a change in the temperature of the exhaust gas as it flows from the exhaust port 2 to a position in the vicinity of the location of the $O_2$ sensor 8, and the estimated value of the exhaust gas temperature Texg in the exhaust port 2. The estimated value of the exhaust gas temperature Tgd in the most downstream partial exhaust passageway 3*d* corresponds to the temperature of the exhaust gas in the vicinity of the location of the $O_2$ sensor 8. The estimated value of the exhaust gas temperature Tgd is obtained as the estimated value of the exhaust gas temperature in the vicinity of the location of the $O_2$ sensor 8.

Figure 6:
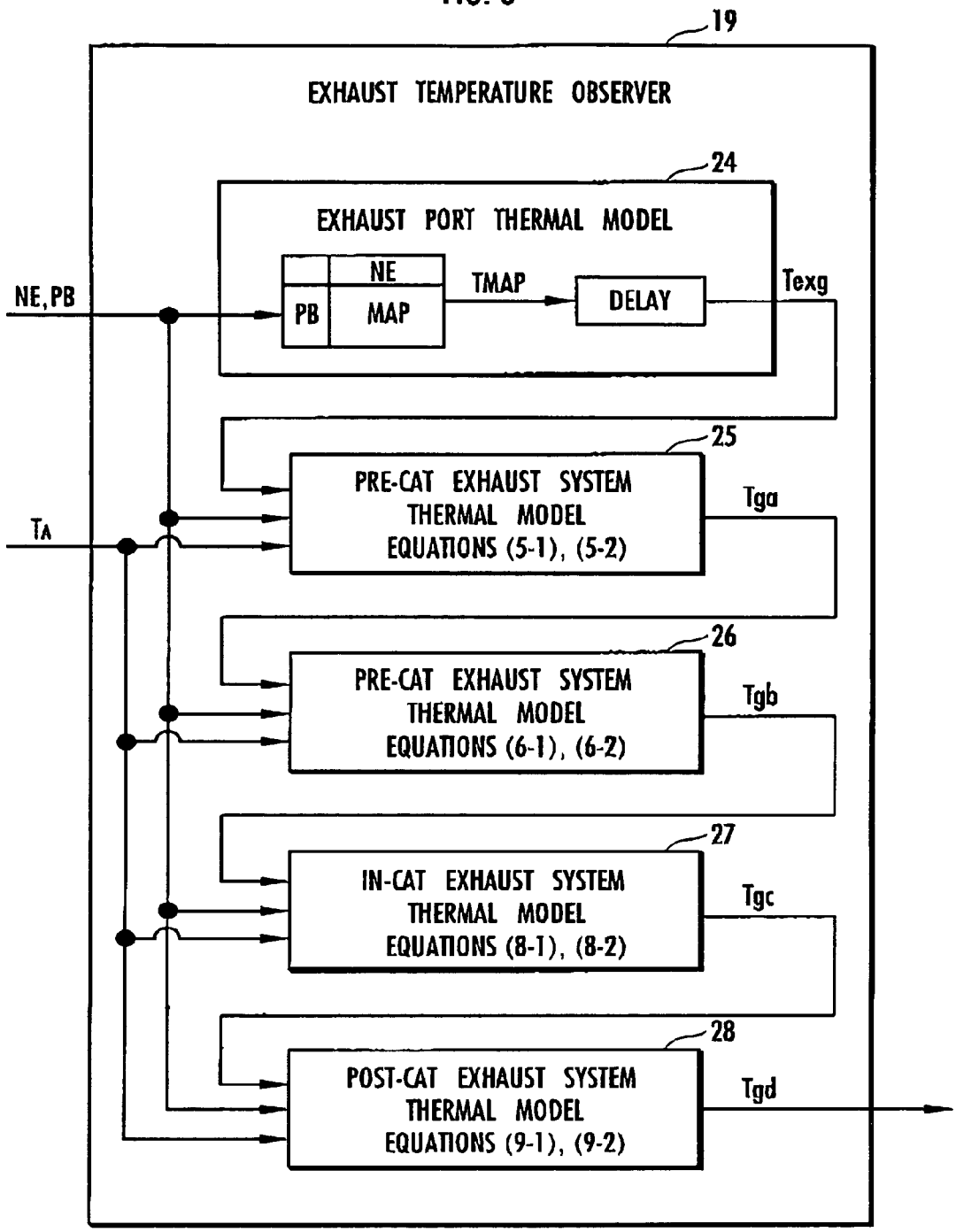
FIG. 6 is a block diagram showing a functional arrangement of the exhaust temperature observer in the apparatus shown in FIG. 1.

The algorithm of the estimating process of the exhaust temperature observer 19 is shown in block form in FIG. 6. In FIG. 6, the model equation (1) is referred to as an exhaust port thermal model 24, the model equations (5-1), (5-2) and the model equations (6-1), (6-2) as pre-CAT exhaust system thermal models 25, 26, respectively, the model equations (8-1), (8-2) as an in-CAT exhaust system thermal model 27, and the model equations (9-1), (9-2) as a post-CAT exhaust system thermal model 28. As shown in FIG. 6, each of the thermal models 24 through 28 is supplied with the detected values of the rotational speed NE and the intake pressure PB of the engine 1. The detected values of the rotational speed NE and the intake pressure PB which are supplied to the exhaust port thermal model 24 are used to determine the basic exhaust gas temperature TMAP, and the detected values of the rotational speed NE and the intake pressure PB which are supplied to the exhaust system thermal models 25 through 28 are used to determine the value of the gas speed parameter Vg.

Each of the exhaust system thermal models 25 through 28 is also supplied with the detected value of the atmospheric temperature $T_A$. The pre-CAT exhaust system thermal model 25, the pre-CAT exhaust system thermal model 26, the in-CAT exhaust system thermal model 27, and the post-CAT exhaust system thermal model 28 are supplied with the estimated values of the exhaust gas temperatures Texg, Tga, Tgb, Tgc, respectively, which are outputted from the higher-level thermal models 24, 25, 26, 27. The post-CAT exhaust system thermal model 28 eventually produces the estimated value of the exhaust gas temperature Tgd in the vicinity of the location of the $O_2$ sensor 8, i.e., exhaust gas temperature data representative of the temperature of the exhaust gas.

In the present embodiment, the estimated value of the exhaust gas temperature Tgd is determined as described above. However, the estimated value of the exhaust gas temperature Tgd may be determined otherwise. For example, if the exhaust gas temperature Texg in the exhaust port 2 and the exhaust gas temperature in the vicinity of the location of the $O_2$ sensor 8 are substantially equal to each other due to the layout or the structure of the exhaust system of the engine 1, then the estimated value of the exhaust gas temperature Texg may be used as the exhaust gas temperature in the vicinity of the location of the $O_2$ sensor 8. At any rate, since the exhaust gas temperature is closely related to the operating state of the engine 1, it is preferable to use at least parameters representing the operating state of the engine 1 for accurately estimating the exhaust gas temperature. It is more preferable to use parameters representing the conditions of the rotational speed and the amount of intake air of the engine 1. In the present embodiment, the detected value produced by the atmospheric temperature sensor on the engine 1 is used to estimate the temperatures of the passage-defining members (the exhaust pipe 6*a*, the catalyst 7 in the catalytic converter 4, and the exhaust pipe 6*b*) which define the partial exhaust passageways 3*a*, 3*b*, 3*c*, 3*d*. However, the detected value produced by an atmospheric sensor which is disposed outside of the exhaust passage 3 may be used to estimate the temperatures of those passage-defining members.

The element temperature observer 20 will be described below. In the present embodiment, the element temperature observer 20 estimates the element temperature $T_{O2}$ sequentially in given cycle times (processing periods) in view of the thermal transfer (heat exchange relationship) between the active element 10 of the $O_2$ sensor 8 and the exhaust gas held in contact therewith, the heat radiation (heat exchange relationship) from the active element 10 into the air in the active element 10, and the thermal transfer (heat exchange relationship) between the active element 10 and the heater 13 which heats the active element 10. The element temperature observer 20 also estimates the temperature Tht (hereinafter referred to as "heater temperature Tht") of the heater 13 in order to estimate the element temperature $T_{O2}$. In estimating the heater temperature Tht, the element temperature observer 20 takes into account the heat transfer (heat exchange relationship) between the heater 13 and the active element 10, the heat radiation from the active heater 13 into the air in the active element 10, and also the heating of the heater 13 based on the electric energy supplied to the heater 13 (the heating electric energy supplied to the heater 13). The element temperature observer 20 has an estimating algorithm for estimating the temperature $T_{O2}$ and the temperature Tht, which is constructed as follows:

The element temperature observer 20 determines an estimated value of the temperature $T_{O2}$ of the $O_2$ sensor 8 and an estimated value of the temperature Tht of the heater 13 sequentially in given cycle times (processing periods) respectively according to the following thermal model equations (10-1), (10-2):

$$T_{o2}(k+1) = T_{o2}(k) + Ax \cdot dt \cdot (Tgd(k) - T_{o2}(k)) + Bx \cdot dt \cdot (Tht(k) - T_{o2}(k)) - Ex \cdot dt \cdot (T_{o2}(k) - T'_A(k)) \quad (10\text{-}1)$$

-continued $$Tht(k+1) = Tht(k) - Cx \cdot dt \cdot (Tht(k) - T_{o2}(k)) - Fx \cdot dt \cdot (Tht(k) - T'_A(k)) + Dx \cdot dt \cdot DUT(k) \cdot \frac{VB(k)^2}{NVB^2} \quad (10\text{-}2)$$

The equation (10-1) represents an element temperature model, and the equation (10-2) represents a heater temperature model.

In the equations (10-1), (10-2), k represents the ordinal number of a processing period of the element temperature observer 20 (which is the same as the processing period of the exhaust temperature observer 19), and $T_A'$ represents the temperature of the air in the active element 10. The equation (10-1) indicates that the temperature change of the active element 10 in each cycle time of the element temperature observer 20 depends on a temperature change component (the second term on the right side of the equation (10-1)) depending on the difference between the exhaust gas temperature Tgd estimated by the exhaust temperature observer 19 as described above (the exhaust gas temperature in the vicinity of the location of the $O_2$ sensor 8) and the element temperature $T_{O2}$, i.e., a temperature change component which is caused by the heat transfer between the active element 10 and the exhaust gas held in contact therewith (which temperature change component represents the heat exchange relationship between the active element 10 and the exhaust gas), a temperature change component (the third term on the right side of the equation (10-1)) depending on the difference between the element temperature $T_{O2}$ and the heater temperature Tht, i.e., a temperature change component which is caused by the heat transfer between the active element 10 and the heater 13 (which temperature change component represents the heat exchange relationship between the active element 10 and the heater 13), and a temperature change component (the fourth term on the right side of the equation (10-1)) depending on the difference between the element temperature $T_{O2}$ and the temperature $T_A'$ of the air in the active element 10, i.e., a temperature change component which is caused by the heat radiation from the active element 10 to the air in the active element 10 (which temperature change component represents the heat exchange relationship between the active element 10 and the air therein), i.e., the sum of those temperature change components.

The equation (10-2) indicates that the temperature change of the heater 13 in each cycle time depends on a temperature change component (the second term on the right side of the equation (10-2)) depending on the difference between the element temperature $T_{O2}$ and the heater temperature Tht, i.e., a temperature change component which is caused by the heat transfer between the active element 10 and the heater 13 (which temperature change component represents the heat exchange relationship between the active element 10 and the heater 13), a temperature change component (the third term on the right hand of the equation (10-2)) depending on the difference between the heater temperature Tht and the temperature $T_A'$ of the air in the active element 10, i.e., a temperature change component which is caused by the heat radiation from the heater 13 to the air in the active element 10 (which temperature change component represents the heat exchange relationship between the heater 13 and the air in the active element 10), and a temperature change component (the fourth term on the right side of the equation (10-2)) depending on the product of the duty cycle DUT that is generated by the heat controller 22 as described later on (or more precisely, the duty cycle DUT that is actually used for the heater controller 22 to control energization of the heater 13) and the square $VB^2$ of the battery voltage VB, i.e., a temperature change component which is caused by the heating of the heater 13 based on the electric energy supplied thereto, i.e., the sum of those temperature change components. The duty cycle DUT in the equation (10-2) corresponds to heater energy supplied quantity data according to the present invention.

In the equations (10-1), (10-2), Ax, Bx, Cx, Dx, Ex, Fx represent model coefficients whose values are set (identified) in advance by way of experimentation or simulation, and dt represents a predetermined processing sequence period (cycle time) of the element temperature observer 20. In the equation (10-2), NVB represents a predetermined reference value (e.g., 14 V) for the battery voltage VB. The reference value NVB is basically a standard voltage (a voltage which may ordinarily be employed) for the battery voltage VB, and may be set to an arbitrary value.

The fourth term on the right side of the equation (10-2) will supplementarily be described below. If the duty cycle of a PWM control process for the heater 13 is constant and the resistance of the heater 13 as it is energized is constant, then the electric energy supplied to the heater 13 is proportional to the square of the voltage applied to the heater 3, and the voltage applied to the heater 3 is proportional to the battery voltage VB. The duty ratio DUT defines the time in which the heater 13 is energized per period of the pulsed voltage applied in the PWM control process. Therefore, the product of the duty cycle DUT and the square $VB^2$ of the battery voltage VB is proportional to the electric energy supplied to the heater 13. The battery voltage VB varies when an alternator for charging the battery is turned on and off. In the equation (10-2), the duty cycle DUT and the square $VB^2$ of the battery voltage VB are multiplied by each other in order to obtain a temperature change component which is caused by the heating of the heater 13 based on the electric energy supplied thereto.

The duty cycle DUT(k) which is required in the calculation of the equation (10-2) is of the latest value of the duty cycle DUT that is actually used for the heater controller 22 to control energization of the heater 13 according to the PWM control process. In the present embodiment, the latest value of the atmospheric temperature $T_A$ that is detected by the non-illustrated atmospheric temperature sensor is substituted for the temperature $T_A'$ (k) of the air in the active element 10 which is required in the calculation of the equations (10-1), (10-2). In the present embodiment, therefore, $T_A'(k)=T_A(k)$. In the present embodiment, the initial values $T_{O2}(0)$, Tht(0) of the element temperature $T_{O2}$ and the heater temperature Tht are equal to the detected value of the atmospheric temperature $T_A$ or the detected value of the engine temperature TW at the time the engine 1 has started to operate.

The element temperature observer 20 sequentially calculates the estimated values of the element temperature $T_{O2}$ and the heater temperature Tht according to the estimating algorithm described above. In the present embodiment, the thermal model equations (10-1), (10-2) include a component representing the heat exchange relationship between the active element 10 and the air therein and a component representing the heat exchange relationship between the heater 13 and the air in the active element 10, respectively (see the fourth term of the equation (10-1) and the third term of the equation (10-2)). However, these components may be omitted as their effect on the element temperature $T_{O2}$ and the heater temperature Tht is relatively small. In the present embodiment, since the $O_2$ sensor 8 has the heater 13, the equations (10-1), (10-2) are employed to determine an estimated value of the element temperature $T_{O2}$. If the $O_2$ sensor 8 has no heater, then an estimated value of the element temperature $T_{O2}$ may be sequentially determined according to an equation that is similar to the equation (10-1) except that the third term of the equation (10-1) is omitted, or an equation that is similar to the equation (10-1) except that the third and fourth terms of the equation (10-1) are omitted. If the third and fourth terms of the equation (10-1) are omitted, then a value which follows, with a time lag of first order, the exhaust gas temperature Tgd is determined as an estimated value of the element temperature $T_{O2}$. Of the thermal model equations (10-1), (10-2) for calculating estimated values of the element temperature $T_{O2}$ and the heater temperature Tht, the equation (10-1) includes a component (the second term of the equation (10-1)) representing the heat exchange relationship between the exhaust gas and the active element 10. However, such a component may be dispensed with in a situation wherein the exhaust gas temperature Tgd is substantially constant, such as when the engine 1 is in a steady operating state where NE and PB are substantially constant.

The $O_2$ output target value setting means 18 serves to set a target value Vtgt for the output Vout of the $O_2$ sensor 8, which is suitable for achieving a good exhaust gas purifying capability (purification rate) for CO (carbon monoxide), HC (hydrocarbons), and NOx (nitrogen oxides) which are major exhaust gas components to be purified by the catalytic converter 4. The relationship between the output characteristics of the $O_2$ sensor 8 and the element temperature $T_{O2}$ and the relationship between the output Vout of the $O_2$ sensor 8 and the purification rates of the catalytic converter 4 for CO, HC, NOx will be described below with reference to FIGS. 3 and 4.

As shown in FIG. 3, the output characteristics of the $O_2$ sensor 8 change depending on the element temperature $T_{O2}$. In FIG. 3, the solid-line curve "a", a broken-line curve "b", a dot-and-dash-line curve "c", and a two-dot-and-dash-line curve "d" represent the output characteristics of the $O_2$ sensor 8 when the element temperature $T_{O2}$ is 800° C., 750° C., 700° C., and 600° C., respectively. As can be seen from FIG. 3, if the element temperature $T_{O2}$ changes in a temperature range lower than 750° C., then the gradient (sensitivity) of a change in the output Vout of the $O_2$ sensor 8 in the vicinity of the stoichiometric air-fuel ratio (the high-sensitivity air-fuel ratio range Δ) and the level of the output Vout at air-fuel ratios richer than the high-sensitivity air-fuel ratio range Δ tend to change. If the element temperature $T_{O2}$ is 750° C. or higher, then a change in the output characteristics of the $O_2$ sensor 8 with respect to a change in the element temperature $T_{O2}$ is so small that the output characteristics of the $O_2$ sensor 8 are substantially constant.

Figure 4:
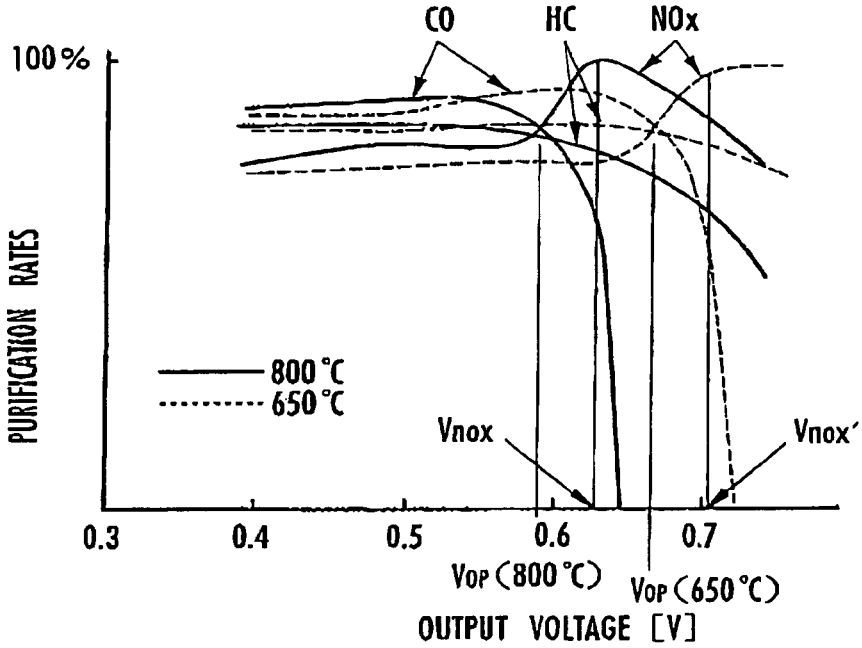
FIG. 4 is a graph illustrative of the relationship between the output of the $O_2$ sensor shown in FIG. 2 and the purification rate of an exhaust gas.
Figure 5:
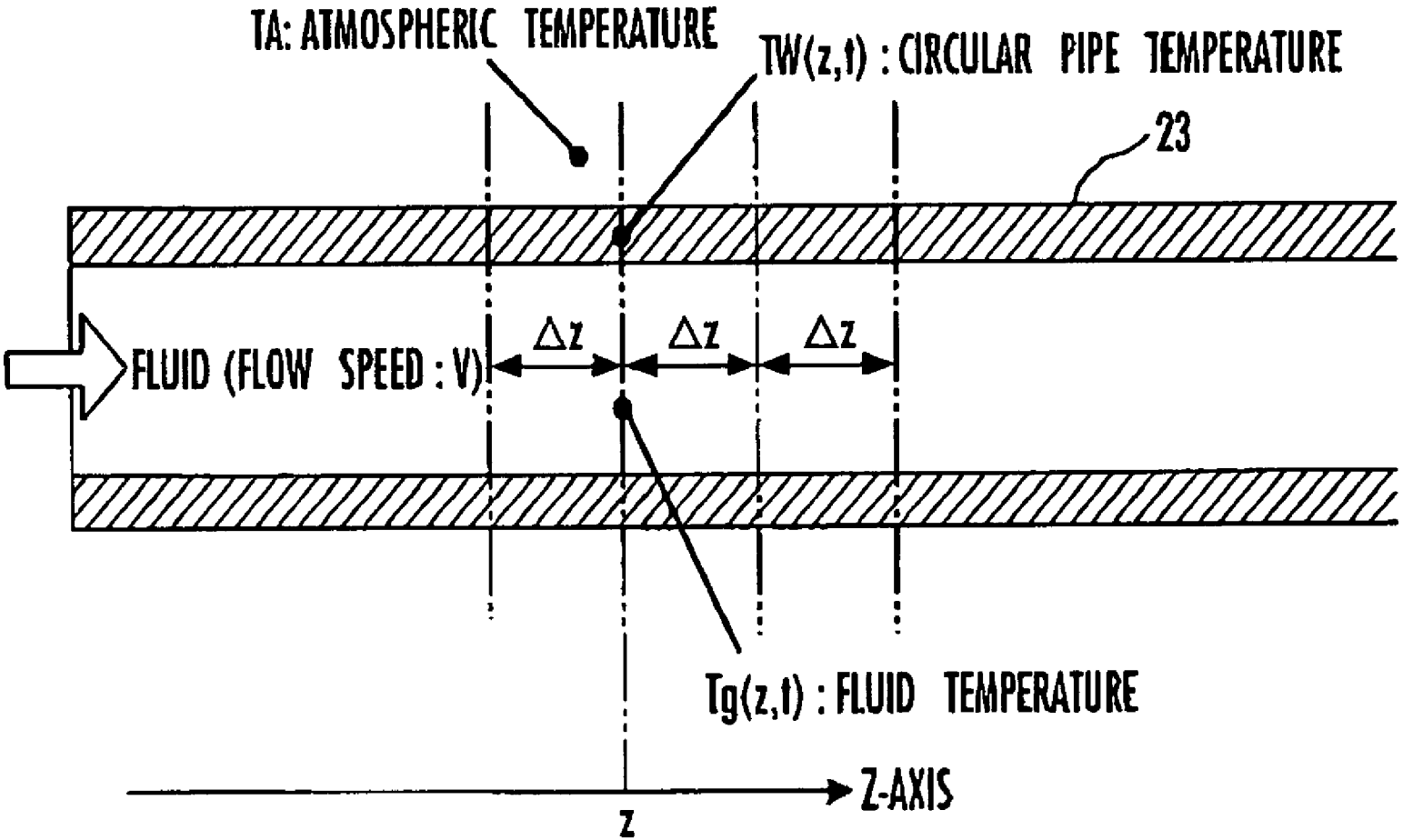
FIG. 5 is a cross-sectional view showing how an exhaust temperature observer in a control unit of the apparatus shown in FIG. 1 operates.

As shown in FIG. 4, if the element temperature $T_{O2}$ of the $O_2$ sensor 8 is constant, then the purification rates of the catalytic converter 4 for CO, HC, NOx contained in the exhaust gas is correlated to the output Vout of the $O_2$ sensor 8 as indicated by a group of solid-line curves or a group of broken-line curves in FIG. 4. The group of solid-line curves in FIG. 4 are plotted when the element temperature $T_{O2}$ of the $O_2$ sensor 8 is 800° C., for example, and the group of broken-line curves in FIG. 4 are plotted when the element temperature $T_{O2}$ of the $O_2$ sensor 8 is 650° C., for example. As can be seen from these solid-line curves or broken-line curves, the output Vout of the $O_2$ sensor 8 (which represents the air-fuel ratio state of the exhaust gas) for maximizing the purification rates for CO, HC, NOx slightly differ from exhaust gas component to exhaust gas component, but sufficiently good purification rates can be achieved for all CO, HC, NOx in the air-fuel ratio state of the exhaust gas wherein output Vout of the $O_2$ sensor 8 is of a certain appropriate output value Vop (voltage value).

However, the output value Vop of the $O_2$ sensor 8 (hereinafter occasionally referred to as "purification optimum output Vop") for achieving sufficiently good purification rates for all exhaust gas components to be purified differs depending on the element temperature $T_{O2}$. This is because the output characteristics of the $O_2$ sensor 8 vary depending on the element temperature $T_{O2}$, as described above. For example, when the element temperature $T_{O2}$ is 650° C., the purification optimum output Vop (650° C.) of the $O_2$ sensor is about 0.67 [V], and when the element temperature $T_{O2}$ is 800° C., the purification optimum output Vop (800° C.) of the $O_2$ sensor is about 0.59 [V]. At the element temperature $T_{O2}$ of 750° C. or higher, the output characteristics of the $O_2$ sensor 8 are substantially constant, as described above, and hence the purification optimum output Vop is also substantially constant (≈Vop (800° C.)). The purification optimum output Vop at the element temperature $T_{O2}$ lower than 750° C. basically tends to become larger as the element temperature $T_{O2}$ is lower.

Figure 11:
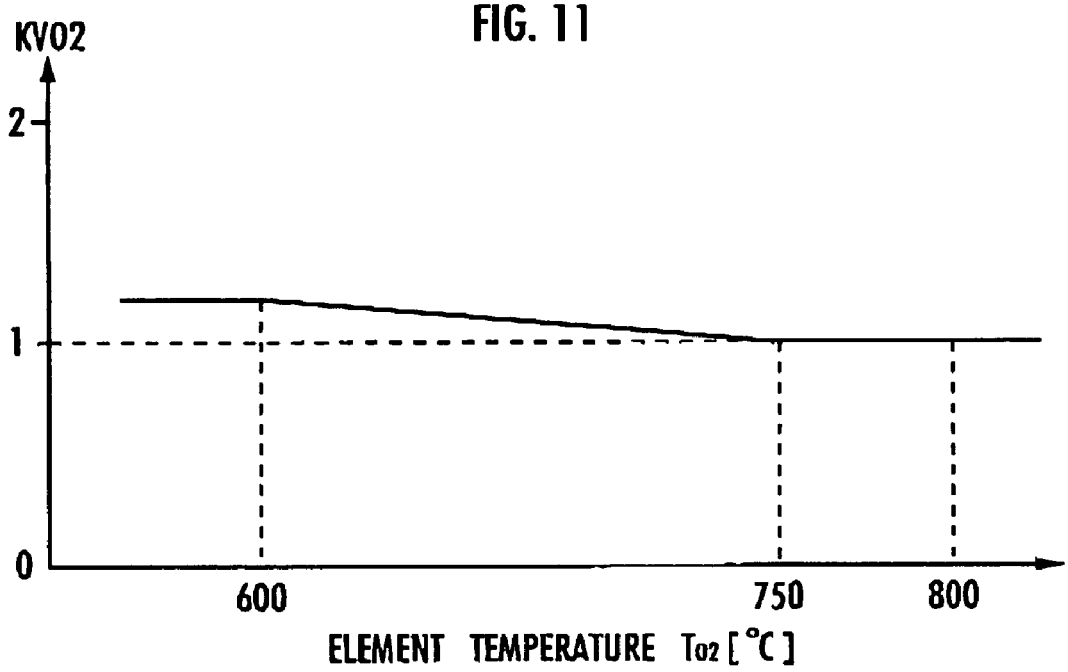
FIG. 11 is a graph showing a data table used in the process shown in FIG. 10.

In view of the foregoing tendency, the $O_2$ output target value setting means 18 determines an purification optimum output Vop depending on the estimated value (the element temperature data according to the present embodiment) of the element temperature $T_{O2}$ of the $O_2$ sensor 8 which has been determined by the element temperature observer 20 as described above, and basically sets the determined purification optimum output Vop as a target value Vtgt for the output Vout of the $O_2$ sensor 8. According to the present embodiment, specifically, the purification optimum output Vop is determined by multiplying, by a corrective coefficient KVO2, a purification optimum output Vop (hereinafter referred to as "reference purification optimum output NVop") that is produced by the $O_2$ sensor 8 when the element temperature $T_{O2}$ thereof is a predetermined temperature (e.g., 800° C.). The corrective coefficient KVO2 is set based on a predetermined data table as shown in FIG. 11, for example, depending on the element temperature $T_{O2}$ (estimated value). When the element temperature $T_{O2}$ is 750° C. or higher, since the output characteristics of the $O_2$ sensor 8 are substantially constant as described above, the corrective coefficient KVO2 is KVO2=1 in a temperature range of $T_{O2} \geqq 750°$ C. in the data table shown in FIG. 11. In the temperature range of $T_{O2} \geqq 750°$ C., however, the purification optimum output Vop may not be strictly constant due to slight changes of the output characteristics of the $O_2$ sensor 8 depending on the element temperature $T_{O2}$. Therefore, the value of the corrective coefficient KVO2 may be slightly varied depending on the element temperature $T_{O2}$ in the temperature range of 750° C. or higher. The data table shown in FIG. 1 is established such that in a temperature range of $T_{O2}<750°$ C., the value of the corrective coefficient KVO2 is greater than "1" as the element temperature $T_{O2}$ is lowered. In the present embodiment, the corrective coefficient KVO2 reaches its upper limit value when $T_{O2}=600°$ C., and is maintained at the upper limit value in a temperature range of $T_{O2} \leqq 600°$ C.

The reference purification optimum output NVop is multiplied by the corrective coefficient KVO2 to determine purification optimum outputs Vop for achieving sufficiently good purification rates for all CO, HC, NOx at respective element temperatures $T_{O2}$. The $O_2$ output target value setting means 18 basical ly sets a purification optimum output Vop thus determined as a target value Vtgt for the output Vout of the $O_2$ sensor 8.

According to the present embodiment, in a certain operating state of the engine 1 or a vehicle on which the engine 1 is mounted, the target value Vtgt for the output Vout of the $O_2$ sensor 8 is set to an output value for making the purification rate for NOx higher than the purification optimum output Vop. Details of such a process will be described later on.

The air-fuel ratio control means 17 controls the air-fuel ratio of the exhaust gas supplied from the engine 1 to the catalytic converter 4 in order to converge (settle) the actual output Vout of the $O_2$ sensor 8 to the target value Vtgt that is set by the $O_2$ output target value setting means 18. Such an air-fuel ratio control process carried by the air-fuel ratio control means 17 may be of a conventional nature, and will not be described in detail below. The air-fuel ratio control process carried by the air-fuel ratio control means 17 is carried out as described in paragraphs [0071]–[0362] in the specification of Japanese laid-open patent publication No. 11-324767 or U.S. Pat. No. 6,188,953, for example. A summary of the air-fuel ratio control process will be described below. An exhaust system (denoted by the reference character E) including the catalytic converter 4 and ranging from the wide-range air-fuel ratio sensor 9 to the $O_2$ sensor 8 is regarded as a controlled object having an input quantity represented by the output KACT of the wide-range air-fuel ratio sensor 9 and an output quantity represented by the $O_2$ sensor 8. A target air-fuel ratio (a target value for the air-fuel ratio of the exhaust gas that is detected by the wide-range air-fuel ratio sensor 9) as a target input for the exhaust system E that is required to converge the output Vout of the $O_2$ sensor 8, which is the output of the exhaust system E, to the target value Vtgt is sequentially determined according to an adaptive sliding mode control process that is a type of feedback control process. Then, a fuel command for adjusting the amount of fuel supplied to the engine 1 (and hence the air-fuel ratio of an air-fuel mixture to be combusted by the engine 1) is generated according to an adaptive control process or a PID control process in order to converge the air-fuel ratio of the exhaust gas that is detected by the wide-range air-fuel ratio sensor 9 to the target air-fuel ratio, and the amount of fuel supplied to the engine 1 is adjusted depending on the generated fuel command.

In calculating the target air-fuel ratio, in order to compensate for a dead time that is present between the output KACT of the wide-range air-fuel ratio sensor 9 (the input of the exhaust system E) and the output Vout of the $O_2$ sensor 8 (the output of the exhaust system E), and also a dead time that is present between the target air-fuel ratio and the air-fuel ratio of the exhaust gas that is detected by the wide-range air-fuel ratio sensor 9, an estimated value of the output Vout of the $O_2$ sensor 8 after a total dead time that is the sum of the above dead times is sequentially determined. The target air-fuel ratio is then calculated according to the adaptive sliding mode control process in order to converge the determined estimated value to the target value Vtgt (and, as a result, to converge the output Vout of the $O_2$ sensor 8 to the target value Vtgt). In order to compensate for dynamic characteristic changes of the exhaust system E, parameters of a model of the exhaust system E that are employed in the adaptive sliding mode control process and also the process for calculating an estimated value of the output Vout of the $O_2$ sensor 8 after the total dead time are sequentially determined using the output KACT of the wide-range air-fuel ratio sensor 9 and the output Vout of the $O_2$ sensor 8.

According to the process disclosed in Japanese laid-open patent publication No. 11-324767 or U.S. Pat. No. 6,188,953, the target value for the output of the $O_2$ sensor disposed downstream of the catalytic converter is a predetermined constant value. According to the present embodiment, however, the target value Vtgt that is sequentially set by the $O_2$ output target value setting means 18 may be used as the target value for the output of the $O_2$ sensor. Furthermore, the air-fuel ratio control process carried by the air-fuel ratio control means 17 is not limited to the process disclosed in Japanese laid-open patent publication No. 11-324767 or U.S. Pat. No. 6,188,953, but may be another process insofar as it can control the output of the $O_2$ sensor 8 well at the target value Vtgt. However, for accurately controlling the output of the $O_2$ sensor 8 at the target value Vtgt, it is preferable to control the air-fuel ratio according to a response-specified control process. Such a response-specified control process should preferably employ the algorithm of a sliding mode control process as disclosed in Japanese laid-open patent publication No. 11-324767 or U.S. Pat. No. 6,188,953, for example (more preferably, an adaptive sliding mode control process including an adaptive algorithm added for eliminating the effect of a disturbance and a modeling error of the controlled object).

By setting the target value Vtgt for the output Vout of the $O_2$ sensor 8 variably depending on the element temperature $T_{O2}$ as described above, it is basically possible to achieve a good exhaust gas purifying capability of the catalytic converter 4 irrespective of the element temperature $T_{O2}$. However, since the process for converting the output Vout of the $O_2$ sensor 8 to the target value Vtgt requires the air-fuel ratio to be controlled delicately, if the output characteristics of the $O_2$ sensor 8 vary frequently due to changes in the element temperature $T_{O2}$, then the ability of the air-fuel ratio control means 17 to control the air-fuel ratio, i.e., the stability and quick response of the control process carried out by the air-fuel ratio control means 17, is likely to be impaired. According to the present embodiment, therefore, the element temperature target value setting means 21 basically sets a target value R for the element temperature $T_{O2}$ to a predetermined constant value. The target value R is a temperature equal to or higher than 750° C., e.g., 800° C. (for reasons to be described later on).

However, with the target value R for the element temperature $T_{O2}$ being set to a high temperature such as 800° C. from the startup of the engine 1, if moisture is attached to the active element 10 of the $O_2$ sensor 8 at the time the engine 1 starts operating, then the active element 10 may possibly be damaged by stresses developed as the active element 10 is abruptly heated. Therefore, the element temperature target value setting means 21 sets the target value R for the element temperature $T_{O2}$ to a temperature lower than 750° C., e.g., 600° C., until a certain period of time (e.g., 15 seconds) elapses after the engine 1 has started operating. As described in detail later on, however, if the atmospheric temperature $T_A$ is low (e.g., $T_A$<0° C.) even upon elapse of the certain period of time after the engine 1 has started operating, then the element temperature target value setting means 21 sets the target value R for the element temperature $T_{O2}$ to a temperature slightly lower than the ordinary target value (800° C.) (750° C.≦R<800° C.).

The reasons for setting the basic target value R for the element temperature $T_{O2}$ to a temperature equal to or higher than 750° C. (800° C. in the present embodiment) will supplementarily be described below. As described above, the output characteristics of the $O_2$ sensor 8 are substantially constant and stable at the element temperature $T_{O2}$ of 750° C. or higher. The findings of the inventors of the present invention reveal that if the element temperature $T_{O2}$ is kept at 750° C. or higher, e.g., 800° C., then the output of the $O_2$ sensor 8 for achieving a good purification rate of the catalytic converter 4 for all CO, HC, NOx, i.e., the purification optimum output Vop (the basic target value for the output of the $O_2$ sensor 8 in the air-fuel ratio control process) is present in an area denoted by e4 on the curve "a" in FIG. 3, i.e., an inflection point e4 where the gradient of the curve "a" representing the output characteristics of the $O_2$ sensor 8 switches from a larger value to a smaller value as the air-fuel ratio becomes richer. At this time, the air-fuel ratio can well be controlled to converge the output Vout of the $O_2$ sensor 8 to the target value Vop. The reason for the above air-fuel fuel control appears to be that the sensitivity of the output Vout of the $O_2$ sensor 8 to the air-fuel ratio at the inflection point e4 is neither excessively high nor small, but is appropriate. For the above reasons, the basic target value R (ordinary target value) for the element temperature $T_{O2}$ is set to 750° C. or higher, e.g., 800° C.

The heater controller 22 calculates the duty cycle DUT according to the algorithm of a feedback control process for converging the estimated value of the element temperature $T_{O2}$ that is determined by the element temperature observer 20 to the target value R for the element temperature $T_{O2}$ that is set by the element temperature target value setting means 21. Specifically, the duty cycle DUT is calculated according to the algorithm of a feedback control process such as a PI control process or a PID control process. If the duty cycle DUT is calculated according to the algorithm of a PI control process, then the duty cycle DUT is calculated as the sum of a control input component (proportional term) that is proportional to the difference between the estimated value of the element temperature $T_{O2}$ and the target value R, and a control input component (integral term) that is proportional to the integral of the difference. The feedback control process for converging the element temperature $T_{O2}$ to the target value R may be constructed using an algorithm other than the algorithm of a PI control process or a PID control process, e.g., the algorithm of a modern control process such as the algorithm of an optimum control process, the algorithm of a predictive control process, or the like. For stably and accurately converging the element temperature $T_{O2}$ to the target value R, it is preferable to calculate the duty cycle DUT based on, in addition to the control input components (the proportional term and the integral term as described above) depending on the difference between the estimated value of the element temperature $T_{O2}$ and the target value R, a control input component depending on the heater temperature Tht (which is estimated by the element temperature observer 20 in the present embodiment), a control input component depending on air exhaust gas temperature Tgd (which is estimated by the exhaust temperature observer 19 in the present embodiment), and a control input component depending on the target value R.

Overall operation of the apparatus according to the present embodiment will be described below. First, controlling the element temperature $T_{O2}$ of the $O_2$ sensor 8 will be described below. When the engine 1 starts operating (upon an engine startup), the control unit 16 sets initial values Texg(0), Tga(0), Tgb(0), Tgc(0), Tgd(0), Twa(0), Twb(0), Twd(0), $T_{O2}$(0), Tht(0) of the estimated values of the exhaust gas temperatures Texg, Tga, Tgb, Tgc, Tgd, the exhaust pipe temperatures Twa, Twb, Twd, the catalyst temperature Twc, the element temperature $T_{O2}$, and the heater temperature Tht, respectively, as follows: In the present embodiment, while the engine 1 is not in operation, the stop time during which the engine 1 is not in operation is measured. The control unit 16 determines whether the stop time that precedes the startup of the engine 1 exceeds a predetermined time (e.g., 2 hours) or not. If the stop time is greater than the predetermined time, then since the temperature within and of the pipe wall of the exhaust passage 3 is considered to be substantially equal to the atmospheric temperature, the control unit 16 sets the initial values Texg(0), Tga(0), Tgb(0), Tgc(0), Tgd(0), Twa(0), Twb(0), Twd(0), $T_{O2}$(0) Tht(0) to the detected value of the atmospheric temperature $T_A$ at the startup of the engine 1. If the stop time is equal to or smaller than the predetermined time, then since the temperature within and of the pipe wall of the exhaust passage 3 is considered to be closer to the engine temperature TW (the coolant temperature) of the engine 1 than the atmospheric temperature due to the remaining heat that is left in the engine 1 after the engine 1 has stopped its previous operation, the control unit 16 sets the initial values Texg(0), Tga(0), Tgb(0), Tgc(0), Tgd(0), Twa(0), Twb(0), Twd(0), $T_{O2}$(0), Tht(0) to the detected value of the engine temperature TW at the startup of the engine 1. Therefore, these initial values are set to a temperature close to the actual temperatures.

Figure 7:
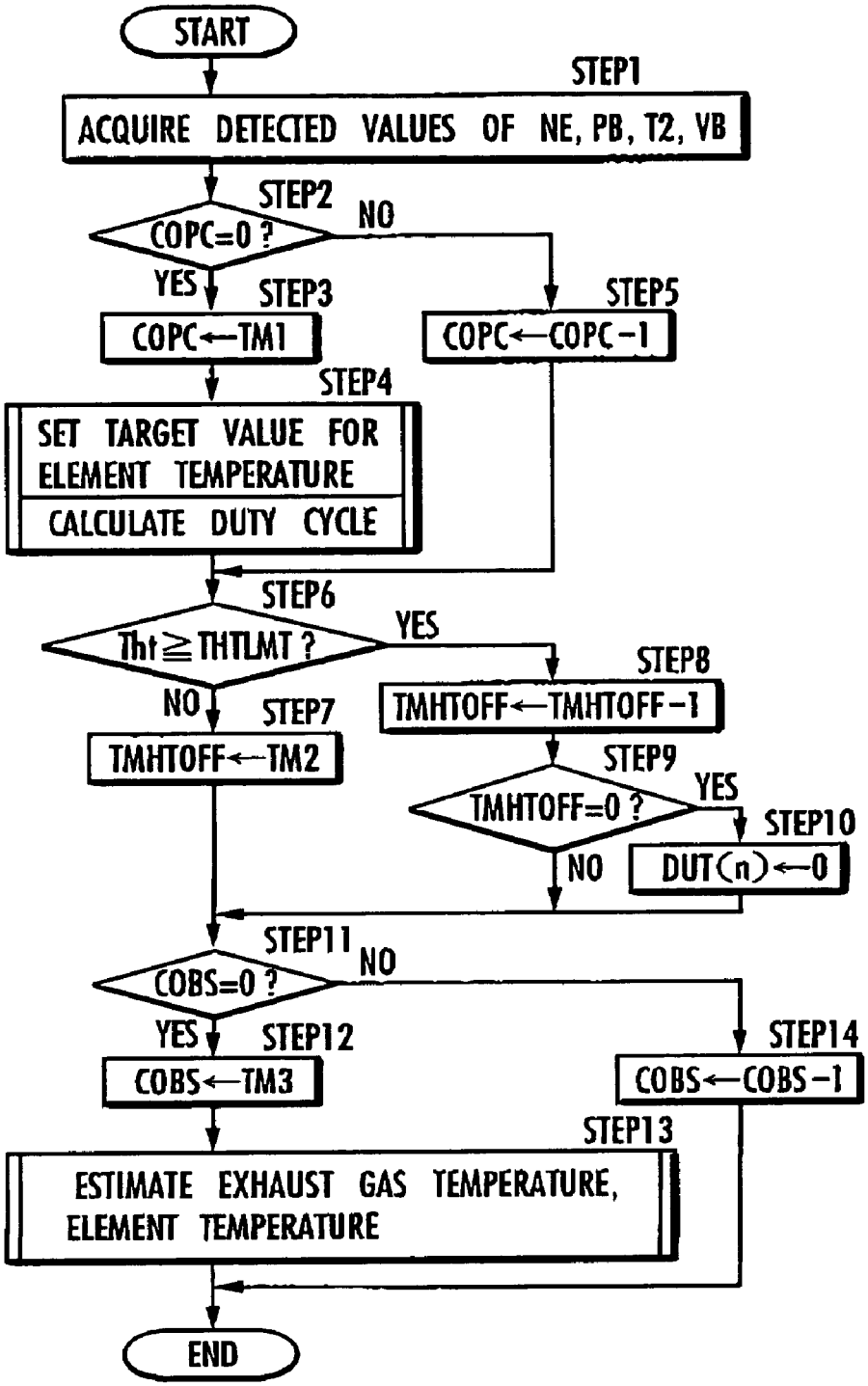
FIG. 7 is a flowchart of an overall processing sequence of the control unit of the apparatus shown in FIG. 1 for controlling the temperature of a sensitive element of the $O_2$ sensor.

When the engine 1 starts to operate upon its startup, the control unit 16 executes a main routine shown in FIG. 7 in a predetermined cycle time (e.g., 10 msec.).

The control unit 16 acquires detected data of the rotational speed NE and the intake pressure PB of the engine 1, the atmospheric temperature TA, and the battery voltage VB in STEP1, and then determines the value of a countdown timer COPC for measuring the time of one period of the processing sequence of the element temperature target value setting means 21 and the heater controller 22 in STEP2. The value of the countdown timer COPC has been initialized to "0" at the time when the engine 1 starts to operate.

If COPC=0, then the control unit 16 newly sets the value of the countdown timer COPC to a timer setting time TM1 which corresponds to one period of the processing sequences of the element temperature target value setting means 21 and the heater controller 22 in STEP3. Thereafter, the element temperature target value setting means 21 carries out a process of setting a target value R for the element temperature $T_{O2}$ of the $O_2$ sensor 8 and the heater controller 22 carries out a process of calculating a duty cycle DUT of the heater 13 in STEP4. If COPC≠0 in STEP2, then the control unit 16 counts down the value of the countdown timer COPC in STEPS, and skips the processing in STEP4 and STEP5. Therefore, the processing in STEP4 (the processing sequences of the element temperature target value setting means 21 and the heater controller 22) and STEPS is carried out at the period determined by the timer setting time TM1.

Figure 8:
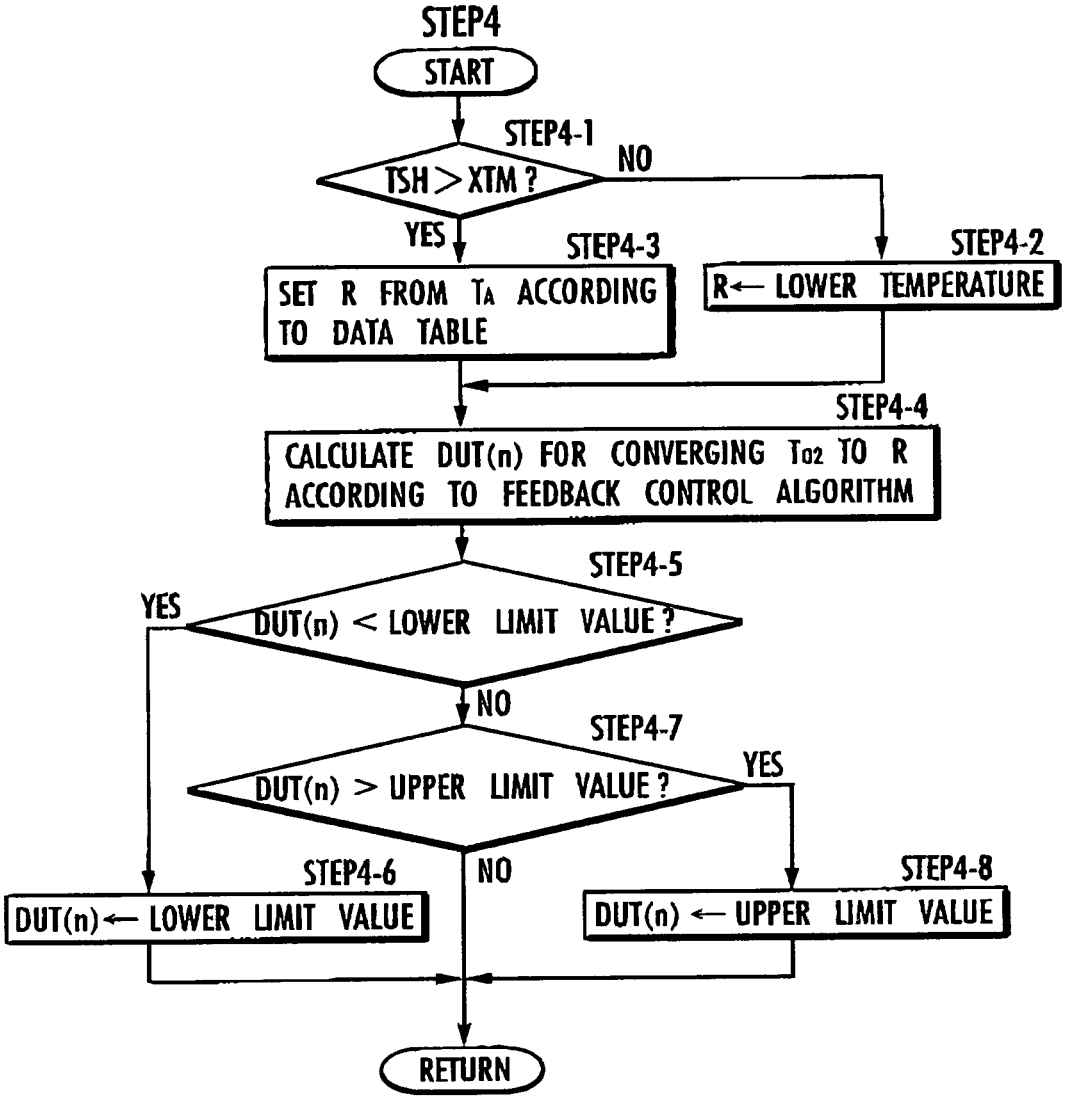
FIG. 8 is a flowchart of a subroutine of the processing sequence shown in FIG. 7.

The processing in STEP4 is specifically carried out as shown in FIG. 8. The element temperature target value setting means 21 carries out a processing sequence in STEP4-1 through STEP4-3. First, the element temperature target value setting means 21 compares the value of a parameter TSH representative of the time that has elapsed from the start of the engine 1 with a predetermined value XTM (e.g., 15 seconds) in STEP4-1. If TSM≦XTM, i.e., if the engine 1 is in a state immediately after it has started to operate, then the element temperature target value setting means 21 sets the target value R for the element temperature $T_{O2}$ to a low temperature (e.g., 600° C.) in order to prevent damage to the active element 10 of the $O_2$ sensor 8 in STEP4-2.

If TSH>XTM in STEP4-1, then the element temperature target value setting means 21 sets the target value R for the element temperature $T_{O2}$ from the present detected value (acquired in STEP1 shown in FIG. 7) of the atmospheric temperature TA based on a predetermined data table in STEP4-3. The target value R that is set at this time is basically a predetermined value (800° C. in the present embodiment) equal to or higher than 750° C. if the atmospheric temperature TA is a normal temperature (e.g., TA≧0° C.). When the atmospheric temperature TA is low (e.g., TA<0° C.) as when the engine 1 is operating in a cold climate, if the target value R for the element temperature $T_{O2}$ is a high temperature of 800° C. because the active element 10 and the heater 13 radiates a relatively large amount of heat, the temperature of the heater 13 is liable to be excessively high. In the present embodiment, when the temperature of the heater 13 becomes excessively high, the heater 13 is forcibly de-energized by an overheating prevention process (described later on) to prevent itself from a failure.

In STEP4-3, according to the present embodiment, when the atmospheric temperature TA is low (e.g., TA<0° C.), the target value R for the element temperature $T_{O2}$ is set to a value slightly lower than the normal value (e.g., 750° C.≦R<800° C.). More specifically, at a normal atmospheric temperature of TA≧0, the target value R is set to a normal target value of 800° C. At TA<0, the target value R is variably set depending on the atmospheric temperature TA in the range of 750° C.≦R<800° C., such that as the atmospheric temperature TA is lower, the target value R is smaller. By thus setting the target value R, it is possible to minimize any situations wherein the heater 13 has to be forcibly de-energized while preventing the heater 13 from being excessively high in temperature.

After the element temperature target value setting means 21 has carried out its own processing sequence as described above, the control unit 16 carries out a processing sequence of the heater controller 22 in STEP4-4 through STEP4-8. The heater controller 22 calculates a present value DUT(n) of the duty cycle DUT as a control input for the heater 13 according to the algorithm of a feedback control process such as a PI control process for converging the estimated value of the element temperature $TO_2$ that is determined by the element temperature observer 20 to the target value R set in STEP4-3 or STEP4-2 in STEP4-4. The estimated value of the element temperature $T_{O2}$ that is used to calculate the present value DUT(n) is a value (determined in STEP13 described later on) which has been determined by the element temperature observer 20 in a processing sequence prior to STEP4 in the present processing sequence. However, when the processing in STEP4 is carried out for the first time after the engine 1 has started to operate, the initial value $T_{O2}$(0) set upon the startup of the engine 1 is used to calculate the present value DUT(n).

Then, the heater controller 22 carries out a limiting process for limiting the duty cycle DUT(n) calculated in STEP4-4 in STEP4-5 through STEP4-8. Specifically, the heater controller 22 determines whether the duty cycle DUT(n) is smaller than a predetermined lower limit value (e.g., 0%) or not in STEP4-5. If DUT(n)<the lower limit value, then the heater controller 22 forcibly sets the value of DUT(n) to the lower limit value in STEP4-6. If DUT(n)≧the lower limit value, then the heater controller 22 determines whether the duty cycle DUT(n) is greater than a predetermined upper limit value (e.g., 100%) or not in STEP4-7. If DUT(n)>the upper limit value, then the heater controller 22 forcibly sets the value of DUT(n) to the upper limit value in STEP4-8. The processing in STEP4 that is carried out by the element temperature target value setting means 21 and the heater controller 22 is now finished.

Control then returns to the main routine shown in FIG. 7. The control unit 16 carries out the processing in STEP6 through STEP10. The processing in STEP6 through STEP10 represents a process of preventing the heater 13 from being overheated. In STEP6, the control unit 16 determines whether or not the present estimated value (latest value) of the heater temperature Tht is equal to or higher than a predetermined upper limit value THTLMT (e.g., 930° C.). In the present embodiment, if Tht≧THTLMT, the control unit 16 forcibly de-energizes the heater 13 to prevent the heater 13 from being damaged. However, the estimated value of Tht may temporarily rise to a value equal to or higher than the upper limit value THTLMT due to a disturbance or the like. According to the present embodiment, therefore, the control unit 16 forcibly de-energizes the heater 13 if the state in which Tht≧THTLMT has continued for a predetermined time (e.g., 3 seconds, hereinafter referred to as "heater OFF delay time").

If Tht<THTLMT in STEP6, then the control unit 16 sets the value of a countdown timer TMHTOFF for measuring the heater OFF delay time to a predetermined value TM2 corresponding to the heater OFF delay time in STEP7. Since the control unit 16 does not forcibly de-energize the heater 13 at this time, control goes to STEP11.

If Tht≧THTLMT in STEP6, then the control unit 16 counts down the value of the countdown timer TMHTOFF by "1" in STEP8. Then, the control unit 16 determines whether the value of the countdown timer TMHTOFF is "0" or not, i.e., whether the heater OFF delay time has elapsed with Tht≧THTLMT or not in STEP9.

If TMHTOFF≠0, then control goes to STEP11. If TMHTOFF=0, then the control unit 16 forcibly sets the present value DUT(n) of the duty cycle DUT to "0" in STEP10. Then, control goes to STEP11.

By thus carrying out the process of preventing the heater 13 from being overheated, the present value DUT(n) of the duty cycle DUT is finally determined. The control unit 16 applies a pulsed voltage to a heater energization circuit (not shown) according to the present value DUT(n) of the duty cycle DUT, energizing the heater 13 with the electric energy depending on the duty cycle DUT(n). When DUT(n)=0, the control unit 16 does not apply a pulsed voltage to the heater energization circuit, thus de-energizing the heater 13.

After having thus executed the processing in STEP6 through STEP10, i.e., the process of preventing the heater 13 from being overheated, the control unit 16 determines the value of a countdown timer COBS for measuring the time dt of one period of the processing sequence of the element temperature observer 20 in STEP11. The value of the countdown timer COBS is initially set to "0" when the engine 1 has started to operate.

If COBS=0, then the control unit 16 newly sets the value of COBS to a timer setting time TM3 which corresponds to the period dt of the processing sequence of the element temperature observer 20 in STEP12. Then, the exhaust temperature observer 19 carries out a process of estimating the exhaust gas temperature Tgd (the exhaust gas temperature in the vicinity of the location of the $O_2$ sensor 8), and the element temperature observer 20 carries out a process of estimating the element temperature $T_{O2}$ (including a process of estimating the heater temperature Tht) in STEP13 (to be described later on). If COBS≠0 in STEP11, the control unit 16 counts down the value of COBC in STEP14, and skips the processing in STEP12 and STEP13. The processing in STEP14 is therefore carried out at a period dt which is determined by the timer setting time TM3. The main routine shown in FIG. 7 is now finished.

According to the present embodiment, the timer setting time TM1 which defines the period of the processing sequences of the element temperature target value setting means 21 and the heater controller 22 (the period at which the processing in STEP4 is carried out) is longer than the timer setting time TM3 which defines the period dt of the processing sequence of the element temperature observer 20 (the period at which the processing in STEP13 is carried out). Specifically, the processing sequence of the element temperature observer 20 should preferably be carried out at a relatively short period (e.g., 20 to 50 msec.) in order to increase the accuracy with which to estimate temperatures. The period of the processing sequence of the heater controller 22 may be longer than the period of the processing sequence of the element temperature observer 20 because the response speed of a change in the element temperature with respect to the control input (duty cycle DUT) is relatively low (in terms of a frequency of several Hz). According to the present invention, therefore, the timer setting time TM1 is selected to be longer than the timer setting time TM3 for thereby setting the period of the processing sequences of the element temperature target value setting means 21 and the heater controller 22 to a time (e.g., 300 to 500 msec.) longer than the period dt of the processing sequence of the element temperature observer 20.

Figure 9:
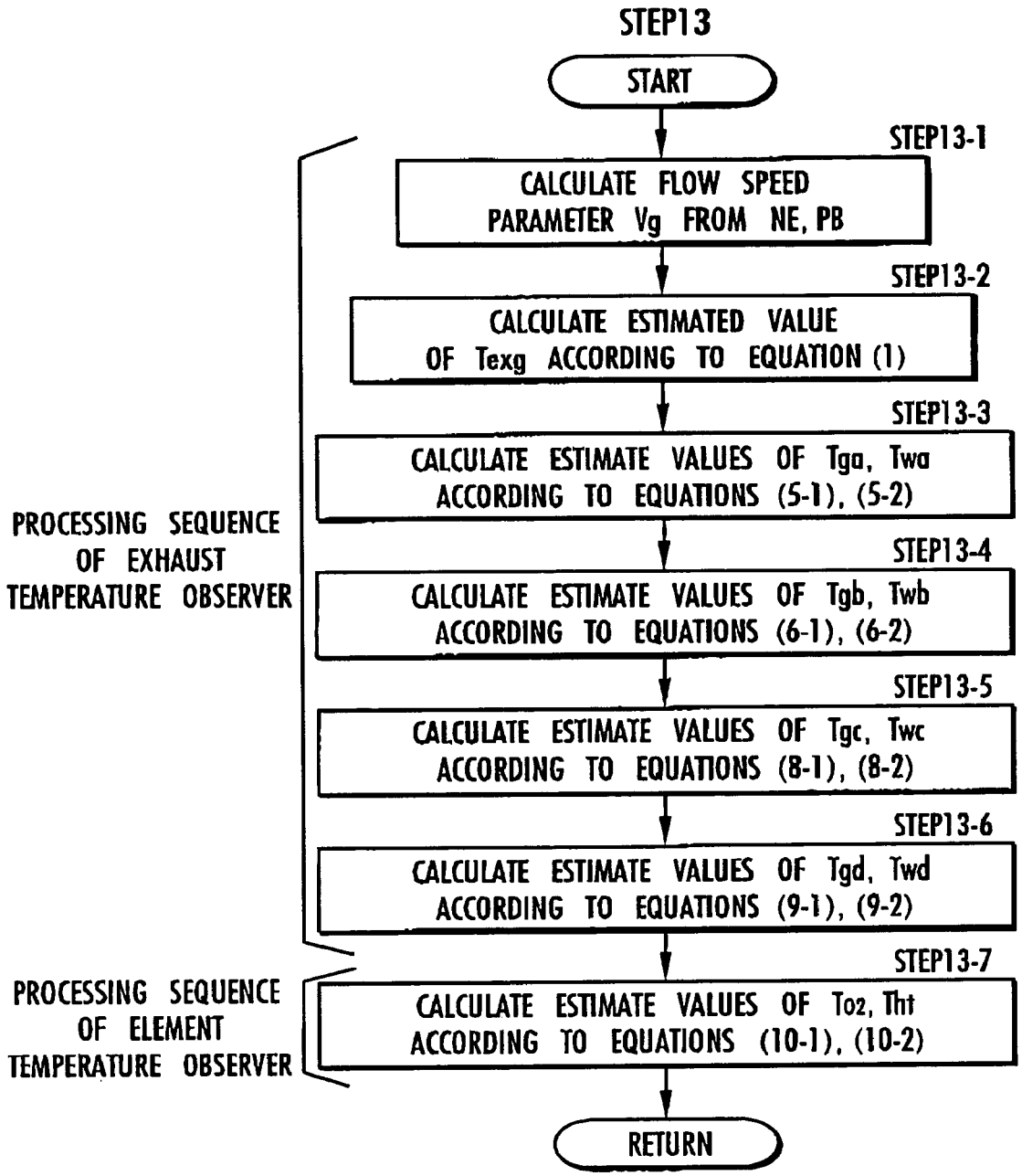
FIG. 9 is a flowchart of another subroutine of the processing sequence shown in FIG. 7.
Figure 10:
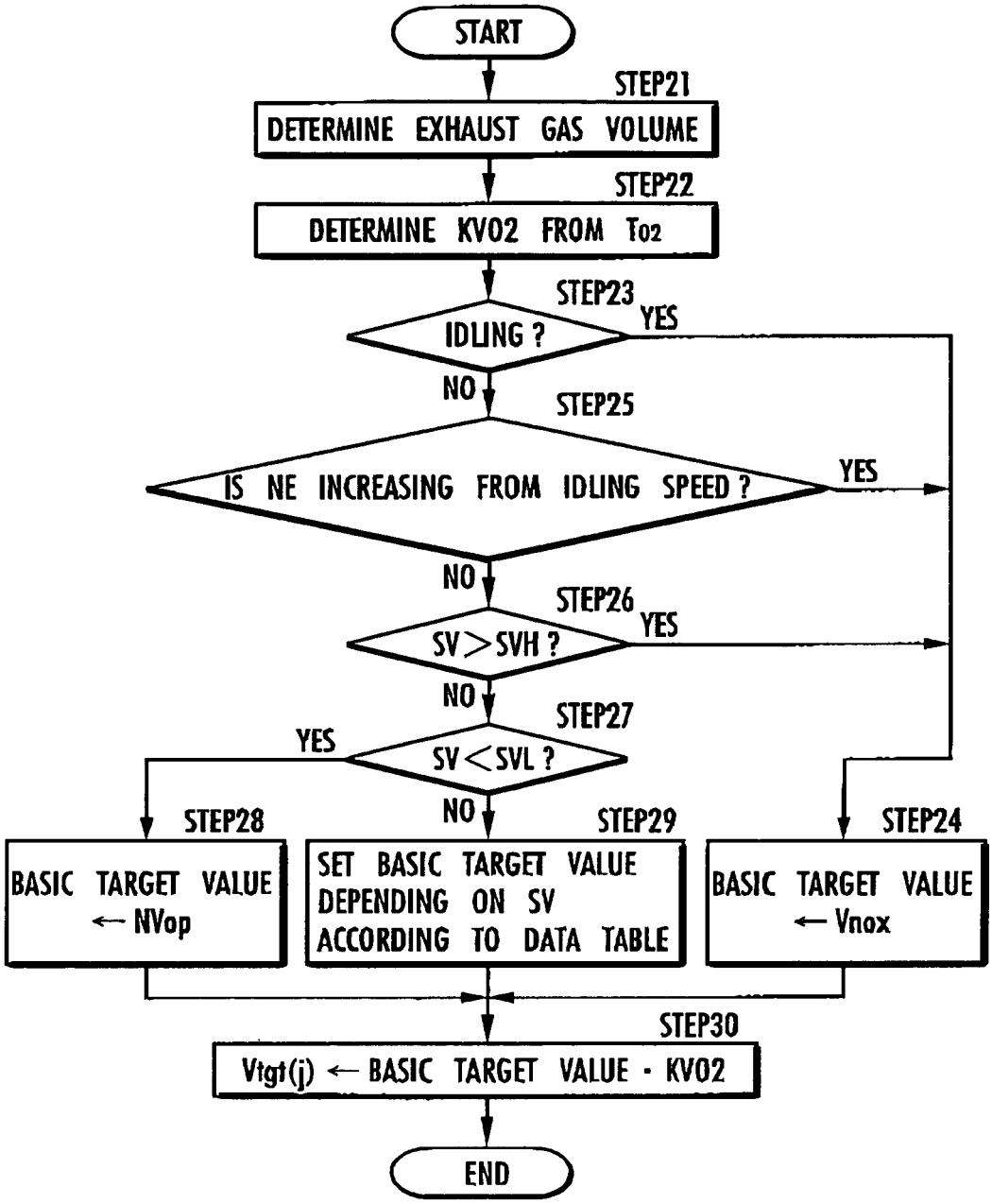
FIG. 10 is a flowchart of a process of setting a target value for the output of the $O_2$ sensor with the control unit of the apparatus shown in FIG. 1.

The processing in STEP13 is specifically carried out as shown in FIG. 9. The exhaust temperature observer 19 successively carries out the processing in STEP13-1 through STEP13-6 to determine an estimated value of the exhaust gas temperature Tgd in the vicinity of the location of the $O_2$ sensor 8. In STEP13-1, the exhaust temperature observer 19 determines a gas speed parameter Vg according to the equation (7) using the present detected values (the latest values acquired in STEP1) of the rotational speed NE and the intake pressure PB of the engine 1. The gas speed parameter Vg is forcibly set to Vg=1 if the result calculated by the equation (7) exceeds "1" due to an excessive rotational speed of the engine 1.

Then, the exhaust temperature observer 19 calculates an estimated value of the exhaust gas temperature Texg at the exhaust port 2 of the engine 1 according to the equation (1) in STEP13-2. Specifically, the exhaust temperature observer 19 determines a basic exhaust gas temperature TMAP(NE, PB) from the present detected values of the rotational speed NE and the intake pressure PB of the engine 1 based on a predetermined map, and thereafter calculates the right side of the equation (1) using the basic exhaust gas temperature TMAP(NE,PB), the present estimated value Texg(k−1) (determined in STEP13-2 in the preceding cycle time) of the exhaust gas temperature Texg, and the value of a predetermined coefficient Ktex, thus calculating a new estimated value Texg(k) of the exhaust gas temperature Texg. In the present embodiment, while the engine 1 is idling and also while the supply of fuel to the engine 1 is being cut off, the basic exhaust gas temperature TMAP used in the calculation of the equation (1) is set to predetermined values corresponding to the respective engine operating states. When the engine 1 starts to operate, the atmospheric temperature $T_A$ or the engine temperature TW detected at this time is set as an initial value Texg(0) of the estimated value of the exhaust gas temperature Texg. When the equation (1) is calculated for the first time after the engine 1 has started to operate, the initial value Texg(0) is used as the value of Texg(k−1).

Then, the exhaust temperature observer 19 calculates an estimated value of the exhaust gas temperature Tga and an estimated value of the exhaust pipe temperature Twa in the partial exhaust passageway 3*a* according to the respective equations (5-1), (5-2) in STEP13-3. Specifically, the exhaust temperature observer 19 determines a new estimated value Tga(k+1) of the exhaust gas temperature Tga by calculating the right side of the equation (5-1) using the present estimated value Tga(k) (determined in STEP13-3 in the preceding cycle time) of the exhaust gas temperature Tga, the present estimated value (determined in STEP13-3 in the preceding cycle time) of the exhaust pipe temperature Twa, the present estimated value of the exhaust gas temperature Texg previously calculated in STEP13-2, the present value of the gas speed parameter Vg calculated in STEP13-1, the value of the predetermined model coefficient Aa, and the value of the period dt of the processing sequence of the exhaust temperature observer 19.

The exhaust temperature observer 19 calculates a new estimated value Twa(k+1) of the exhaust pipe temperature Twa by calculating the right side of the equation (5-2) using the present estimated value Tga(k) (determined in STEP13-3 in the preceding cycle time) of the exhaust gas temperature Tga, the present estimated value (determined in STEP13-3 in the preceding cycle time) of the exhaust pipe temperature Twa, the values of the predetermined model coefficients Ba, Ca, and the value of the period dt of the processing sequence of the exhaust temperature observer 19.

When the engine 1 starts to operate, the atmospheric temperature $T_A$ or the engine temperature TW detected at this time is set as initial values Tga(0), Twa(0) of the estimated values of the exhaust gas temperature Tga and the exhaust pipe temperature Twa. When the equations (5-1), (5-2) are calculated for the first time after the engine 1 has started to operate, these initial values Tga(0), Twa(0) are used as the respective values of Tga(k−1), Twa(k−1).

Then, the exhaust temperature observer 19 calculates an estimated value of the exhaust gas temperature Tgb and an estimated value of the exhaust pipe temperature Twb in the partial exhaust passageway 3*b* according to the respective equations (6-1), (6-2) in STEP13-4. Specifically, the exhaust temperature observer 19 determines a new estimated value Tgb(k+1) of the exhaust gas temperature Tgb by calculating the right side of the equation (6-1) using the present estimated value Tgb(k) (determined in STEP13-4 in the preceding cycle time) of the exhaust gas temperature Tgb, the present estimated value (determined in STEP13-4 in the preceding cycle time) of the exhaust pipe temperature Twb, the present estimated value of the exhaust gas temperature Tga previously calculated in STEP13-3, the present value of the gas speed parameter Vg calculated in STEP13-1, the value of the predetermined model coefficient Ab, and the value of the period dt of the processing sequence of the exhaust temperature observer 19.

The exhaust temperature observer 19 calculates a new estimated value Twb(k+1) of the exhaust pipe temperature Twb by calculating the right side of the equation (6-2) using the present estimated value Tgb(k) (determined in STE13-4 in the preceding cycle time) of the exhaust gas temperature Tgb, the present estimated value (determined in STEP13-4 in the preceding cycle time) of the exhaust pipe temperature Twb, the values of the predetermined model coefficients Bb, Cb, and the value of the period dt of the processing sequence of the exhaust temperature observer 19.

When the engine 1 starts to operate, the atmospheric temperature $T_A$ or the engine temperature TW detected at this time is set as initial values Tgb(0), Twb(0) of the estimated values of the exhaust gas temperature Tgb and the exhaust pipe temperature Twb. When the equations (6-1), (6-2) are calculated for the first time after the engine 1 has started to operate, these initial values Tgb(0), Twb(0) are used as the respective values of Tgb(k−1), Twb(k−1).

Then, the exhaust temperature observer 19 calculates an estimated value of the exhaust gas temperature Tgc and an estimated value of the exhaust pipe temperature Twc in the partial exhaust passageway 3*c* according to the respective equations (8-1), (8-2) in STEP13-5. Specifically, the exhaust temperature observer 19 determines a new estimated value Tgc(k+1) of the exhaust gas temperature Tgc by calculating the right side of the equation (8-1) using the present estimated value Tgc(k) (determined in STEP13-5 in the preceding cycle time) of the exhaust gas temperature Tgc, the present estimated value (determined in STEP13-5 in the preceding cycle time) of the exhaust pipe temperature Twc, the present estimated value of the exhaust gas temperature Tgb previously calculated in STEP13-4, the present value of the gas speed parameter Vg calculated in STEP13-1, the value of the predetermined model coefficient Ac, and the value of the period dt of the processing sequence of the exhaust temperature observer 19.

The exhaust temperature observer 19 calculates a new estimated value Twc(k+1) of the catalyst temperature Twc by calculating the right side of the equation (8-2) using the present estimated value Tgc(k) (determined in STEP13-5 in the preceding cycle time) of the exhaust gas temperature Tgc, the present estimated value (determined in STEP13-5 in the preceding cycle time) of the catalyst temperature Twc, the present value of the gas speed parameter Vg calculated in STEP13-1, the values of the predetermined model coefficients Bc, Cc, Dc, and the value of the period dt of the processing sequence of the exhaust temperature observer 19.

When the engine 1 starts to operate, the atmospheric temperature $T_A$ or the engine temperature TW detected at this time is set as initial values Tgc(0), Twc(0) of the estimated values of the exhaust gas temperature Tgc and the exhaust pipe temperature Twc. When the equations (8-1), (8-2) are calculated for the first time after the engine 1 has started to operate, these initial values Tgc(0), Twc(0) are used as the respective values of Tgc(k−1), Twc(k−1).

Then, the exhaust temperature observer 19 calculates an estimated value of the exhaust gas temperature Tgd and an estimated value of the exhaust pipe temperature Twd in the partial exhaust passageway 3*d* (near the location of the $O_2$ sensor 8) according to the respective equations (9-1), (9-2) in STEP13-6. Specifically, the exhaust temperature observer 19 determines a new estimated value Tgd(k+1) of the exhaust gas temperature Tgd by calculating the right side of the equation (9-1) using the present estimated value Tgd(k) (determined in STEP13-6 in the preceding cycle time) of the exhaust gas temperature Tgd, the present estimated value (determined in STEP13-6 in the preceding cycle time) of the exhaust pipe temperature Twd, the present estimated value of the exhaust gas temperature Tgc previously calculated in STEP13-5, the present value of the gas speed parameter Vg calculated in STEP13-1, the value of the predetermined model coefficient Ad, and the value of the period dt of the processing sequence of the exhaust temperature observer 19.

The exhaust temperature observer 19 calculates a new estimated value Twd(k+1) of the exhaust pipe temperature Twd by calculating the right side of the equation (9-2) using the present estimated value Tgd(k) (determined in STEP13-6 in the preceding cycle time) of the exhaust gas temperature Tgd, the present estimated value (determined in STEP13-6 in the preceding cycle time) of the exhaust pipe temperature Twd, the values of the predetermined model coefficients Bd, Cd, and the value of the period dt of the processing sequence of the exhaust temperature observer 19.

When the engine 1 starts to operate, the atmospheric temperature TA or the engine temperature TW detected at this time is set as initial values Tgd(0), Twd(0) of the estimated values of the exhaust gas temperature Tgd and the exhaust pipe temperature Twd. When the equations (9-1), (9-2) are calculated for the first time after the engine 1 has started to operate, these initial values Tgd(0), Twd(0) are used as the respective values of Tgd(k−1), Twd(k−1).

Then, the element temperature observer 20 executes the processing in STEP13-7 to determine estimated values of the element temperature $TO_2$ of the $O_2$ sensor 8 and the heater temperature Tht according to the equations (10-1), (10-2). Specifically, the element temperature observer 20 determines a new estimated value $T_{O2}(k+1)$ of the element temperature $T_{O2}$ by calculating the right side of the equation (10-1) using the present estimated value $T_{O2}(k)$ (determined in STEP13-7 in the preceding cycle time) of the element temperature $T_{O2}$, the present estimated value Tht(k) (determined in STEP13-7 in the preceding cycle time) of the heater temperature Tht, the present estimated value Tgd(k) of the exhaust gas temperature Tgd previously calculated in STEP13-6, the present detected value $T_A(k)$ (the latest value acquired in STEP1 shown in FIG. 7) of the atmospheric temperature $T_A$ as the temperature $T_A'$ of the air in the active element 10, the values of the predetermined model coefficients Ax, Bx, and the value of the period dt (=the period of the processing sequence of the exhaust temperature observer 19) of the processing sequence of the element temperature observer 20.

Then, the element temperature observer 20 determines a new estimated value Tht(k+1) of the heater temperature Tht by calculating the right side of the equation (10-2) using the present estimated value $T_{O2}(k)$ (determined in STEP13-7 in the preceding cycle time) of the element temperature $T_{O2}$, the present estimated value Tht(k) (determined in STEP13-7 in the preceding cycle time) of the heater temperature Tht, the present detected value $T_A(k)$ (the latest value acquired in STEP1 shown in FIG. 7) of the atmospheric temperature $T_A$ as the temperature $T_A'$ of the air in the active element 10, the present value DUT(k) of the duty cycle DUT, the values of the predetermined model coefficients Cx, Dx, and the value of the period dt of the processing sequence of the element temperature observer 20.

When the engine 1 starts to operate, the atmospheric temperature TA or the engine temperature TW detected at this time is set as initial values $T_{O2}(0)$, Tht(0) of the estimated values of the element temperature $T_{O2}$ and the heater temperature Tht. When the equations (10-1), (10-2) are calculated for the first time after the engine 1 has started to operate, these initial values $T_{O2}(0)$, Tht(0) are used as the respective values of $T_{O2}(k-1)$, Tht(k−1). The duty cycle DUT(k) used in the equation (10-2) is basically of the latest value determined by the heater controller 22 in STEP4. However, if the value of the duty cycle DUT is limited in STEP10 to de-energize the heater 13, then the limited value of the duty cycle DUT is used in the equation (10-2).

A process of controlling the air-fuel ratio of the engine 1 will be described below. While controlling the element temperature $T_{O2}$ of the $O_2$ sensor 8 as described above, the $O_2$ output target value setting means 18 concurrently sequentially determines the target value Vtgt for the output of the $O_2$ sensor 8 in a predetermined cycle time (processing period), according to a processing sequence shown in FIG. 10.

The $O_2$ output target value setting means 18 determines an exhaust gas volume SV as a parameter representing the load on the engine 1 in STEP21. The exhaust gas volume SV represents the rate at which the exhaust gas flows. In the present embodiment, the exhaust gas volume SV is determined from the latest value of a fuel consumption quantity NTI per unit time of the engine 1 which is sequentially calculated by the air-fuel ratio control means 17 for controlling the air-fuel ratio, based on a predetermined data table. The fuel consumption quantity per unit time of the engine 1 is determined by multiplying, by the rotational speed NE of the engine 1, a basic fuel consumption quantity of the engine 1 (a standard value (basic value) of the fuel consumption quantity depending on the rotational speed NE and the intake pressure PB of the engine 1) that is determined from the detected values of the rotational speed NE and the intake pressure PB of the engine 1 based on a map or the like. If the rate at which intake air supplied to the engine 1 or the exhaust gas flows is detected directly by a flow sensor, then the detected rate may be used instead of the exhaust gas volume SV.

Then, in order to set the target value Vtgt for the output Vout of the $O_2$ sensor 8 variably depending on the element temperature $T_{O2}$, the $O_2$ output target value setting means 18 determines a corrective coefficient KVO2 from the latest value (present value) of the estimated value of the element temperature $T_{O2}$ that is determined by the element temperature observer 20, based on the data table shown in FIG. 11 in STEP22.

Then, the $O_2$ output target value setting means 18 determines whether the engine 1 is idling or not in STEP23. If the engine 1 is idling, then the $O_2$ output target value setting means 18 sets the basic target value for the output of the $O_2$ sensor 8 to a predetermined value Vnox in STEP24. As shown in FIG. 4, the predetermined value Vnox is equal to an output value of the $O_2$ sensor 8 which substantially maximizes the purification rate of the catalytic converter 4 for NOx when the element temperature $T_{O2}$ is a predetermined temperature (e.g., 800° C.), and is equal to an output value of the $O_2$ sensor 8 which makes the air-fuel ratio of the exhaust gas richer than the purification optimum output Vop for achieving sufficiently good purification rates for all CO, HC, NOx at the predetermined temperature. Since the output characteristics of the $O_2$ sensor 8 are substantially constant when the element temperature $T_{O2}$ is equal to or higher than 750° C., the output value of the $O_2$ sensor 8 for maximizing the purification rate of the catalytic converter 4 for NOx (hereinafter referred to as "NOx purification optimum output") is substantially constant when the element temperature $T_{O2}$ is equal to or higher than 750° C., and is substantially the same as the NOx purification optimum output Vnox (hereinafter referred to as "NOx purification reference optimum output Vnox") when the element temperature $T_{O2}$ is the predetermined temperature (800° C.). When the element temperature $T_{O2}$ is lower than 750° C., the NOx purification optimum output tends to be larger as the element temperature $T_{O2}$ is lower, as with the purification optimum output Vop. Therefore, the NOx purification optimum output at each element temperature $T_{O2}$ is substantially equal to a value that is produced by multiplying the NOx purification reference optimum output Vnox by the corrective coefficient KVO2 that is determined from the data table shown in FIG. 11.

After having set the basic target value to the NOx purification reference optimum output Vnox in STEP24, the $O_2$ output target value setting means 18 multiplies the basic target value Vnox by the corrective coefficient KVO2 that is determined in STEP22, thus correcting the basic target value Vnox thereby to set a present target value Vtgt(j) for the output Vout of the $O_2$ sensor 8 in STEP30. In Vtgt(j), j represents the ordinal number of a cycle time of the processing sequence shown in FIG. 10.

Thus, if the answer to STEP23 is YES, the target value Vtgt(j) (=Vnox·KVO2) set in STEP30 is equal to the latest value of the estimated value of the element temperature $T_{O2}$, i.e., the output value of the $O_2$ sensor 8 for maximizing the purification rate of the catalytic converter 4 for NOx at the present element temperature $T_{O2}$. For example, as shown in FIG. 4, when the element temperature $T_{O2}$ is 650° C., the target value Vtgt(j) is set to a value that is substantially equal to the output value Vnox' shown in FIG. 4. The reason why the target value Vtgt is set as described above while the engine 1 is idling will be described later on.

If the engine 1 is not idling in STEP23, then the $O_2$ output target value setting means 18 determines whether the rotational speed NE of the engine 1 is in the process of increasing from the idling speed or not in STEP25. If the answer to STEP25 is YES, then the vehicle on which the engine 1 is mounted starts moving, for example. In such a situation, the proportion of NOx contained in the exhaust gas is greater than the proportions of other gas components contained in the exhaust gas. According to the present invention, if the answer to STEP25 is YES, then the $O_2$ output target value setting means 18 carries out the processing in STEP24, STEP30 to set the output value (=Vnox·KVO2) of the $O_2$ sensor 8 for maximizing the purification rate of the catalytic converter 4 for NOx as the target value Vtgt(j). The decision process in STEP25 is carried out based on the detected value of the rotational speed NE of the engine 1 or a rate of change thereof (a change of NE per unit time). For example, when the rotational speed NE of the engine 1 is higher than the idling speed by a predetermined value and the rate of change of the rotational speed NE is of a predetermined value or more on the increase of the rotational speed NE, it is possible to judge that the rotational speed NE is increasing from the idling speed. Since the rotational speed NE increases from the idling speed basically when the vehicle on which the engine 1 is mounted starts moving, it may be determined whether the vehicle starts moving or not based on a detected value of the vehicle speed or an ON/OFF signal representing operation of the brake of the vehicle, and if the vehicle starts moving, then it may be judged that the rotational speed NE of the engine 1 is in the process of increasing from the idling speed.

If the answer to STEP25 is NO, then the $O_2$ output target value setting means 18 determines whether the exhaust gas volume SV determined in STEP21 is greater than a predetermined high-load threshold SVH or not in STEP26. If SV>SVH (the engine 1 is operating under a high load), then the proportion of NOx contained in the exhaust gas is greater than the proportions of other gas components contained in the exhaust gas, as when the rotational speed NE of the engine 1 is in the process of increasing from the idling speed. Therefore, if the answer to STEP26 is YES, then the $O_2$ output target value setting means 18 sets the output value (=Vnox·KVO2) of the $O_2$ sensor 8 for substantially maximizing the purification rate of the catalytic converter 4 for NOx as a target value Vtgt(j).

If the answer to STEP26 is NO, then the $O_2$ output target value setting means 18 determines whether the exhaust gas volume SV determined in STEP21 is greater than a predetermined low-load threshold SVL or not in STEP27. If SV<SVL (the engine 1 is operating under a low load), then the $O_2$ output target value setting means 18 sets the reference purification optimum output NVop as a basic target value in STEP28. In STEP30, the basic target value NVop is multiplied by the corrective coefficient KVO2 determined in STEP22, thus setting a present target value Vtgt(j) (=NVop·KVO2).

If the answer to STEP27 is YES (the engine 1 is operating under a low load), therefore, then the target value Vtgt(j) set in STEP30 is equal to an output value of the $O_2$ sensor 8 for achieving sufficiently good purification rates for all CO, HC, NOx at the present element temperature $T_{O2}$ (the latest estimated value of the element temperature $T_{O2}$ that has been used to determine the corrective coefficient KVO2 in STEP22), i.e., the purification optimum output Vop. When the engine 1 is operating under a low load with SV<SVL, the vehicle on which the engine 1 is mounted is running at a substantially constant speed, for example.

Figure 12:
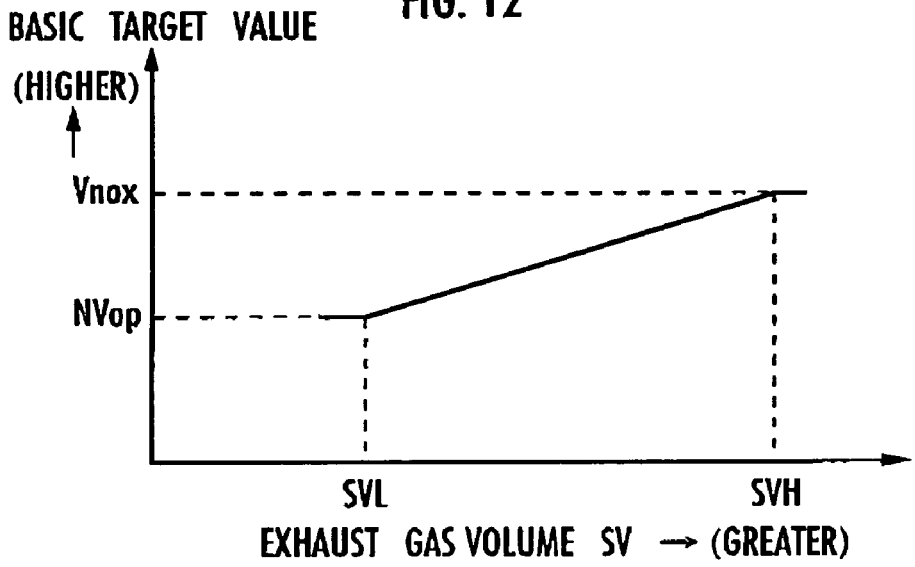
FIG. 12 is a graph showing another data table used in the process shown in FIG. 10.

If the answer to STEP27 is NO (SVL≦SV≦SVH, i.e., the engine 1 is operating under a medium load), then the $O_2$ output target value setting means 18 sets a basic target value depending on the exhaust gas volume SV based on a predetermined data table shown in FIG. 12, for example in STEP29. The data table shown in FIG. 12 is established such that the basic target value is set to a higher value (an output value of the $O_2$ sensor 8 for making the exhaust gas air-fuel ratio richer) as the exhaust gas volume SV is greater. The basic target value at SV=SVL is equal to the reference purification optimum output NVop, and the basic target value at SV=SVH is equal to the NOx purification reference optimum output Vnox. Therefore, when the engine 1 is operating under a medium load, the basic target value is set so as to vary continuously depending on the exhaust gas volume SV, i.e., depending on the load of the engine 1, between the reference purification optimum output NVop and the NOx purification reference optimum output Vnox. After having thus set the basic target value in STEP29, the $O_2$ output target value setting means 18 multiplies the basic target value by the corrective coefficient KVO2 that is determined in STEP22, thus setting a present target value Vtgt(j). The target value Vtgt(j) thus set is equal to an output value of the $O_2$ sensor 8 for increasing the purification rate of the catalytic converter 4 for NOx as the load on the engine 1 is greater. The above process described in detail above is the processing sequence of the $O_2$ output target value setting means 18.

The air-fuel ratio control means 17 controls the air-fuel ratio of the air-fuel mixture to be combusted by the engine 1 according to a feedback control process for converging the output Vout of the $O_2$ sensor 8 to the target value Vtgt that has been set by the $O_2$ output target value setting means 18 as described above.

With the apparatus according to the first embodiment of the present invention, as described above, the target value Vtgt for the output Vout of the $O_2$ sensor 8 is set variably depending on the element temperature $T_{O2}$ by setting the corrective coefficient KVO2 depending on the element temperature $T_{O2}$ based on the data table shown in FIG. 11. Consequently, it is possible to set a target value Vtgt appropriate for achieving a desired exhaust gas purification capability of the catalytic converter 4 irrespective of the element temperature $T_{O2}$. By controlling the air-fuel ratio to converge the output Vout of the $O_2$ sensor 8 to the target value Vtgt, the desired exhaust gas purification capability of the catalytic converter 4 can be maintained irrespective of the element temperature $T_{O2}$.

In addition, the heater controller 22 controls the heater 13 to keep the element temperature $T_{O2}$ at the target value R that is set by the element temperature target value setting means 21. The target value R is basically constant except immediately after the engine 1 has started to operate and when the atmospheric temperature $T_A$ is considerably low ($T_A$<0° C. in the present embodiment). Therefore, any changes in element temperature $T_{O2}$ are minimized. As a result, it is possible to stabilize the output characteristics of the $O_2$ sensor 8 and hence increase the stability of the desired exhaust gas purification capability of the catalytic converter 4. While the target value for the element temperature $T_{O2}$ is maintained at a constant level when the engine 1 is operating in a steady state, since the actual element temperature $T_{O2}$ is substantially kept at the same level as the target value R by controlling the heater 13 with the heater controller 22, the target value Vtgt for the output Vout of the $O_2$ sensor 8 is kept substantially constant. If the atmospheric temperature $T_A$ is considerably low, however, the actual element temperature $T_{O2}$ may not be able to reach the target value R because the temperature of the exhaust gas is relatively low and the amount of heat radiated into the atmosphere is large. Furthermore, due to a change in the temperature of the exhaust gas caused by a change in the operating state of the engine 1, the actual element temperature $T_{O2}$ may vary with respect to the target value R. In these instances, the desired exhaust gas purification capability of the catalytic converter 4 is reliably maintained by setting the target value Vtgt for the output Vout of the $O_2$ sensor 8 depending on the element temperature $T_{O2}$.

According to the present embodiment, the element temperature $T_{O2}$ used in the processing sequences of the $O_2$ output target value setting means 18 and the heater controller 22 is estimated based on the rotational speed NE and the intake pressure PB that serve as parameters indicative of the operating state of the engine 1 and the thermal models represented by the equations (2-1), (2-2) through (10-1), (10-2). In the estimating process, a temperature change that the exhaust gas undergoes as it flows from the exhaust port 2 of the engine 1 to the location of the $O_2$ sensor 8, the heat transfer between the exhaust gas and the active element 10, the heat transfer between the active element 10 and the heater 13, and the duty cycle DUT representative of the amount of electric energy supplied to the heater 13 are taken into account. Therefore, the element temperature $T_{O2}$ can accurately be estimated without the need for a temperature sensor. Inasmuch as the target value Vtgt for the output Vout of the $O_2$ sensor 8 is set using the estimated value of the element temperature $T_{O2}$, it is possible to set a target value Vtgt appropriate for maintaining the desired exhaust gas purification capability of the catalytic converter 4. Moreover, since the supply of electric energy to the heater 13 is controlled using the estimated value of the element temperature $T_{O2}$, the element temperature $T_{O2}$ can be controlled at the target value R stably. Thus, the desired exhaust gas purification capability of the catalytic converter 4 can be maintained while properly eliminating the effect of a change in the output characteristics of the $O_2$ sensor 8 which is caused by the element temperature $T_{O2}$.

According to the present invention, furthermore, the target value Vtgt for the output Vout of the $O_2$ sensor 8 is set to such a value that the purification rate of the catalytic converter 4 for NOx is maximized when the engine 1 is operating in a state wherein NOx contained in the exhaust gas is large, as when the rotational speed NE of the engine 1 is in the process of increasing from the idling speed or the engine 1 is operating under a high load. Therefore, the ability of the catalytic converter 4 to purify NOx is increased in situations wherein NOx contained in the exhaust gas is large.

According to the present invention, the target value Vtgt for the output Vout of the $O_2$ sensor 8 is set to such a value that the purification rate of the catalytic converter 4 for NOx is maximized even while the engine 1 is idling, for the following reasons: With the engine 1 mounted on the vehicle, it is generally difficult to predict the timing when the rotational speed NE starts increasing from the idling speed as when the vehicle starts moving. Therefore, the timing when it can be judged that the rotational speed NE is in the process of increasing from the idling speed (i.e., the timing when the answer to STEP25 shown in FIG. 10 changes from NO to YES) is delayed from the timing when the rotational speed NE actually starts increasing from the idling speed. There is also a certain delay occurring until the actual output Vout of the $O_2$ sensor 8 is substantially converged to the target value Vtgt that maximizes the purification rate of the catalytic converter 4 for NOx. Consequently, if the target value Vtgt while the engine 1 is idling is set in the same manner as when the engine 1 is operating under a low load, then it is difficult to sufficiently increase the purification rate for NOx during a period of time after the rotational speed NE starts increasing from the idling speed until the actual output Vout of the $O_2$ sensor 8 is substantially converged to the target value Vtgt that maximizes the purification rate of the catalytic converter 4 for NOx. According to the present embodiment, therefore, even while the engine 1 is idling, the target value Vtgt for the output Vout of the $O_2$ sensor 8 is set to such a value that the purification rate of the catalytic converter 4 for NOx is maximized, so that an air-fuel ratio is achieved for enabling the catalytic converter 4 to purify NOx sufficiently from a time before the rotational speed NE starts increasing. Thus, NOx can sufficiently be purified when the rotational speed NE is in the process of increasing from the idling speed.

According to the present embodiment, when the engine 1 is operating under a medium load, the basic target value for the output Vout of the $O_2$ sensor 8 varies continuously depending on the exhaust gas volume (exhaust gas flow rate) SV between the reference purification optimum output NVop and the NOx purification reference optimum output Vnox. Therefore, the target value Vtgt produced by multiplying the basic target value by the corrective coefficient KVO2 is prevented from varying non-continuously, and hence the air-fuel ratio can be controlled smoothly. Specifically, the air-fuel ratio upstream of the catalytic converter 4 is prevented from changing largely due to a change in the target value Vtgt, and the ability of the output Vout of the $O_2$ sensor 8 to converge to the target value Vtgt is prevented from being lowered, thus preventing the purification rate of the catalytic converter 4 from being lowered when the target value Vtgt changes. At the same time, when NOx contained in the exhaust gas increases as the load on the engine 1 increases, the target value Vtgt changes in a direction to increase the purification rate for NOx, so that the catalytic converter 4 can well purify NOx.

An apparatus for controlling the air-fuel ratio of an internal combustion engine according to a second embodiment of the present invention will be described below with reference to FIGS. 13 and 14. The second embodiment of the present invention corresponds to a second aspect of the present invention. The apparatus according to the second embodiment of the present invention differs partly structurally or functionally from the apparatus according to the first embodiment of the present invention. Those structural or functional parts of the apparatus according to the second embodiment of the present invention which are identical to those of the apparatus according to the first embodiment of the present invention are denoted by identical reference characters, and will not be described in detail below.

Figure 13:
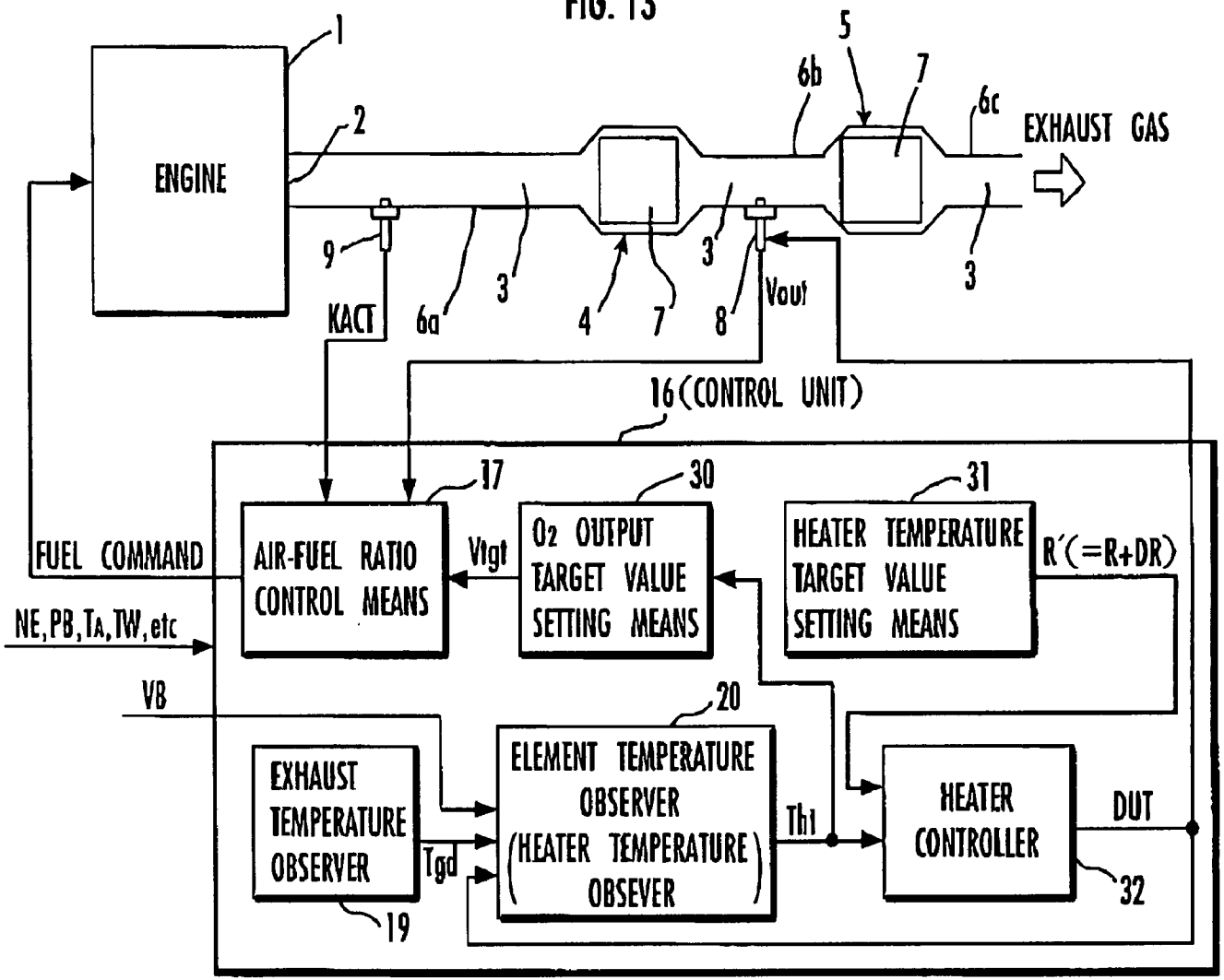
FIG. 13 is a block diagram of an apparatus for controlling the air-fuel ratio of an internal combustion engine according to a second embodiment of the present invention.
Figure 14:
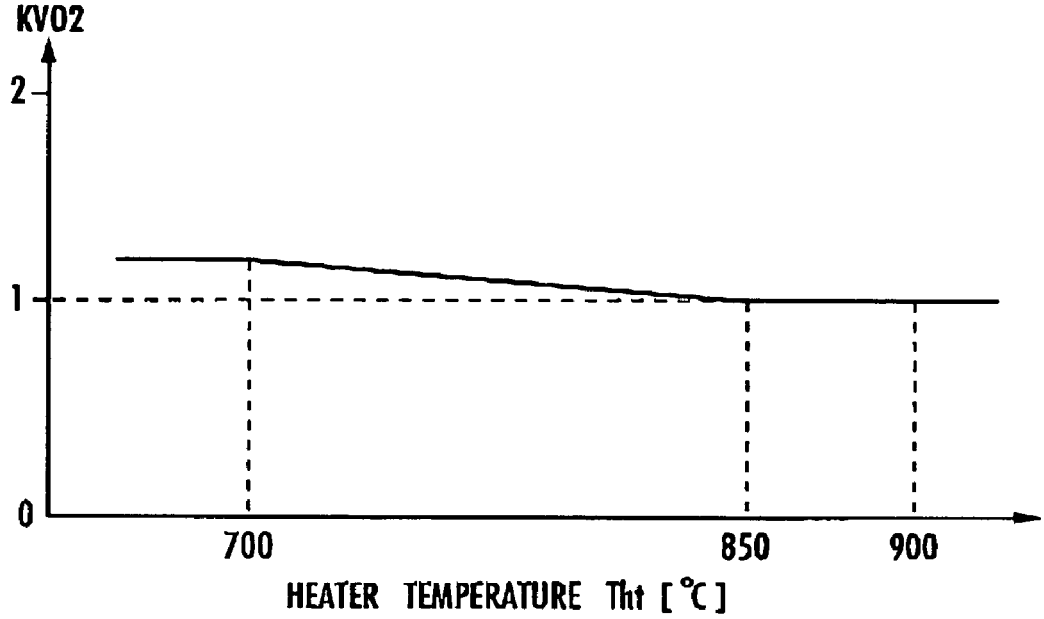
FIG. 14 is a graph showing a data table used in a process carried out by a control unit of the apparatus shown in FIG. 13.

FIG. 13 shows in block form the apparatus for controlling the air-fuel ratio of an internal combustion engine according to the second embodiment of the present invention. As shown in FIG. 13, the apparatus according to the second embodiment of the present invention differs from the apparatus according to the first embodiment of the present invention only as to partial functional means of the control unit 16. The control unit 16 comprises an air-fuel ratio control means 17, an $O_2$ output target value setting means 30, an exhaust temperature observer 19, an element temperature observer 20, a heater temperature target value setting means 31, and a heater controller 32. The air-fuel ratio control means 17, the exhaust temperature observer 19, and the element temperature observer 20 are identical to those of the first embodiment. However, according to the second embodiment, the element temperature observer 20 serves as a heater temperature data acquiring means for sequentially determining an estimated value of the temperature Tht of the heater 13 of the $O_2$ sensor 8 as heater temperature data. In FIG. 13, therefore, the element temperature observer 20 is also denoted as "HEATER TEMPERATURE OBSERVER" in parentheses for outputting an estimated value of the heater temperature Tht (which corresponds to heater temperature data according to the second aspect of the present invention). In the description, which follows, of the second embodiment, the element temperature observer 20 is referred to as a heater temperature observer 20.

The heater temperature target value setting means 31 serves to set a target value R' for the heater temperature Tht of the $O_2$ sensor 8. The findings of the inventors of the present invention show that the heater temperature Tht is relatively highly correlated to the element temperature $T_{O2}$ and is higher a certain temperature than the element temperature $T_{O2}$ in a steady state. According to the present embodiment, the heater temperature target value setting means 31 sets a value (R+DR) which is higher than the target value R (the target value R set in STEP4 in FIG. 7) for the element temperature $T_{O2}$ that is set as described above with reference to the first embodiment by a predetermined value DR (e.g., 100° C.), as the target value R' for the heater temperature Tht. Until a predetermined period of time (e.g., 15 seconds) elapses after the engine 1 has started to operate, the target value R' is set to a low temperature (e.g., 700° C.) that is higher than the target value R set in STEP4-2 in FIG. 8 by the predetermined value DR. Upon elapse of the predetermined period of time after the engine 1 has started to operate, the target value R' is set to a temperature (e.g., a temperature in the range from 850 to 900° C.) that is higher than the target value R that is set depending on the atmospheric temperature $T_A$ in STEP4-3 in FIG. 8 by the predetermined value DR.

The heater controller 32 sequentially determines the duty cycle DUT as a control input to the heater 13 in order to keep the heater temperature Tht at the target value R'. According to the present embodiment, as with the first embodiment, the heater controller 32 calculates the duty cycle DUT to enable the heater temperature observer 20 to converge the estimated value of the heater temperature Tht determined according to the algorithm described in the first embodiment, according to the algorithm of a feedback control process such as a PI control process or a PID control process. For example, if the duty cycle DUT is calculated according to the algorithm of a PI control process, then the duty cycle DUT is calculated as the sum of a control input component (proportional term) that is proportional to the difference between the estimated value of the heater temperature Tht and the target value R', and a control input component (integral term) that is proportional to the integral of the difference. As with the first embodiment, the feedback control process for converging the heater temperature Tht to the target value R' may be constructed using the algorithm of a modern control process such as the algorithm of an optimum control process, the algorithm of a predictive control process, or the like. For stably and accurately converging the heater temperature Tht to the target value R', it is preferable to calculate the duty cycle DUT based on, in addition to the control input components (the proportional term and the integral term as described above) depending on the difference between the estimated value of the heater temperature Tht and the target value R', a control input component depending on the exhaust gas temperature Tgd (which is estimated by the exhaust temperature observer 19 in the present embodiment) and a control input component depending on the target value R'.

The $O_2$ output target value setting means 30 sequentially determines a target value Vtgt for the output Vout of the $O_2$ sensor 8 for an air-fuel ratio control process carried out by the air-fuel ratio control means 17. The process carried out by the $O_2$ output target value setting means 30 differs from the corresponding process in the first embodiment only as to the setting (the processing corresponding to STEP22 shown in FIG. 10) of the corrective coefficient KVO2 for varying the target value Vtgt for the output Vout of the $O_2$ sensor 8 depending on the element temperature $T_{O2}$. Specifically, according to the present embodiment, since the element temperature $T_{O2}$ and the heater temperature Tht are highly correlated to each other, the corrective coefficient KVO2 is set depending on the heater temperature Tht (which is an estimated value determined by the heater temperature observer 20) based on a predetermined data table shown in FIG. 14, for example. In a steady state, the heater temperature Tht is generally higher than the element temperature $T_{O2}$ by a predetermined value DR (e.g., 100° C.). Therefore, when the heater temperature Tht is 850° C. or higher (at this time, the element temperature $T_{O2}$ is about 750° C. or higher), the corrective coefficient KVO2 is set to "1". This processing corresponds to the processing according to the first embodiment wherein when $T_{O2} \geqq 750°$ C. in FIG. 11, the corrective coefficient KVO2 is set to "1". When the heater temperature Tht is lower than 850° C. (at this time, the element temperature $T_{O2}$ is generally lower than 750° C.), the corrective coefficient KVO2 is set to be slightly greater than "1" as the heater temperature Tht is lower. This processing corresponds to the processing according to the first embodiment wherein when $T_{O2} < 750°$ C. in FIG. 11, the corrective coefficient KVO2 is set to a larger value as element temperature $T_{O2}$ is lower.

Other structural and processing details of the apparatus according to the second embodiment than described above are exactly identical to those of the apparatus according to the first embodiment. In the present embodiment, by setting the corrective coefficient KVO2 depending on the heater temperature Tht, the target value Vtgt for the output Vout of the $O_2$ sensor 8 is indirectly set variably depending on the element temperature $T_{O2}$. By controlling the electric energy supplied to the heater 13 with the heater controller 22 so as to maintain the heater temperature Tht (which is an estimated value determined by the heater temperature observer 20) at the target value R', the element temperature $T_{O2}$ is indirectly controlled at a temperature (which is substantially equal to the target value R for the element temperature $T_{O2}$ in the first embodiment) corresponding to the target value R'. Therefore, as with the first embodiment, it is possible to control the air-fuel ratio in order to converge the output Vout of the $O_2$ sensor 8 to the target value Vtgt that is appropriate for achieving a desired exhaust gas purification capability of the catalytic converter 4 irrespective of the element temperature $T_{O2}$, thus reliably maintaining the exhaust gas purifying capability of the catalytic converter 4. As with the first embodiment, since the target value Vtgt is set in order to increase the purification rate for NOx in a situation where the engine 1 is operated to increase NOx in the exhaust gas, the catalytic converter 4 can well purify NOx.

In the first and second embodiments described above, the apparatus has the $O_2$ sensor 8 provided as an exhaust gas sensor. However, the present invention is also applicable to an exhaust sensor other than the $O_2$ sensor 8 (e.g., the wide-range air-fuel ratio sensor 9, an HC sensor, a NOx sensor, etc.).

The internal combustion engine to which the present invention is applicable may be an ordinary port-injected internal combustion engine, a spark-ignition internal combustion engine with direct fuel injection into cylinders, a diesel engine, an internal combustion engine for use as an outboard engine on a boat, etc.

Although certain preferred embodiments of the present invention have been shown and described in detail, it should be understood that various changes and modifications may be made therein without departing from the scope of the appended claims.

What is claimed is:

1. An apparatus for controlling the air-fuel ratio of an internal combustion engine, comprising:

an exhaust gas sensor disposed downstream of a catalytic converter that is positioned in an exhaust passage of the internal combustion engine;

an active element contacting an exhaust gas passing through said catalytic converter, said active element being sensitive to a particular component in the exhaust gas, so that the air-fuel ratio of the exhaust gas supplied from the internal combustion engine to the catalytic converter is controlled to converge an output of the exhaust gas sensor to a predetermined target value;

element temperature data acquiring means for sequentially acquiring element temperature data representative of the temperature of the active element of said exhaust gas sensor; and target value setting means for setting said target value variably depending on said element temperature data.

2. An apparatus according to claim 1, wherein said element temperature data acquiring means comprises means for sequentially determining an estimated value of the temperature of the active element as said element temperature data, using a parameter representative of at least an operating state of said internal combustion engine.

3. An apparatus according to claim 2, wherein said element temperature data acquiring means comprises means for estimating a temperature of the exhaust gas using the parameter representative of at least the operating state of said internal combustion engine, and determining the estimated value of the temperature of the active element, using an estimated value of the temperature of the exhaust gas and a predetermined thermal model representative of a heat exchange relationship between the exhaust gas and said active element.

4. An apparatus according to claim 3, wherein the estimated value of the temperature of the exhaust gas which is used to determine the estimated value of the temperature of the active element comprises an estimated value of the temperature of the exhaust gas in the vicinity of the location of said exhaust gas sensor, and said element temperature data acquiring means comprises means for estimating a temperature of the exhaust gas in the vicinity of an exhaust port of the internal combustion engine using the parameter representative of the operating state of said internal combustion engine, and determining an estimated value of the temperature of the exhaust gas in the vicinity of the location of said exhaust gas sensor, using an estimated value of the temperature of the exhaust gas in the vicinity of the exhaust port and a predetermined thermal model representative of a change in the temperature of the exhaust gas as the exhaust gas flows from near the exhaust port to the location of said exhaust gas sensor.

5. An apparatus according to claim 3, further comprising:

a heater for heating said active element; and heater control means for controlling said heater;

said element temperature data acquiring means comprising means for determining the estimated value of the temperature of the active element using the estimated value of the temperature of the exhaust gas, heater energy supplied quantity data representing a quantity of heating energy supplied from said heater control means to said heater, and a predetermined thermal model representative of the heat exchange relationship between said exhaust gas and said active element, a heat exchange relationship between said active element and said heater, and the heating of said heater with the heating energy supplied to said heater.

6. An apparatus according to claim 4, further comprising:

a heater for heating said active element; and heater control means for controlling said heater;

said element temperature data acquiring means comprising means for determining the estimated value of the temperature of the active element using the estimated value of the temperature of the exhaust gas in the vicinity of the location of said exhaust gas sensor, heater energy supplied quantity data representing a quantity of heating energy supplied from said heater control means to said heater, and a predetermined thermal model representative of the heat exchange relationship between said exhaust gas and said active element, a heat exchange relationship between said active element and said heater, and the heating of said heater with the heating energy supplied to said heater.

7. An apparatus according to claim 1, further comprising:

a heater for heating said active element; and heater control means for controlling said heater;

said element temperature data acquiring means comprising means for sequentially determining an estimated value of the temperature of the active element as said element temperature data, using at least heater energy supplied quantity data representing a quantity of heating energy supplied from said heater control means to said heater, and a predetermined thermal model representative of a heat exchange relationship between said active element and said heater, and the heating of said heater with the heating energy supplied to said heater.

8. An apparatus according to any one of claims 1 through 4, further comprising:

a heater for heating said active element; and heater control means for controlling said heater to keep said active element at a predetermined temperature.

9. An apparatus according to any one of claims 5 through 7, wherein said heater control means comprises means for controlling said heater to keep said active element at a predetermined temperature.

10. An apparatus for controlling the air-fuel ratio of an internal combustion engine, comprising:

an exhaust gas sensor disposed downstream of a catalytic converter that is positioned in an exhaust passage of the internal combustion engine;

an active element for contacting an exhaust gas passing through said catalytic converter, said active element being sensitive to a particular component in the exhaust gas, and a heater for heating said active element;

heater control means for controlling said heater, so that the air-fuel ratio of the exhaust gas supplied from the internal combustion engine to the catalytic converter is controlled to converge an output of the exhaust gas sensor to a predetermined target value;

heater temperature data acquiring means for sequentially acquiring heater temperature data representative of the temperature of the heater of said exhaust gas sensor; and target value setting means for setting said target value variably depending on said heater temperature data.

11. An apparatus according to claim 10, wherein said heater temperature data acquiring means comprises means for estimating a temperature of the exhaust gas using a parameter representative of at least an operating state of said internal combustion engine, and sequentially determining an estimated value of the temperature of said heater as said heater temperature data, using an estimated value of the temperature of the exhaust gas, heater energy supplied quantity data representing a quantity of heating energy supplied from said heater control means to said heater, and a predetermined thermal model representative of a heat exchange relationship between said exhaust gas and said active element, a heat exchange relationship between said active element and said heater, and the heating of said heater with the heating energy supplied to said heater.

12. An apparatus according to claim 11, wherein the estimated value of the temperature of the exhaust gas which is used to determine the estimated value of the temperature of the heater comprises an estimated value of the temperature of the exhaust gas in the vicinity of the location of said exhaust gas sensor, and said heater temperature data acquiring means comprises means for estimating a temperature of the exhaust gas in the vicinity of an exhaust port of the internal combustion engine using the parameter representative of the operating state of said internal combustion engine, and determining an estimated value of the temperature of the exhaust gas in the vicinity of the location of said exhaust gas sensor, using an estimated value of the temperature of the exhaust gas in the vicinity of the exhaust port and a predetermined thermal model representative of a change in the temperature of the exhaust gas as the exhaust gas flows from near the exhaust port to the location of said exhaust gas sensor.

13. An apparatus according to claim 10, wherein said heater temperature data acquiring means comprises means for sequentially determining an estimated value of the temperature of said heater as said heater temperature data, using at least heater energy supplied quantity data representing a quantity of heating energy supplied from said heater control means to said heater, and a predetermined thermal model representative of a heat exchange relationship between said active element and said heater, and the heating of said heater with the heating energy supplied to said heater.

14. An apparatus according to any one of claims 10 through 13, wherein said heater control means comprises means for controlling said heater to keep said active element at a predetermined temperature.

15. A method of controlling the air-fuel ratio of an internal combustion engine, comprising:

disposing an exhaust gas sensor downstream of a catalytic converter that is positioned in an exhaust passage of the internal combustion engine;

providing an active element for contacting an exhaust gas passing through said catalytic converter, said active element being sensitive to a particular component in the exhaust gas;

controlling the air-fuel ratio of the exhaust gas supplied from the internal combustion engine to the catalytic converter using the active element to converge an output of the exhaust gas sensor to a predetermined target value;

sequentially acquiring element temperature data representative of the temperature of the active element of said exhaust gas sensor; and sequentially setting said target value variably depending on said element temperature data.

16. A method according to claim 15, further comprising the step of:

sequentially determining an estimated value of the temperature of the active element as said element temperature data, using a parameter representative of at least an operating state of said internal combustion engine.

17. A method according to claim 16, wherein said step of sequentially determining the estimated value of the temperature of the active element comprises the steps of sequentially estimating a temperature of the exhaust gas using the parameter representative of at least the operating state of said internal combustion engine, and determining the estimated value of the temperature of the active element, using an estimated value of the temperature of the exhaust gas and a predetermined thermal model representative of a heat exchange relationship between the exhaust gas and said active element.

18. A method according to claim 17, wherein the estimated value of the temperature of the exhaust gas which is used to determine the estimated value of the temperature of the active element comprises an estimated value of the temperature of the exhaust gas in the vicinity of the location of said exhaust gas sensor, and said step of sequentially determining the estimated value of the temperature of the active element comprises the steps of estimating a temperature of the exhaust gas in the vicinity of an exhaust port of the internal combustion engine using the parameter representative of the operating state of said internal combustion engine, and determining an estimated value of the temperature of the exhaust gas in the vicinity of the location of said exhaust gas sensor, using an estimated value of the temperature of the exhaust gas in the vicinity of the exhaust port and a predetermined thermal model representative of a change in the temperature of the exhaust gas as the exhaust gas flows from near the exhaust port to the location of said exhaust gas sensor.

19. A method according to claim 17, wherein said step of sequentially determining the estimated value of the temperature of the active element comprises the steps of determining the estimated value of the temperature of the active element using the estimated value of the temperature of the exhaust gas, heater energy supplied quantity data representing a quantity of heating energy supplied to a heater for heating said active element, and a predetermined thermal model representative of the heat exchange relationship between said exhaust gas and said active element, a heat exchange relationship between said active element and said heater, and the heating of said heater with the heating energy supplied to said heater.

20. A method according to claim 18, wherein said step of sequentially determining the estimated value of the temperature of the active element comprises the steps of determining the estimated value of the temperature of the active element using the estimated value of the temperature of the exhaust gas in the vicinity of the location of said exhaust gas sensor, heater energy supplied quantity data representing a quantity of heating energy supplied a heater for heating said active element, and a predetermined thermal model representative of the heat exchange relationship between said exhaust gas and said active element, a heat exchange relationship between said active element and said heater, and the heating of said heater with the heating energy supplied to said heater.

21. A method according to claim 15, further comprising the step of:

sequentially determining an estimated value of the temperature of the active element as said element temperature data, using heater energy supplied quantity data representing a quantity of heating energy supplied to a heater for heating said active element, and a predetermined thermal model representative of a heat exchange relationship between said active element and said heater, and the heating of said heater with the heating energy supplied to said heater.

22. A method according to any one of claims 15 through 18, further comprising the step of:

controlling a heater for heating said active element to keep said active element at a predetermined temperature.

23. A method according to any one of claims 19 through 21, further comprising the step of:

controlling said heater to keep said active element at a predetermined temperature.

24. A method of controlling the air-fuel ratio of an internal combustion engine, comprising:

disposing an exhaust gas sensor downstream of a catalytic converter that is positioned in an exhaust passage of the internal combustion engine;

providing an active element for contacting an exhaust gas passing through said catalytic converter, said active element being sensitive to a particular component in the exhaust gas;

heating said active element using a heater, so that the air-fuel ratio of the exhaust gas supplied from the internal combustion engine to the catalytic converter is controlled to converge an output of the exhaust gas sensor to a predetermined target value;

sequentially acquiring heater temperature data representative of the temperature of said heater; and setting said target value variably depending on said heater temperature data.

25. A method according to claim 24, further comprising the steps of:

estimating a temperature of the exhaust gas using a parameter representative of at least an operating state of said internal combustion engine; and sequentially determining an estimated value of the temperature of said heater as said heater temperature data, using an estimated value of the temperature of the exhaust gas, heater energy supplied quantity data representing a quantity of heating energy supplied to said heater, and a predetermined thermal model representative of a heat exchange relationship between said exhaust gas and said active element, a heat exchange relationship between said active element and said heater, and the heating of said heater with the heating energy supplied to said heater.

26. A method according to claim 25, wherein the estimated value of the temperature of the exhaust gas which is used to determine the estimated value of the temperature of the heater comprises an estimated value of the temperature of the exhaust gas in the vicinity of the location of said exhaust gas sensor, and said step of sequentially determining the estimated value of the temperature of the heater comprises the steps of estimating a temperature of the exhaust gas in the vicinity of an exhaust port of the internal combustion engine using the parameter representative of the operating state of said internal combustion engine, and determining an estimated value of the temperature of the exhaust gas in the vicinity of the location of said exhaust gas sensor, using an estimated value of the temperature of the exhaust gas in the vicinity of the exhaust port and a predetermined thermal model representative of a change in the temperature of the exhaust gas as the exhaust gas flows from near the exhaust port to the location of said exhaust gas sensor.

27. A method according to claim 24, further comprising the step of:

sequentially determining an estimated value of the temperature of said heater as said heater temperature data, using at least heater energy supplied quantity data representing a quantity of heating energy supplied to said heater, and a predetermined thermal model representative of a heat exchange relationship between said active element and said heater, and the heating of said heater with the heating energy supplied to said heater.

28. A method according to any one of claims 24 through 27, further comprising the step of:

controlling said heater to keep said active element at a predetermined temperature.

29. A recording medium readable by a computer and storing an air-fuel ratio control program for enabling the computer to control the air-fuel ratio of an internal combustion engine, said air-fuel ratio control program comprising a program for enabling said computer to perform the steps of: disposing an exhaust gas sensor downstream of a catalytic converter that is positioned in an exhaust passage of the internal combustion engine; providing an active element for contacting an exhaust gas passing through said catalytic converter, said active element being sensitive to a particular component in the exhaust gas; controlling the air-fuel ratio of the exhaust gas supplied from the internal combustion engine to the catalytic converter using the active element to converge an output of the exhaust gas sensor to a predetermined target value;

sequentially acquiring element temperature data representative of the temperature of the active element of said exhaust gas sensor; and setting said target value variably depending on said element temperature data.

30. A recording medium according to claim 29, wherein said program for enabling said computer to sequentially acquire the element temperature data is arranged to enable said computer to sequentially determine an estimated value of the temperature of the active element as said element temperature data, using a parameter representative of at least an operating state of said internal combustion engine.

31. A recording medium according to claim 30, wherein said program for enabling said computer to sequentially acquire the element temperature data is arranged to enable said computer to sequentially estimate a temperature of the exhaust gas using the parameter representative of at least the operating state of said internal combustion engine, and determine the estimated value of the temperature of the active element, using an estimated value of the temperature of the exhaust gas and a predetermined thermal model representative of a heat exchange relationship between the exhaust gas and said active element.

32. A recording medium according to claim 31, wherein the estimated value of the temperature of the exhaust gas which is used to determine the estimated value of the temperature of the active element comprises an estimated value of the temperature of the exhaust gas in the vicinity of the location of said exhaust gas sensor, and said program for enabling said computer to sequentially acquire the element temperature data is arranged to enable said computer to estimate a temperature of the exhaust gas in the vicinity of an exhaust port of the internal combustion engine using the parameter representative of the operating state of said internal combustion engine, and determine an estimated value of the temperature of the exhaust gas in the vicinity of the location of said exhaust gas sensor, using an estimated value of the temperature of the exhaust gas in the vicinity of the exhaust port and a predetermined thermal model representative of a change in the temperature of the exhaust gas as the exhaust gas flows from near the exhaust port to the location of said exhaust gas sensor.

33. A recording medium according to claim 31, wherein said program for enabling said computer to sequentially acquire the element temperature data is arranged to enable said computer to determine the estimated value of the temperature of the active element using the estimated value of the temperature of the exhaust gas, heater energy supplied quantity data representing a quantity of heating energy supplied to a heater for heating said active element, and a predetermined thermal model representative of the heat exchange relationship between said exhaust gas and said active element, a heat exchange relationship between said active element and said heater, and the heating of said heater with the heating energy supplied to said heater.

34. A recording medium according to claim 32, wherein said program for enabling said computer to sequentially acquire the element temperature data is arranged to enable said computer to determine the estimated value of the temperature of the active element using the estimated value of the temperature of the exhaust gas in the vicinity of the location of said exhaust gas sensor, heater energy supplied quantity data representing a quantity of heating energy supplied a heater for heating said active element, and a predetermined thermal model representative of the heat exchange relationship between said exhaust gas and said active element, a heat exchange relationship between said active element and said heater, and the heating of said heater with the heating energy supplied to said heater.

35. A recording medium according to claim 29, wherein said program for enabling said computer to sequentially acquire the element temperature data is arranged to enable said computer to sequentially determine an estimated value of the temperature of the active element as said element temperature data, using heater energy supplied quantity data representing a quantity of heating energy supplied to a heater for heating said active element, and a predetermined thermal model representative of a heat exchange relationship between said active element and said heater, and the heating of said heater with the heating energy supplied to said heater.

36. A recording medium according to any one of claims 29 through 32, wherein said air-fuel ratio control program includes a program for enabling said computer to control a heater for heating said active element to keep said active element at a predetermined temperature.

37. A recording medium according to any one of claims 33 through 35, wherein said air-fuel ratio control program includes a program for enabling said computer to control said heater to keep said active element at a predetermined temperature.

38. A recording medium readable by a computer and storing an air-fuel ratio control program for enabling the computer to control the air-fuel ratio of an internal combustion engine, said air-fuel ratio control program comprising a program for enabling said computer to perform the steps of: disposing an exhaust gas sensor downstream of a catalytic converter that is positioned in an exhaust passage of the internal combustion engine; providing an active element for contacting an exhaust gas passing through said catalytic converter, said active element being sensitive to a particular component in the exhaust gas; heating said active element using a heater, so that the air-fuel ratio of the exhaust gas supplied from the internal combustion engine to the catalytic converter is controlled to converge an output of the exhaust gas sensor to a predetermined target value and a heater; sequentially acquiring heater temperature data representative of the temperature of said heater; and setting said target value variably depending on said heater temperature data.

39. A recording medium according to claim 38, wherein said program for enabling said computer to sequentially acquire heater temperature data is arranged to enable said computer to estimate a temperature of the exhaust gas using a parameter representative of at least an operating state of said internal combustion engine, and sequentially determine an estimated value of the temperature of said heater as said heater temperature data, using an estimated value of the temperature of the exhaust gas, heater energy supplied quantity data representing a quantity of heating energy supplied to said heater, and a predetermined thermal model representative of a heat exchange relationship between said exhaust gas and said active element, a heat exchange relationship between said active element and said heater, and the heating of said heater with the heating energy supplied to said heater.

40. A recording medium according to claim 39, wherein the estimated value of the temperature of the exhaust gas which is used to determine the estimated value of the temperature of the heater comprises an estimated value of the temperature of the exhaust gas in the vicinity of the location of said exhaust gas sensor, and said program for enabling said computer to sequentially acquire heater temperature data is arranged to enable said computer to estimate a temperature of the exhaust gas in the vicinity of an exhaust port of the internal combustion engine using the parameter representative of the operating state of said internal combustion engine, and determine an estimated value of the temperature of the exhaust gas in the vicinity of the location of said exhaust gas sensor, using an estimated value of the temperature of the exhaust gas in the vicinity of the exhaust port and a predetermined thermal model representative of a change in the temperature of the exhaust gas as the exhaust gas flows from near the exhaust port to the location of said exhaust gas sensor.

41. A recording medium according to claim 38, wherein said program for enabling said computer to sequentially acquire heater temperature data is arranged to enable said computer to sequentially determine an estimated value of the temperature of said heater as said heater temperature data, using at least heater energy supplied quantity data representing a quantity of heating energy supplied to said heater, and a predetermined thermal model representative of a heat exchange relationship between said active element and said heater, and the heating of said heater with the heating energy supplied to said heater.

42. A recording medium according to any one of claims 38 through 41, wherein said air-fuel ratio control program includes a program for enabling said computer to control said heater to keep said active element at a predetermined temperature.

* * * * *